US005907319A

United States Patent [19]

Hashimoto et al.

[11] Patent Number: 5,907,319

[45] Date of Patent: May 25, 1999

[54] IMAGE FORMING APPARATUS PROMOTING EASY FUNCTION SETTING

[75] Inventors: Yasunari Hashimoto, Tokyo; Yoshimine Horiuchi, Yokohama; Masao Moriya, Kawasaki; Shunsuke Watanabe, Tokyo, all of Japan

[73] Assignee: Ricoh Company, Ltd., Tokyo, Japan

[21] Appl. No.: 08/612,489

[22] Filed: Mar. 7, 1996

[30] Foreign Application Priority Data

Mar. 7, 1995 [JP] Japan ..... 7-047111
Dec. 25, 1995 [JP] Japan ..... 7-337158

[51] Int. Cl.[6] ..... G03G 21/00

[52] U.S. Cl. ..... 345/173; 345/146; 345/357; 358/468; 399/75; 399/82

[58] Field of Search ..... 345/173, 112, 345/146, 357; 358/468; 399/75, 77, 81, 82, 83, 85, 87; 395/333, 336, 337, 338

[56] References Cited

U.S. PATENT DOCUMENTS

| | | | |
|---|---|---|---|
| 4,491,827 | 1/1985 | Sugiura et al. | 340/365 |
| 4,708,461 | 11/1987 | Okuda et al. | 355/14 R |
| 4,764,789 | 8/1988 | Iwaki et al. | 399/81 |
| 4,870,458 | 9/1989 | Shibuya et al. | 355/200 |
| 4,970,549 | 11/1990 | Yoshizuka et al. | 399/81 |
| 5,012,280 | 4/1991 | Tsutsumi et al. | 399/81 |
| 5,025,395 | 6/1991 | Nose et al. | 345/335 |
| 5,066,977 | 11/1991 | Yoshizuka | 399/80 |
| 5,115,501 | 5/1992 | Kerr | 707/9 |
| 5,192,942 | 3/1993 | Yamada et al. | 345/146 |
| 5,192,992 | 3/1993 | Yamada et al. | 340/706 |
| 5,300,761 | 4/1994 | Kasahara et al. | 235/375 |
| 5,390,005 | 2/1995 | Kimoto et al. | 399/81 |
| 5,579,088 | 11/1996 | Ko | 355/203 |

FOREIGN PATENT DOCUMENTS

| | | |
|---|---|---|
| 6-35605 | 2/1994 | Japan . |
| 6-130766 | 5/1994 | Japan . |

*Primary Examiner*—Steven J. Saras
*Assistant Examiner*—Vincent E. Kovalick
*Attorney, Agent, or Firm*—Oblon, Spivak, McClelland, Maier & Neustadt, P.C.

[57] ABSTRACT

In an image forming apparatus, picture display control means causes display means to selectively display a simple picture which allows a limited number of basic functions to be selected, or a standard picture which allows all the functions, inclusive of the functions available with the simple picture, to be selected. The simple picture and standard picture are switched over by software. The operation of the apparatus may be permitted only when a user code matching any one of user codes registered beforehand is input; either the simple picture or the standard picture may be set for each user code and displayed as the initial picture. The apparatus allows the operator to set up functions matching the contents of image formation and operator's skill without resorting to an openable cover for concealing a part of function setting keys.

33 Claims, 48 Drawing Sheets

ADDRESS DECODER
140
SERIAL I/F
EDITOR
USARP
ADF
B
131
136
SERIAL I/F
OPERATION PANEL UNIT
USARP
CPU 130
SCANNER
15
USARP
137
FAX
USARP
138
I/F UNIT
USARP
CPU (MAIN)
135
ADDRESS LATCH
CALENDER IC
TONER CONSUMPTION DATA
DATA1·DATA2
DATA10~13 DATA20~23
CLK,LSYNC,LGATE,FGATE
PMSYNC
ROM
RAM
139
CG CARD
CPU 130
GATE ARRAY 134

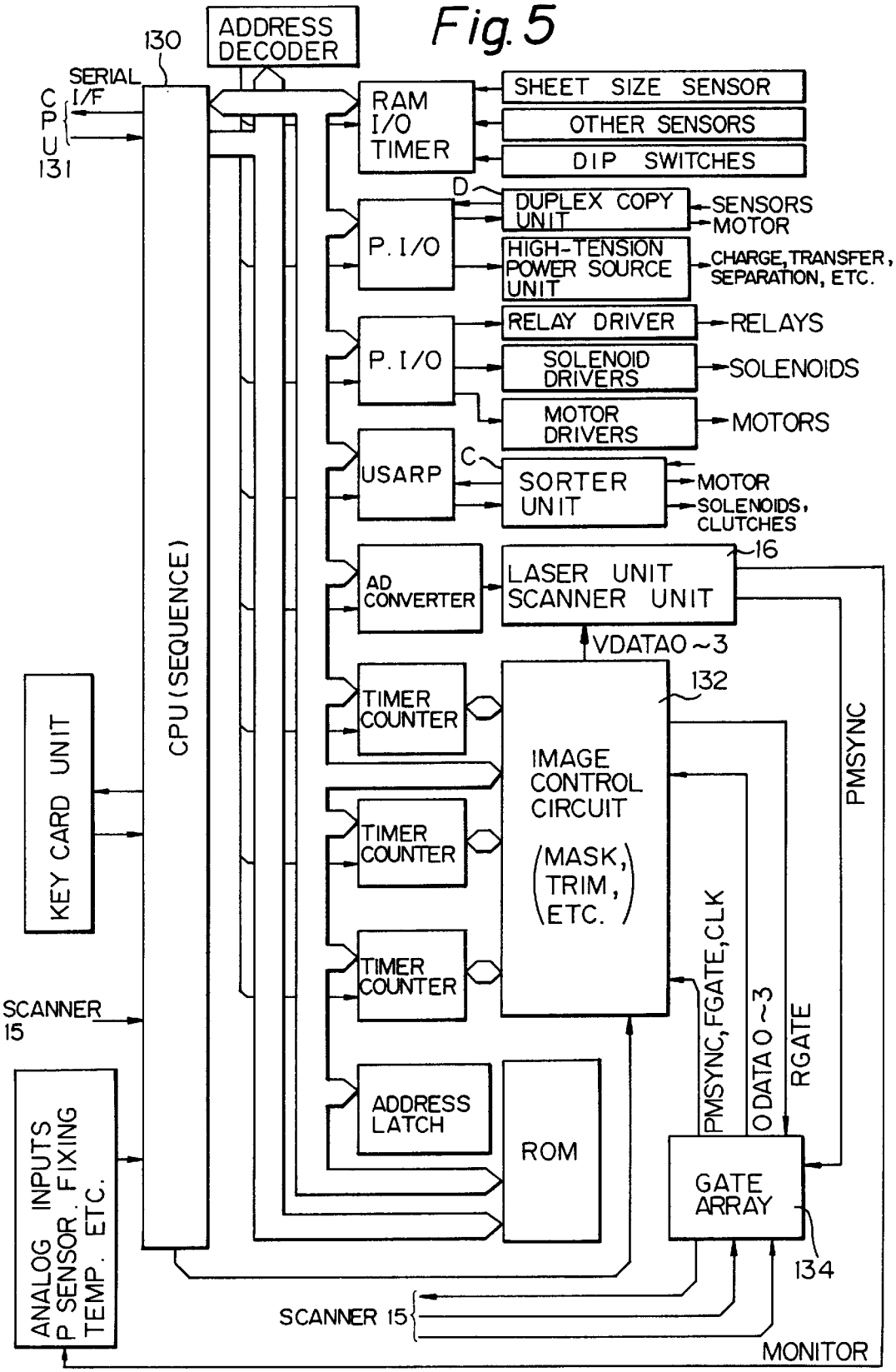
Fig. 5
ADDRESS DECODER
130
SERIAL I/F
CPU 131
CPU (SEQUENCE)
RAM I/O TIMER
SHEET SIZE SENSOR
OTHER SENSORS
DIP SWITCHES
D
DUPLEX COPY UNIT
SENSORS
MOTOR
P. I/O
HIGH-TENSION POWER SOURCE UNIT
CHARGE, TRANSFER, SEPARATION, ETC.
RELAY DRIVER
RELAYS
P. I/O
SOLENOID DRIVERS
SOLENOIDS
MOTOR DRIVERS
MOTORS
USARP
C
SORTER UNIT
MOTOR
SOLENOIDS, CLUTCHES
AD CONVERTER
LASER UNIT SCANNER UNIT
16
VDATA0~3
132
TIMER COUNTER
TIMER COUNTER
TIMER COUNTER
IMAGE CONTROL CIRCUIT
(MASK, TRIM, ETC.)
PMSYNC
KEY CARD UNIT
SCANNER 15
ADDRESS LATCH
ROM
PMSYNC, FGATE, CLK
ODATA 0~3
RGATE
GATE ARRAY
134
ANALOG INPUTS P SENSOR. FIXING TEMP. ETC.
SCANNER 15
MONITOR

| Fig. 21A |
| --- |
| Fig. 21B |

| Fig. 32A | Fig. 32B |
|---|---|

| Fig. 33A | Fig. 33B |
|---|---|

IMAGE FORMING APPARATUS PROMOTING EASY FUNCTION SETTING

BACKGROUND OF THE INVENTION

1. Field of the Invention

The present invention relates to a copier, laser printer or similar image forming apparatus and, more particularly, to an image forming apparatus allowing the operator to set functions easily on its operation panel without regard to the operator's skill.

2. Discussion of the Background

Japanese Patent Laid-Open Publication No. 62-200365, for example, discloses a copier having an openable cover for covering a part of mode (function) setting keys on its operation panel. When the cover is closed to conceal a part of the mode setting keys, preselected standard (default) modes available with the concealed keys are unconditionally set up while some limited number of basic functions are selectable on the other or open keys. When the cover is opened, all the functions available with the keys are selectable. On the other hand, Japanese Patent Laid-Open Publication No. 1-120572 teaches a copier having a display and a touch panel provided on the display surface of the display. The touch panel is a transparent sheet-like touch matrix switch. The display is implemented as, e.g., a liquid crystal display or a fluorescent display tube capable of displaying functions relating to an image forming apparatus and including sheet cassette information. When the operator of the copier touches a desired part of the touch panel, a function assigned to the desired part is set up.

The openable cover scheme selectively renders only some limited number of keys or all the keys accessible, so that the operator can select functions matching the contents of image formation and the operator's skill. However, the problem is that the operator must open and close the cover by hand. The touch panel scheme allows various kinds of functions to be selected because keys can be arranged in any desired layout, compared to a system using hard keys and light emitting diodes. However, such a scheme is not practicable without resorting to a complicated operation panel which would be a burden for some operators who desire only basic functions or are not fully experienced. Should the number of items available for the operator be reduced in order to facilitate the operation, the number of functions would, of course, be reduced.

SUMMARY OF THE INVENTION

It is therefore an object of the present invention to provide an image forming apparatus allowing an operator to set desired functions easily without regard to the operator's skill and without resorting to the conventional openable cover.

An image forming apparatus of the present invention has a display section for displaying information on functions relating to an image forming operation. A position sensing device has a matrix touch switch provided on the display surface of the display section, and senses a position of the matrix touch switch touched by the operator. A function setting section sets a function designated by the position touched by the operator. A picture display section causes the display section to selectively display a simple picture which allows a limited number of basic functions to be selected, or a standard picture which allows all functions including the limited number of basic functions to be selected. A picture switching section selects one of the simple picture and standard picture.

BRIEF DESCRIPTION OF THE DRAWINGS

The above and other objects, features and advantages of the present invention will become more apparent from the following detailed description taken with the accompanying drawings in which:

FIGS. 4 and 5 are schematic block diagrams showing in combination a part of a control system for controlling the entire copier of FIG. 2;

DESCRIPTION OF THE PREFERRED EMBODIMENTS

Figure 1:
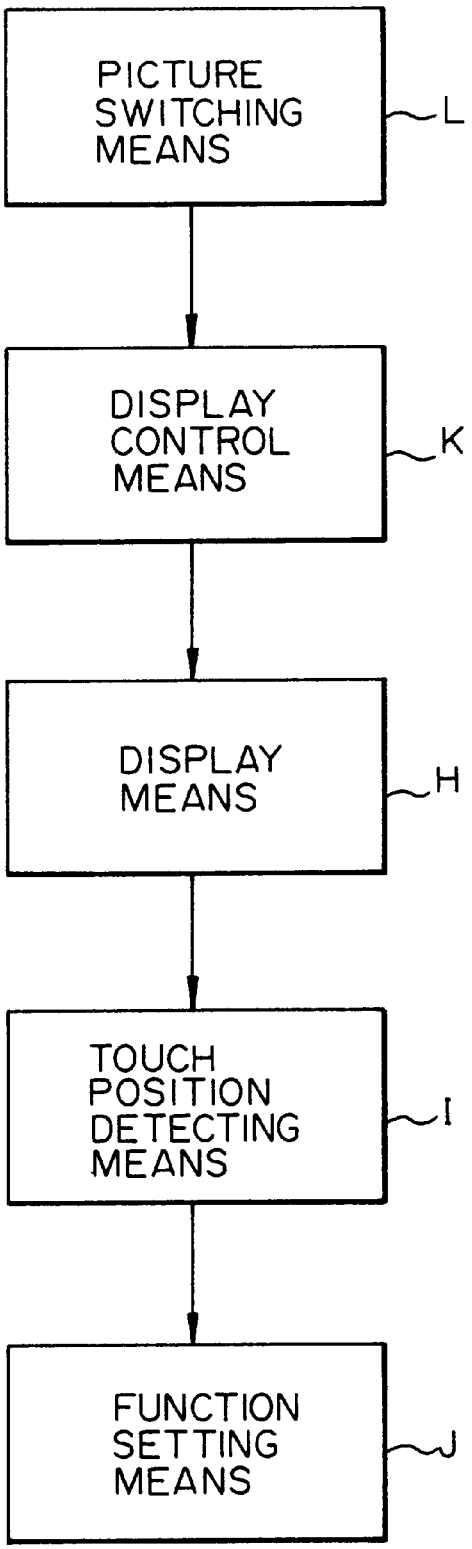
FIG. 1 is a block diagram schematically showing the basic construction of the present invention.

Referring to FIG. 1 of the drawings, the basic arrangement of the present invention is shown and generally made up of display means H, touch position detecting means I, function setting means J, picture display control means K, and picture switching means L. The display means H is implemented by, e.g., a liquid crystal display or a fluorescent display tube and displays various kinds of information representative of functions relating to a copying operation, e.g., information representative of a sheet cassette selected. The touch position detecting means I is implemented as a transparent sheet-like matrix touch switch and provided on the display surface of the display means H. When the operator touches a desired part of the detecting means I, the detecting means I detects it. The function setting means J sets a function corresponding to the position detected by the detecting means I. The picture display control means K causes the display means H to selectively display a simple picture or a standard picture. The simple picture allows the operator to select a limited number of basic functions. On the other hand, the standard picture allows the operator to select all the available functions inclusive of the functions available with the simple picture. The picture switching means L selects either the simple picture or the standard picture.

A preferred embodiment of the image forming apparatus in accordance with the present invention and implemented as a digital copier by way of example will be described hereinafter.

Figure 2:
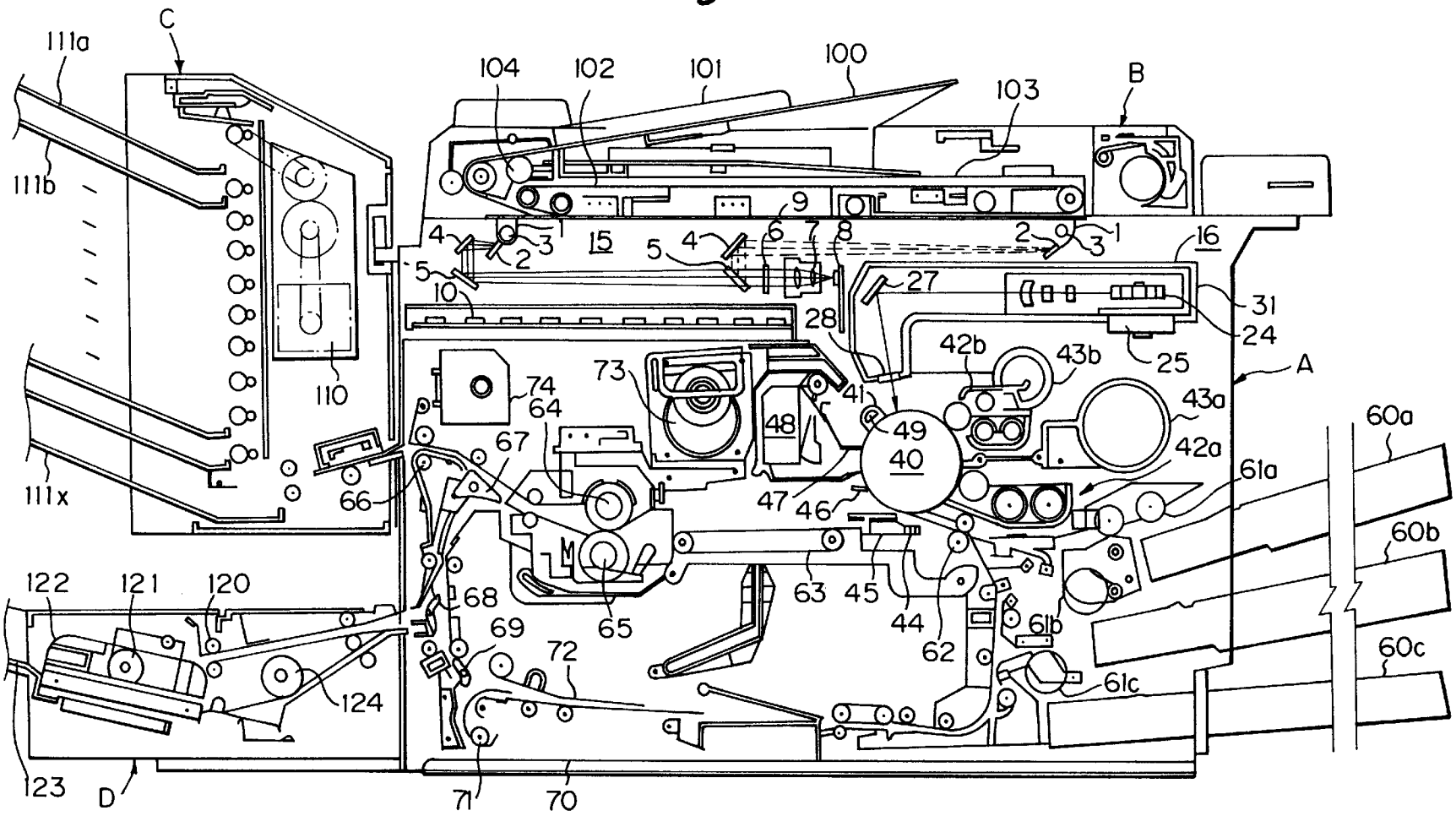
FIG. 2 is a section of an image forming apparatus embodying the present invention and implemented as a digital copier by way of example.

Referring to FIG. 2, the digital copier has a copier body A, an ADF (Automatic Document Feeder) B, a sorter C, and a turn-over unit D for a duplex copy mode, i.e., four units in total.

Copier Body

The copier body A has a scanner section, an optical writing section, a photoconductive element section, a developing section, and a transport section. The constructions and operations of these sections are as follows.

(1) Scanner Section

The scanner section, generally 15, has a first scanner including a reflector 1, a light source 3, and a first mirror 2, and a second scanner including a second mirror 4 and a third mirror 5. The first scanner is movable at a constant speed while the second scanner follows the movement of the first scanner at one half of the speed of the first scanner. When the two scanners optically scan a document, not shown, laid on a glass platen 9 in cooperation, the resulting imagewise reflection from the document is focused onto a monodimensional solid-state imaging device 8 via a color filter 6 and a lens 7. While the light source 3 may be implemented by any suitable lamp, e.g., a fluorescent lamp or a halogen lamp, a fluorescent lamp is predominant over the others due to its stable wavelength and long life. Although the reflector 1 is shown as being associated with a single light source 3, two or more light sources may be used, if desired.

The solid-state imaging device 8 has a constant sampling clock. Hence, the light source would adversely effect images if it were not turned on at a frequency higher than the sampling clock. Generally, a CCD (Charge Coupled Device) image sensor is used for the imaging device 8. The imaging device 8 generates an analog image signal representative of the document image. The analog image signal is transformed to a digital image signal. An image processing board 10 performs various kinds of image processing, e.g., bilevel and multilevel conversion, tonality processing, magnification change, and editing with the digital signal, thereby transforming it to an aggregation of spots.

In the illustrative embodiment, to generate color image data, the color filter 6 for transmitting only the information of necessary colors is movable into and out of the optical path extending from the document to the image sensor 8. Every time the two cooperative scanners scan the document, the color filter 6 is moved into or out of the optical path. At the same time, a multiplex copy function, duplex copy function or any other desired function is executed so as to produce any desired kind of copies.

(2) Optical Writing Section

The optical writing section, generally 16, writes the processed image data on a photoconductive drum 40 in the form of an aggregation of beam spots by the raster scanning of a laser beam. It has been customary with copiers to use an He—Ne laser as a laser beam source because it has a wavelength of 633 nm which matches well with the sensitivity of a conventional photoconductor. However, the problem is that the He—Ne laser is expensive. Another problem is that the He—Ne laser needs a complicated arrangement because it cannot be directly modulated. Today, semiconductor lasers which are inexpensive and can be directly modulated are available due to the enhanced sensitivity of photoconductors in a long wavelength range. The embodiment also uses a semiconductor laser.

Figure 3:
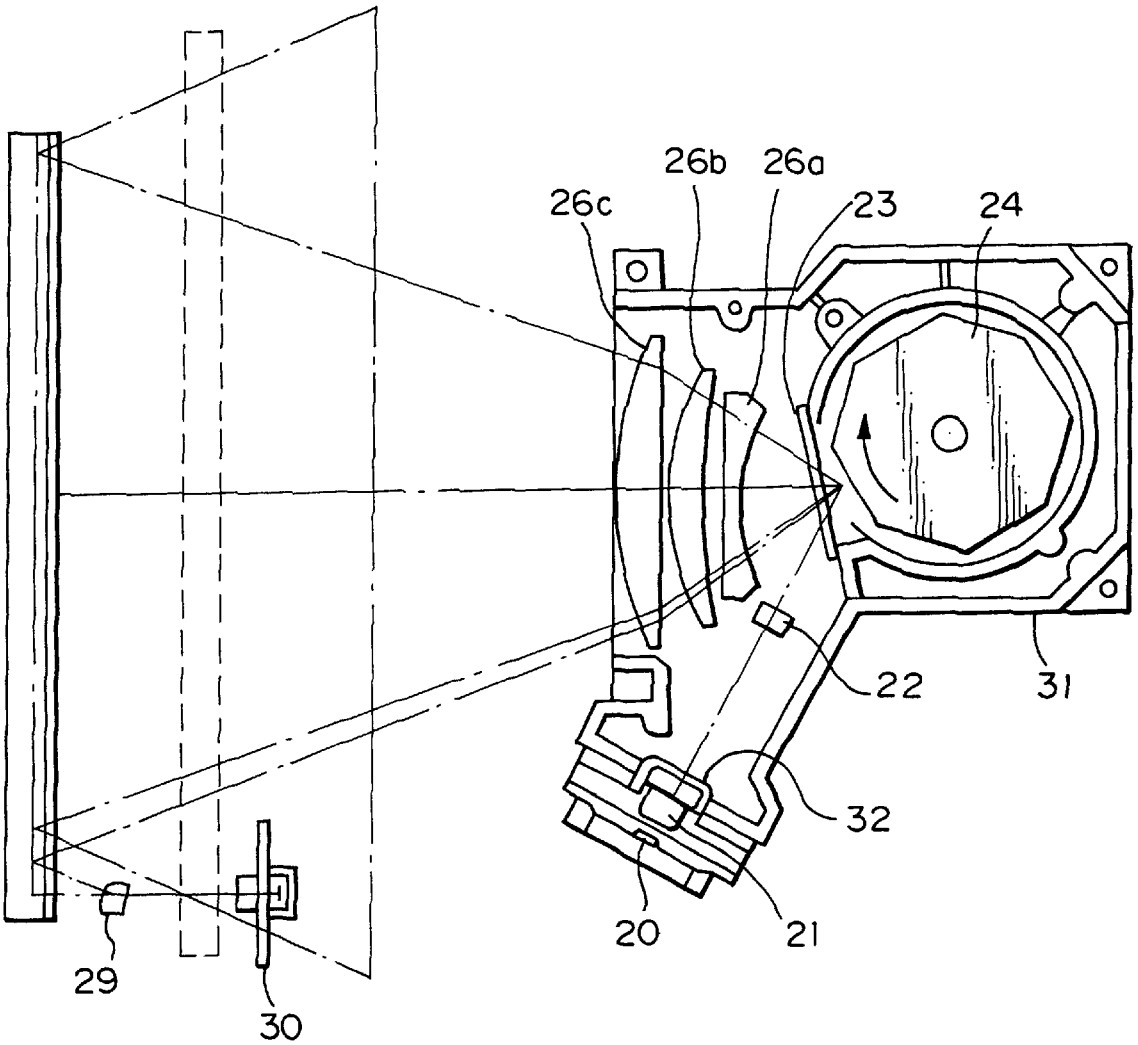
FIG. 3 is a plan view of an optical writing section included in the embodiment.

As shown in FIG. 3, a semiconductor laser 20 mounted on a casing 31 emits a laser beam. The beam is collimated by a collimator lens 21 and then provided with a preselected shape by an aperture 32. The beam from the aperture 32 is compressed in the subscanning direction by a first cylinder lens 22 and then incident to a polygon mirror 24 having an accurate polygonal configuration. A polygon motor 25 (see FIG. 2) causes the polygon mirror 24 to rotate at a constant speed in a preselected direction. The rotation speed of the mirror 24 is determined by the rotation speed and writing density of the drum 40 and the number of faces of the mirror 24.

The polygon mirror 24 in rotation reflects the laser beam incident thereto. The laser beam from the mirror 24 is sequentially incident to f-θ lenses 26*a*, 26*b* and 26*c*. The f-θ lenses 26*a*–26*c* cause the incident laser beam having a constant angular velocity to scan the drum 40 at a constant linear speed while forming a spot of minimum diameter on the drum 40. In addition, the lenses 26*a*–26*c* serve to compensate for irregularities in the configuration of the polygon mirror 24. The laser beam transmitted through the lenses 26*a*–26*c* is steered by a mirror 29 to a synchronization sensor 30 located at the outside of the image area of the drum 40. After a synchronizing signal representative of the leading end of a main scanning line has been output, one line of image data is output on the elapse of a preselected period of time. This is repeated until a single image has been formed on the drum 40.

(3) Photoconductive Element Section

The drum 40 shown in FIG. 2 has a photoconductive layer on the periphery thereof. While photoconductors sensitive to a semiconductor laser (wavelength of 780 nm) include an organic photoconductor (OPC), α—Si and Se—Te, the embodiment uses OPC by way of example. Generally, for laser writing, there are available two different processes, i.e., a negative-to-positive (N/P) process which illuminates an image area and a positive-to-positive (P/P) process which illuminates a background area. The embodiment effects laser writing with the N/P process.

A main charger 41 is a scorotron charger having a grid on its side adjoining the drum 40. The main charger 41 uniformly charges the surface of the drum 40 to the negative polarity. The laser beam illuminates the image area of the charged surface and thereby reduces the potential of the image area. As a result, the drum 40 is provided with a potential of about −750 V to −800 V in its background area and a potential of about −500 V in its image area. Such a potential distribution on the drum 40 is an electrostatic latent image. Developing devices 42*a* and 42*b* each have a developing roller to which a bias voltage of −500 V to −600 V is applied in the event of development. In this condition, toner of a particular color and charged to the negative polarity is fed from each of the developing devices 42*a* and 52*b* to the latent image, thereby developing the latent image.

(4) Developing Section

The developing units 42*a* and 42*b* are respectively a main and an auxiliary developing unit and constitute the developing section. When copies should be produced in black, the auxiliary developing device 42*b* and a toner replenishing device 43*b* associated therewith are removed from the copier body A. A toner replenishing device 43*a* is associated with the main developing device 42*a* and filled with black toner. The toner replenishing device 43*b* is filled with color toner. While one of the developing devices 42*a* and 42*b* is in operation, the other developing unit is held inoperative by, e.g., having its main pole position changed. With this developing scheme and by switching the color filter 6 and combining the multiplex image transfer function, a duplex copy function and other functions available with a sheet transport system, it is possible to produce various kinds of color copies and to edit images in color. For development using three or more different colors, three or more developing devices may be arranged around the drum 40, or a revolver having three or more developing devices may be used.

When a paper or similar sheet is fed in synchronism with the rotation of the drum 40, the image developed by one or both of the developing devices 42*a* and 42*b* is transferred to the sheet by a transfer charger 44. Specifically, the transfer charger 44 applies a positive charge to the sheet from the rear of the sheet. The sheet carrying the image thereon is subjected to AC discharge by a separation charger 45 supported integrally with the transfer charger 44. Subsequently, the sheet is separated from the drum 40 by a separator 46. The toner left on the drum 40 after the image transfer is scraped off by a cleaning blade 47 and then collected in a waste toner tank 48. The potential pattern also left on the drum 40 after the image transfer is dissipated by light issuing from a discharge lamp 49.

(5) Transport Section

The copier body A is loaded with three removable sheet cassettes 60*a*, 60*b* and 60*c* each storing a stack of sheets of particular size. When the operator selects one of the cassettes 60*a*–60*c* and then presses a start button, not shown, a pick-up roller 61 (61*a*, 61*b* or 61*c*) adjoining the cassette selected starts rotating and feeds the uppermost sheet from the cassette. When the leading edge of the sheet abuts against a registration roller 62 which is not in rotation, the pick-up roller 61 stops rotating. The registration roller 62 starts rotating at such a timing that the sheet will meet the toner image formed on the drum 40.

After the toner image has been transferred from the drum 40 to the sheet at the image transfer station, as stated earlier, a conveyor 63 conveys the sheet to between a heat roller 64 and a press roller 65 while sucking it thereonto. The heat roller 64 and press roller 65 cooperate to fix the toner image on the sheet by heating it. In a simplex copy mode, the sheet with the fixed image is driven out via an outlet adjoining the sorter C by way of a path selector 67 and an outlet roller 66. In a multiplex copy mode, the sheet is steered by path selectors 68 and 69 into a refeed loop 72 formed in the lower portion of the copier body A. The refeed loop 72 again brings the sheet to the image transfer station.

A duplex copy mode is selectively implemented only by the copier body A or by the copier body A and turn-over unit D. The following description will concentrate on the former case. The sheet steered downward by the path selector 67 is guided further downward by the path selector 68 and then guided by the path selector 69 to a duplex copy tray 70 disposed below the refeed loop 72. Subsequently, a roller 71 is reversed, and the path selector 69 is repositioned. As a result, the sheet is driven into the refeed loop 72 while being turned upside down.

ADF

The ADF B automatically conveys one document to the glass platen 9 at a time and then drives it out after copying.

Specifically, a stack of documents are laid on a document feed tray 100 and positioned in the widthwise direction by side guides 101 (only one is visible). One document is separated from the others by a pick-up roller 104. A conveyor belt 102 conveys the separated document to a preselected position on the glass platen 9 and positions it there. After a predetermined number of copies have been produced with the document positioned on the glass platen 9, the belt 102 discharges the document to a receive tray 103. By detecting the positions of the side guides 101 and counting the document transport time, it is possible to determine the document size.

Sorter

The sheets or copies sequentially coming out of the copier body A are selectively distributed to bins 111*a*–111*x* included in the sorter C in order of page or page by page. The sheets may even be distributed to only preselected ones of the bins 111*a*–111*x*. A plurality of rollers are rotated by a motor 110, and a pawl is positioned at the inlet of each bin 111. Each sheet is driven by the rollers and driven into a particular bin 111 by the pawl.

Turn-Over Unit

While the copier body A can deal with only a single sheet at a time alone in the duplex copy mode, it can collectively handle a stack of sheets when combined with the turn-over unit D. Specifically, to reproduce images on both sides of a plurality of sheets, the sheets steered downward by the path selector 67 are sequentially guided by the next path selector 68 to the turn-over unit D. In the turn-over unit D, a discharge roller 120 sequentially stacks the incoming sheets on a tray 123 while a feed roller 121 and side guides 12 position them in the lengthwise and widthwise directions. The sheets stacked and positioned on the tray 123 are refed from the tray 123 by a refeed roller 124 and directly driven into the refeed loop 72 by the path selector 69.

Control Section

Figure 4:
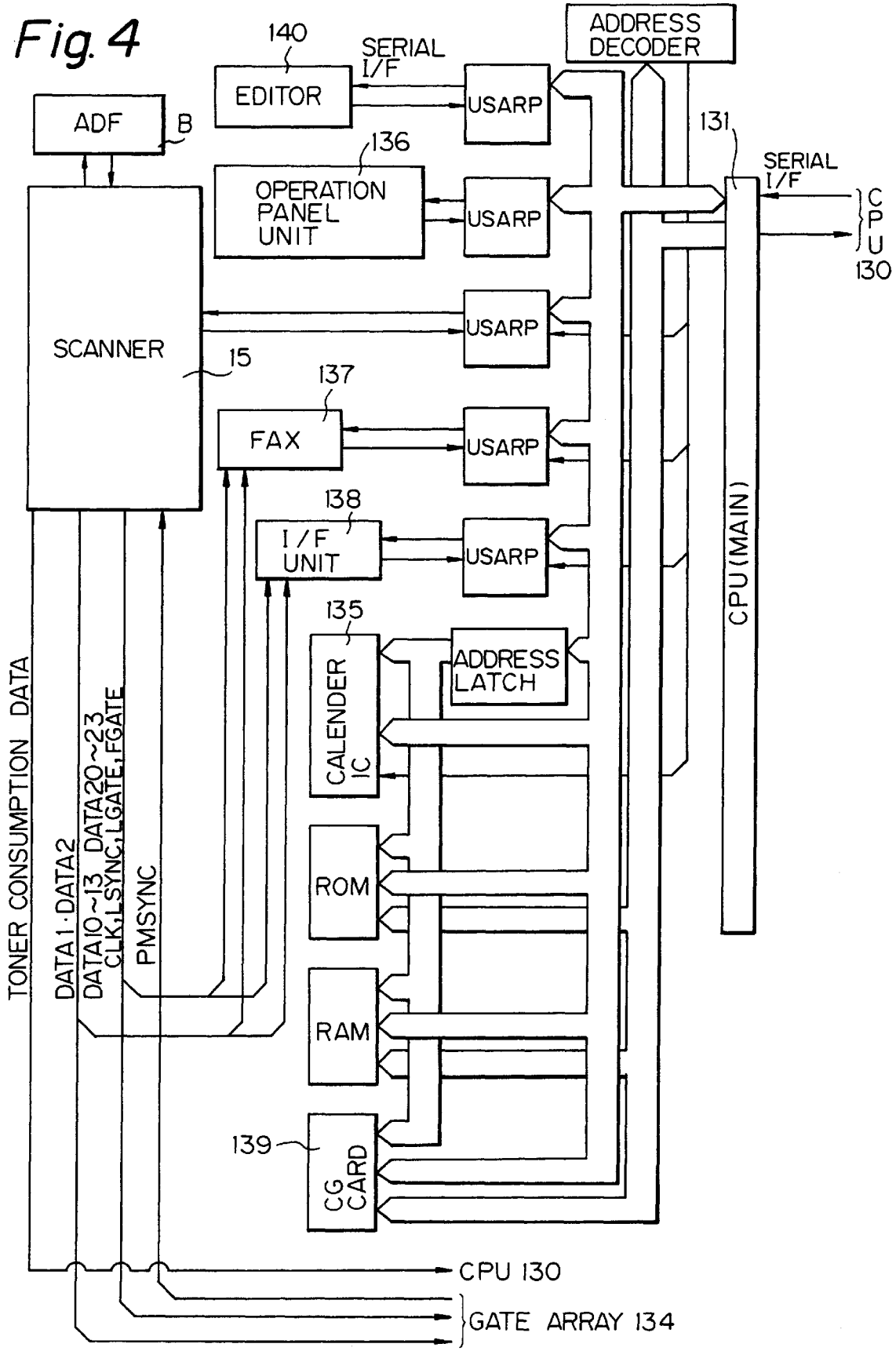

A reference will be made to FIG. 4 and successive figures for describing a control section included in the embodiment. FIGS. 4 and 5 show the control section in combination.

As shown, the control section includes two CPUs (Central Processing Units) 130 and 131 assigned to sequence and operation, respectively. The CPUs 130 and 131 are interconnected by a serial interface (RS-232C). Also connected to the sequence control CPU 130 via I/Os (Input/Outputs), timer/counters, and so forth are various sensors including sheet size sensors, sheet discharge sensors, and a registration sensor, sensor switches including dip switches, high-tension power source units, drivers for driving relays, solenoids and motors, the optical writing unit or laser beam scanner unit 16, an image control circuit 132, and various external units including the sorter or sorter unit C and turn-over unit or duplex copy unit D.

The sensors include the paper size sensors respectively associated with the cassettes 60*a*–60*c*, FIG. 2, and each outputting an electric signal representative of the size and orientation of sheets, sensors relating to the sheet transport, e.g., registration and discharge, sensors relating to supplies, e.g., an oil end sensor and a toner end sensor, and sensors relating to mechanical errors, e.g., a door open sensor and a fuse-blow sensor. The outputs of these sensors are input to the CPU 130. The high-tension power source units each apply a particular high voltage to one of the main charger 41, transfer charger 44, separation charger 45, FIG. 2, and bias electrodes for development. The drivers are respectively associated with, e.g., sheet feed clutches, registration clutch, counters, main motor 73 (see FIG. 2) and other motors, toner replenish solenoid, power relay, and fixing heater.

The duplex copy unit D includes a motor for positioning the sheets in the widthwise direction, sheet feed clutch, a side fence home position sensor for changing a transport path, and sensors relating to the transport of the sheets. The sorter unit C is connected to the copier body A by a serial interface. On receiving a signal from a sequence, the sorter unit C conveys each sheet to a particular bin at a preselected timing.

The sequence control CPU 130 receives various analog outputs including the output of a thermistor adjoining the fixing station, the monitor output of the laser diode, and a reference voltage signal assigned to the laser diode. For example, in response to the output of the thermistor, the CPU 130 effects ON/OFF control such that the temperature at the fixing station remains constant. An analog-to-digital converter (ADC) and the analog input of the CPU 130 implement a mechanism for maintaining the emission power of the laser diode constant. Specifically, the mechanism causes the monitor voltage at the time when the laser diode is turned on to coincide with a preselected reference voltage (3 mW).

The sequence control CPU 130 selectively turns on or turns off the toner replenish solenoid on the basis of toner consumption data received from the scanner section 15, as will be described specifically later. The image control circuit 132 generates various kinds of timing signals including timing signals for masking, trimming and erasing, and sends a video signal (VDATA0–3) to the laser diode by counting the ON signals of the laser diode. A gate array 134 synchronizes bilevel image data DATA1 and DATA2 and sixteen-level (multilevel) data DATA10–13 and DATA20–23 received from the scanner section 15 to a synchronizing signal PMSYNC received form the laser beam scanner unit 16. Further, the gate array 134 transforms the above data to a four-bit serial signal (ODATA0–3) and applies them to the image control circuit 132.

The above bilevel data DATA1 and DATA2 respectively correspond to the odd pixels (dots) and even pixels, and each has one bit. These data DATA1 and DATA2 are combined to constitute two-bit parallel data. Likewise, the sixteen-level data DATA10–13 and DATA20–23 respectively correspond to the odd pixels and even pixels, and each has four bits. These data DATA10–13 and DATA20–23 are combined to constitute eight-bit parallel data.

Control relating to the operation, as distinguished from the sequence, is as follows. The main CPU 131 controls a plurality of serial ports and a calendar IC (Integrated Circuit) 135. Connected to the serial ports are the sequence control CPU 130 and an operation panel unit 136, the scanner section 15, a facsimile transceiver (FAX) 137, an interface (I/F) unit 138, a CG (Character Generator) card or font card 139, and an editor 140.

The operation panel unit 136 includes keys to be operated by the operator and indicators for displaying conditions of the copier. Specifically, the operation panel unit 136 serially sends information input on the keys to the CPU 131, and selectively turns on the indicators in response to commands serially received from the CPU 131. The scanner section 15 serially sends information relating to image processing. The FAX 137 and I/F unit 138 interchange preselected information with the CPU 131. The calendar IC 135 stores date and time. The apparatus may be ON/OFF controlled on the basis of the stored date and time, if desired.

The CG card or font card 139 is a removable memory card and used to feed font data to a code data file from the outside. The font data include an outline font and a bit map font. The editor 140 allows a desired editing function to be input thereon. Image editing data, e.g., masking data, trimming data or image shifting data input on the editor 140 by the operator are serially sent to the main CPU 131.

Figure 6:
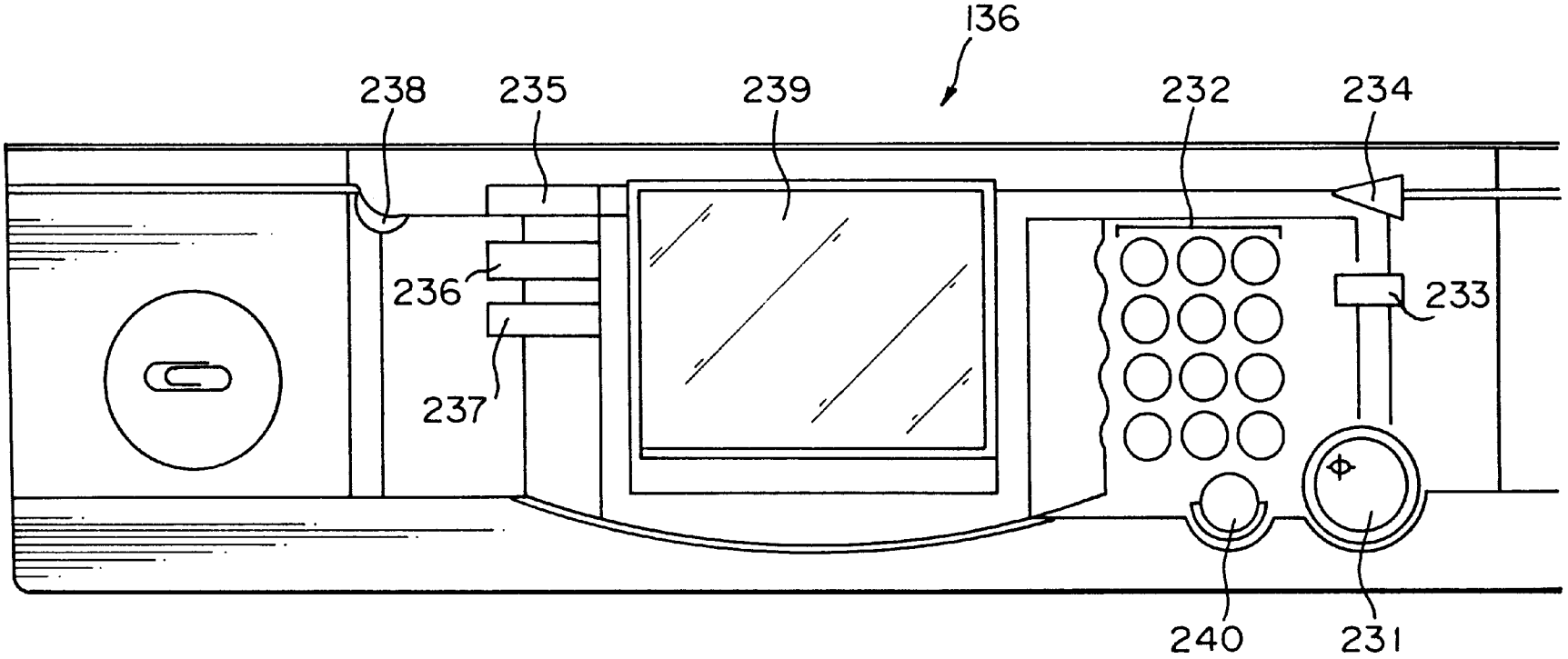
FIG. 6 is a front view showing a specific arrangement of an operation panel unit included in the embodiment.

FIG. 6 shows a specific arrangement of the operation panel unit 136. As shown, the unit 136 has a start key 231, numeral keys 232, a clear/stop key 240, a mode clear and preheat/timer key 233, an interrupt key 234, a guidance key 235, a program key 236, a picture switch key 237, a brightness control knob 238, and an LCD 239.

The start key 231 is used to start a copying operation. The numeral keys 232 are used to enter a desired number of copies and other numerical values. The clear/stop key 240 is operated to clear the input number of copies (or sets of copies) or to stop the copying operation under way. The mode clear and preheat/timer key 233 is used to cancel input functions relating to the copying operation or to set a preheat mode (set when the key 233 is continuously pressed over a predetermined period of time). It is to be noted that the word "functions" refer to the number of copies, sheet size, image density, magnification change mode, and other various kinds of copy modes.

The interrupt key 234 is accessible for interrupting a copying operation under way in order to copy other documents. The guidance key 235 is used to select a mode for displaying guidance messages relating to the functions and manipulations. The program key 236 is used to register or call copy modes of frequent use. The picture switch key 237 is used to select either one of the previously mentioned simple picture and standard picture. The brightness control knob 238 is used to adjust the brightness of the screen of the LCD 239.

The LCD 239 is capable of displaying information relating to the sheet cassette (paper size) and other functions. The LCD 239 may be replaced with a fluorescent display tube or similar display device, if desired.

Figure 7:
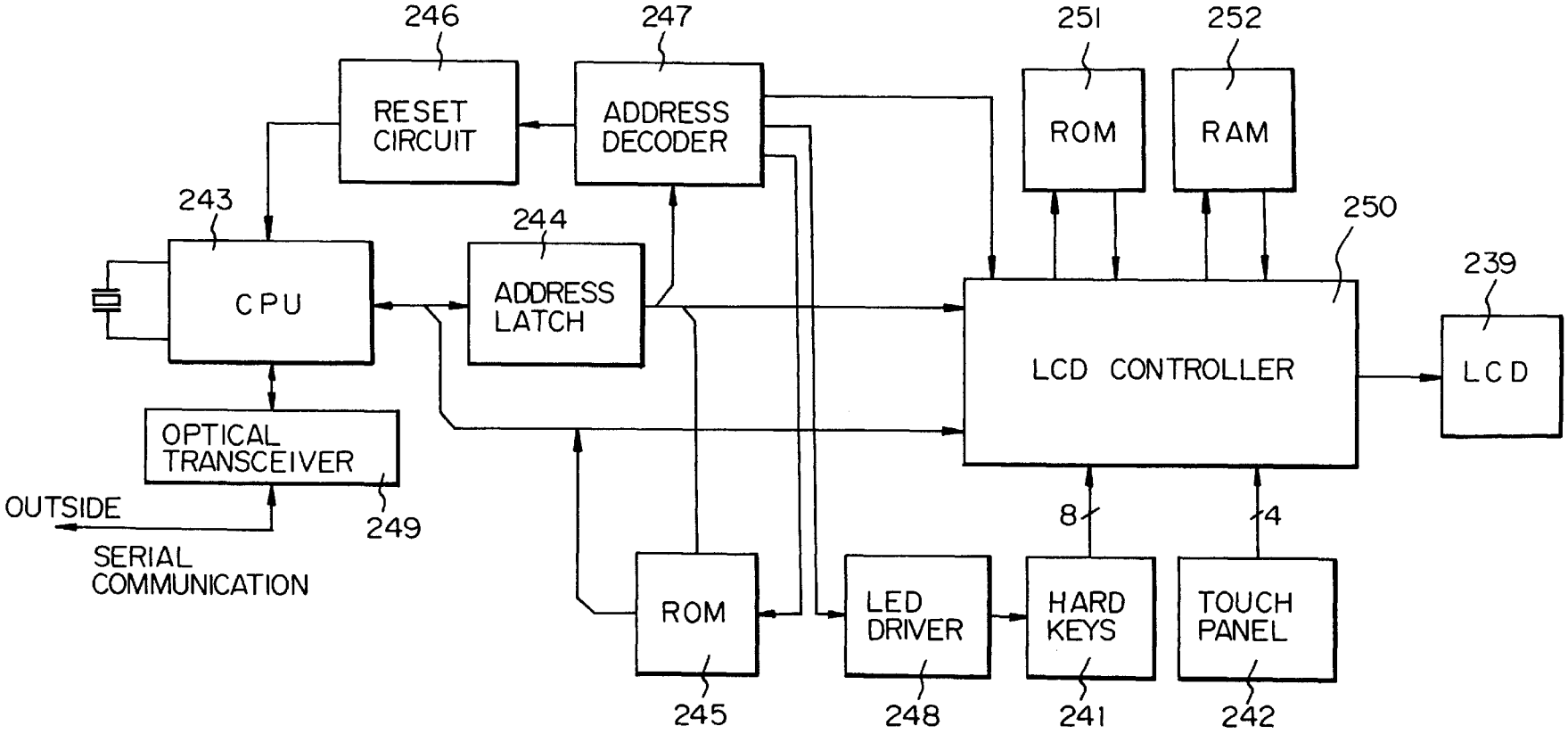
FIG. 7 is a block diagram schematically showing a control arrangement included in the operation panel unit.

FIG. 7 shows a control arrangement included in the operation panel unit 136. As shown, the unit 136 has, in addition to hard keys 241 including the start key 231 and the LCD 239 shown in FIG. 6, a touch panel 242, and a control section including a CPU 243, an address latch 244, a ROM (Read Only Memory) 245, a reset circuit 246, an address decoder 247, an LED (Light Emitting Diode) driver 249, an optical transceiver 249, an LCD controller 250, a ROM 251, and a RAM (Random Access Memory) 252.

The touch panel 242 is a transparent sheet-like matrix touch switch provided on the surface of the LCD 239. When the operator touches a desired part of the touch panel 242, the panel 242 detects it and sends position information to the LCD controller 250. The CPU 243 controls the entire operation panel unit 136. The address latch 244 latches an address output from the CPU 243 and outputs it. The ROM 245 stores various kinds of fixed data including a program for causing the CPU 243 to execute various kinds of processing. The reset circuit 246 sends a reset signal to the CPU 243 when a preselected signal is output from the address decoder 247.

The address decoder 247 decodes the address latch output from the address latch 244 and generates signals to be delivered to various sections (including a chip select signal). The LED driver 248 selectively turns on or turns off LEDs buried in preselected ones of the hard keys 241 (e.g. start key 231) in response to the output of the address decoder 247. The optical transceiver 249 is connected to the CPU 243 and performs serial communication with the outside (copier body A). The LCD controller 250 controls the display of the LCD 239. The ROM 251 stores various kinds of fixed data including a program for causing the LCD controller 250 to execute display control. The RAM 252 plays the role of a work memory which the LCD controller 250 uses for display control, or the role of a video memory for storing image data to appear on the LCD 239.

The main CPU 131 shown in FIG. 4 and the operation panel unit 136 shown in FIG. 7 constitute the display means H, touch position detecting means I, function setting means J, image display control means K, and image switching means L shown in FIG. 1.

Figure 8:
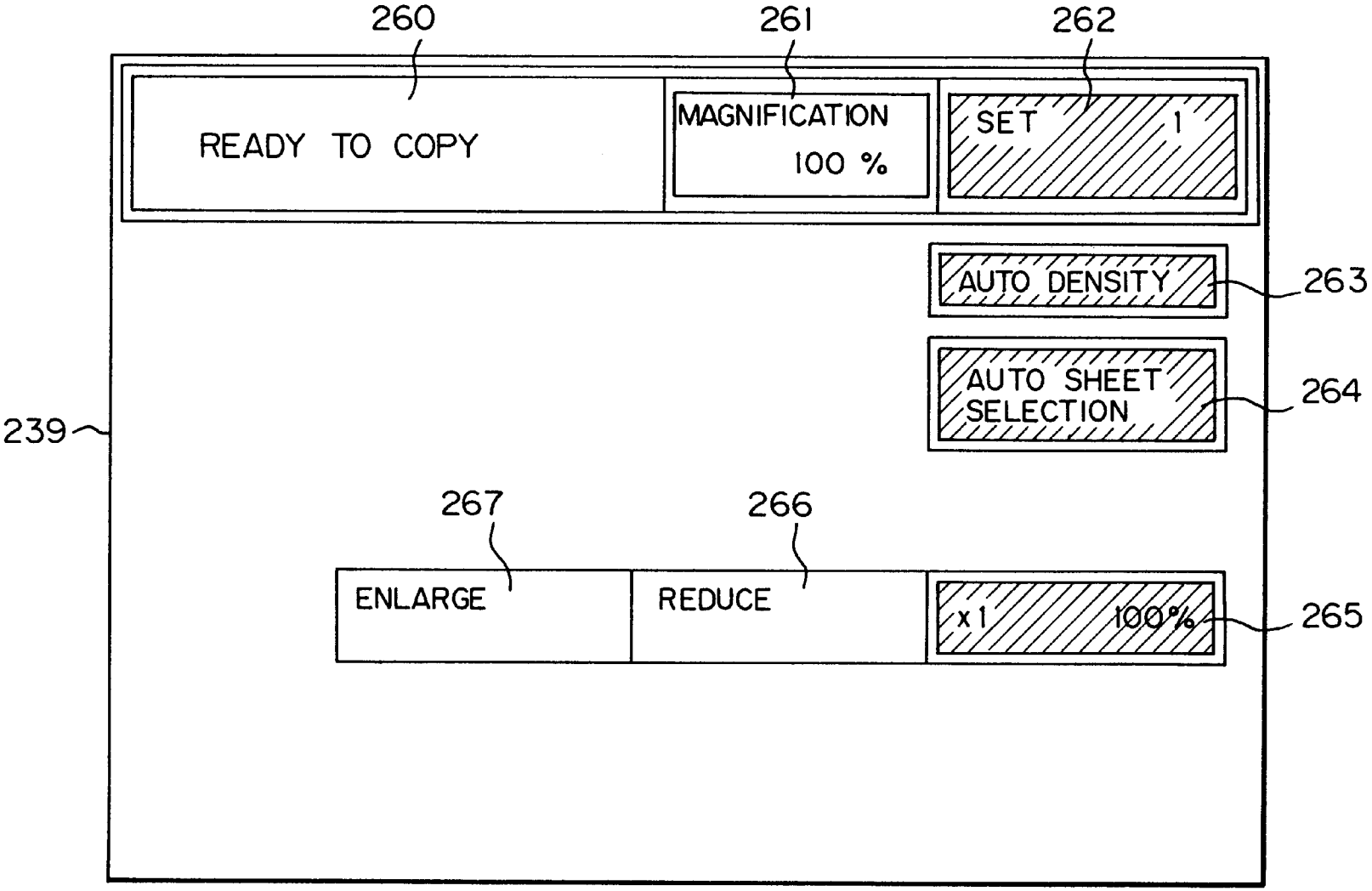
FIG. 8 shows a specific simple picture to appear on an LCD (Liquid Crystal Display) provided on the operation panel unit.

FIG. 8 shows a specific simple picture appearing on the LCD 239. As shown, the simple picture has a message area 260 for displaying a message, e.g., "Ready to copy" or "Wait", a magnification area 261 for displaying a magnification, and a copy number area 262 for displaying the number of copies set and the number of copies actually produced in its upper portion and lower portion, respectively. An auto density key 263 is used to select automatic image density control. An auto sheet size key 264 is used to select automatic sheet size processing. A x1 key 265 is used to select x1 copying. A reduce key 266 is used to select reduction while an enlarge key 267 is used to select enlargement. It is to be noted that the simple picture cannot be replaced with another picture relating thereto.

Figure 9:
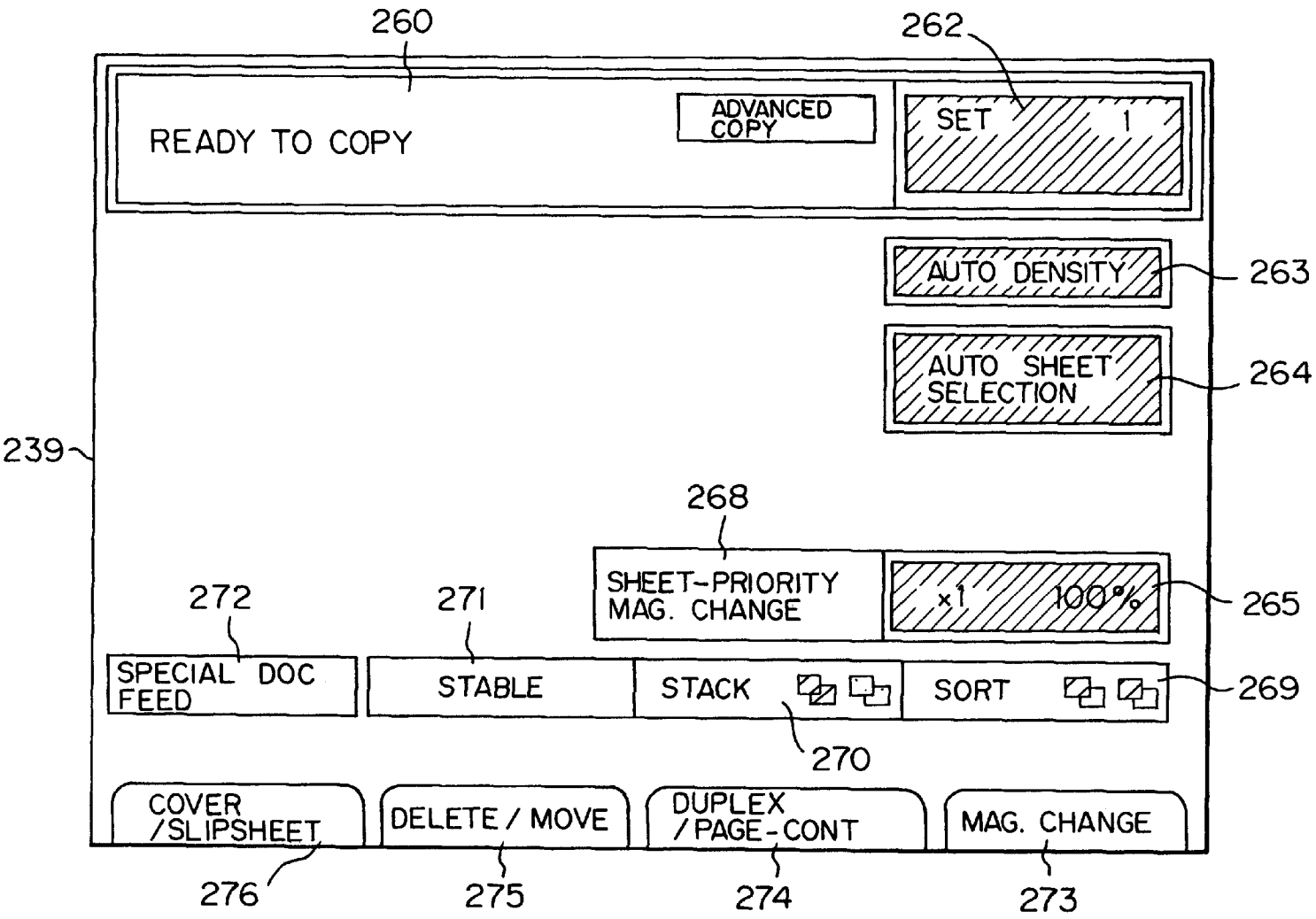
FIG. 9 shows a specific standard picture to also appear on the LCD.

FIG. 9 shows a specific standard picture appearing on the LCD 239. In FIG. 9, the same areas and keys as those shown in FIG. 8 are designated by the same reference numerals. As shown, the standard picture includes a sheet-priority magnification change key 268 accessible for effecting the automatic enlargement or reduction of image data in conformity to the sheet size selected. A sort key 269 is used to select a procedure for stacking copies in order of page set by set. A stack key 270 is used to select a procedure for stacking copies page by page. A staple key 271 is used to select a procedure for stapling each set of sorted copies. There are also shown in FIG. 9 a special document feed key 272, a magnification change key 273, a duplex/page-continuous key 274, a delete/move key 275, and a cover/slipsheet key 276.

A reference will be made to FIGS. 10–20 for describing how the operator selects a duplex copy mode on the standard picture, and how the control section of the copier deals with it.

Assume that the standard picture of FIG. 9 is displayed on the LCD 239, and that the operator touches the duplex/page-continuous key 274 included in the standard picture. Then, the control section replaces the standard picture with a picture shown in FIG. 10 and for setting a duplex copy mode (simplex→duplex).

Figure 10:
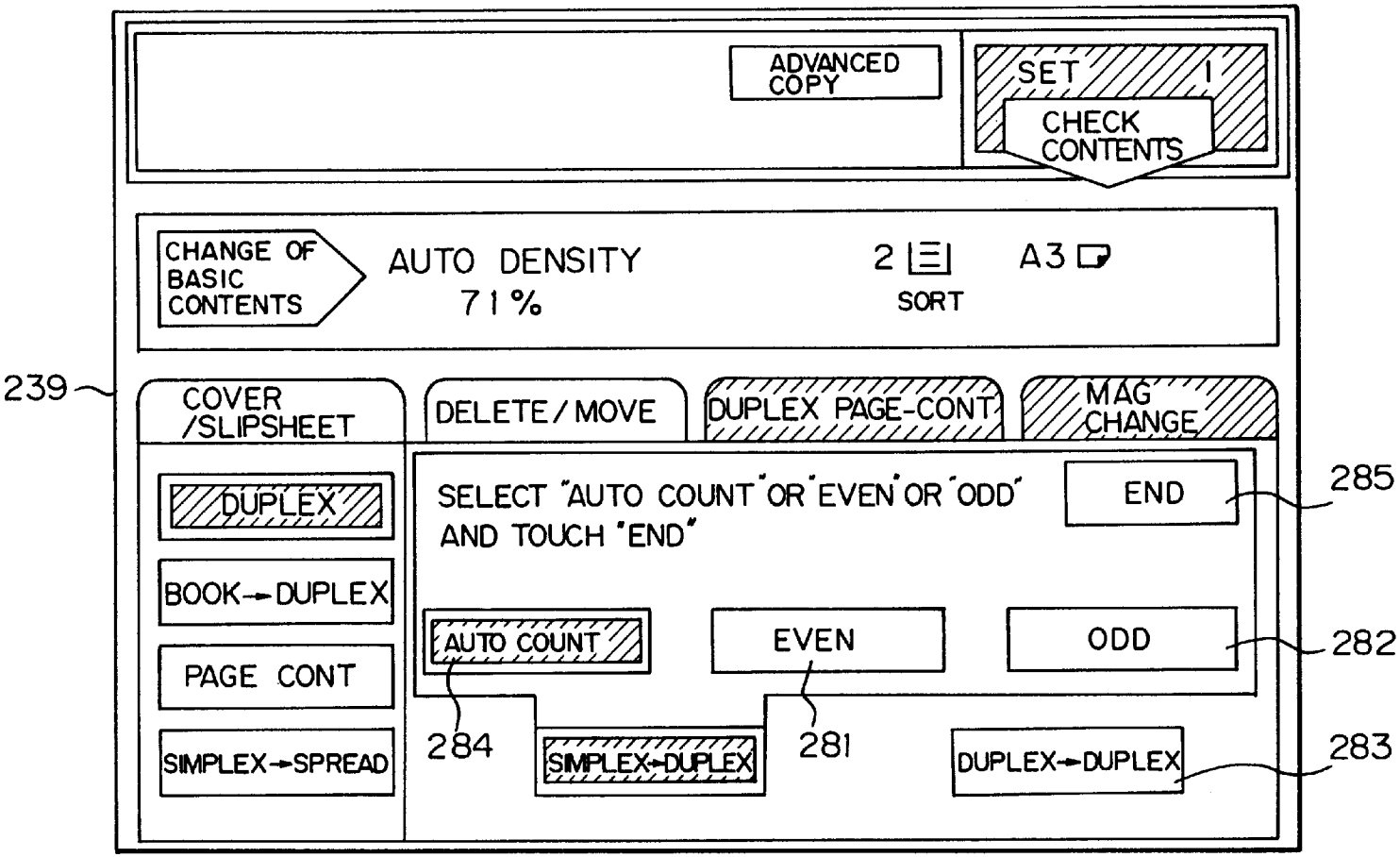
FIG. 10 shows a specific picture to appear on the LCD when a duplex/page-continuous key included in the standard picture is touched by the operator.
Figure 11:
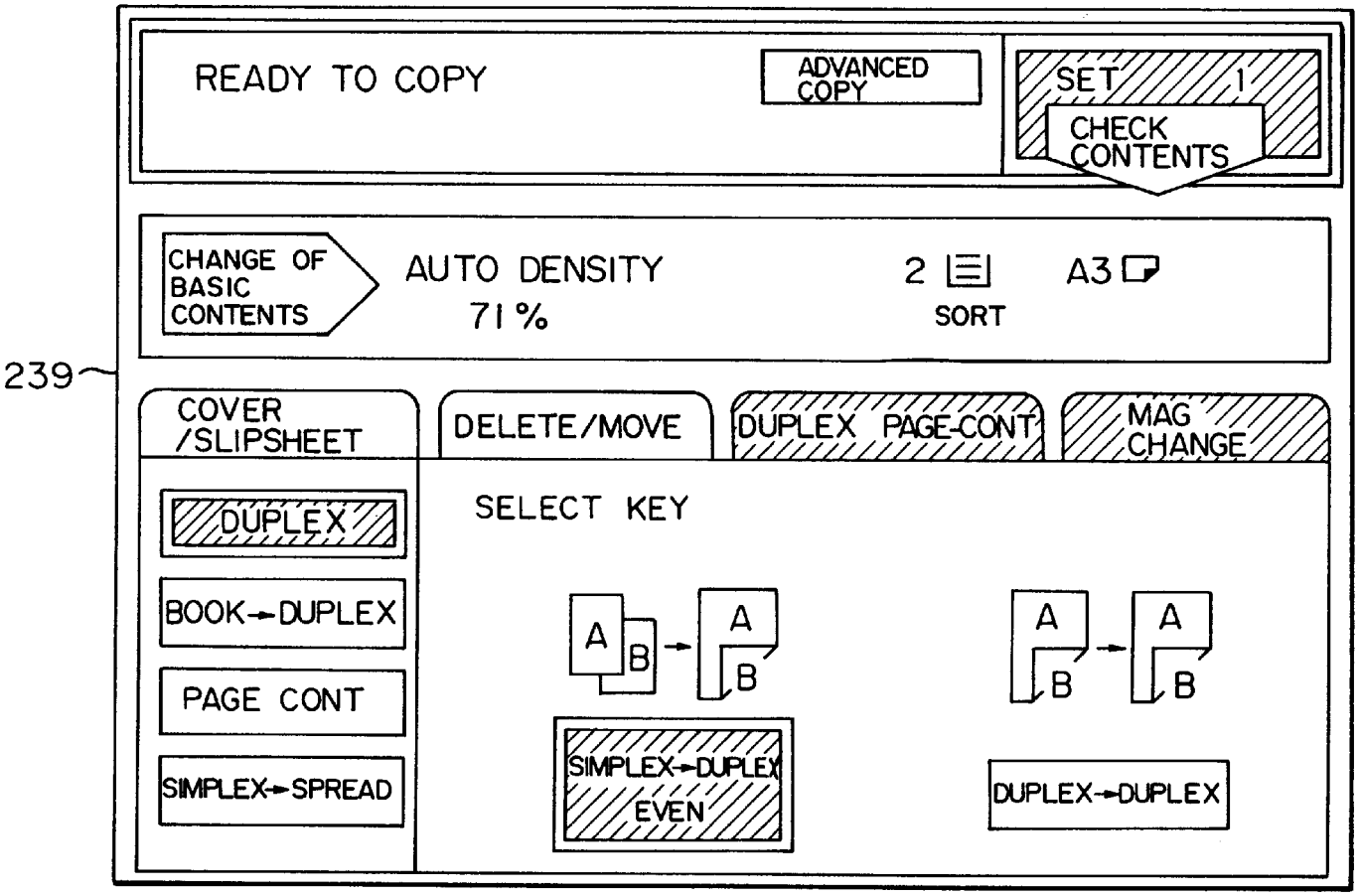
FIG. 11 shows a specific picture to appear on the LCD when an even key included in the picture of FIG. 10 is touched.
Figure 12:
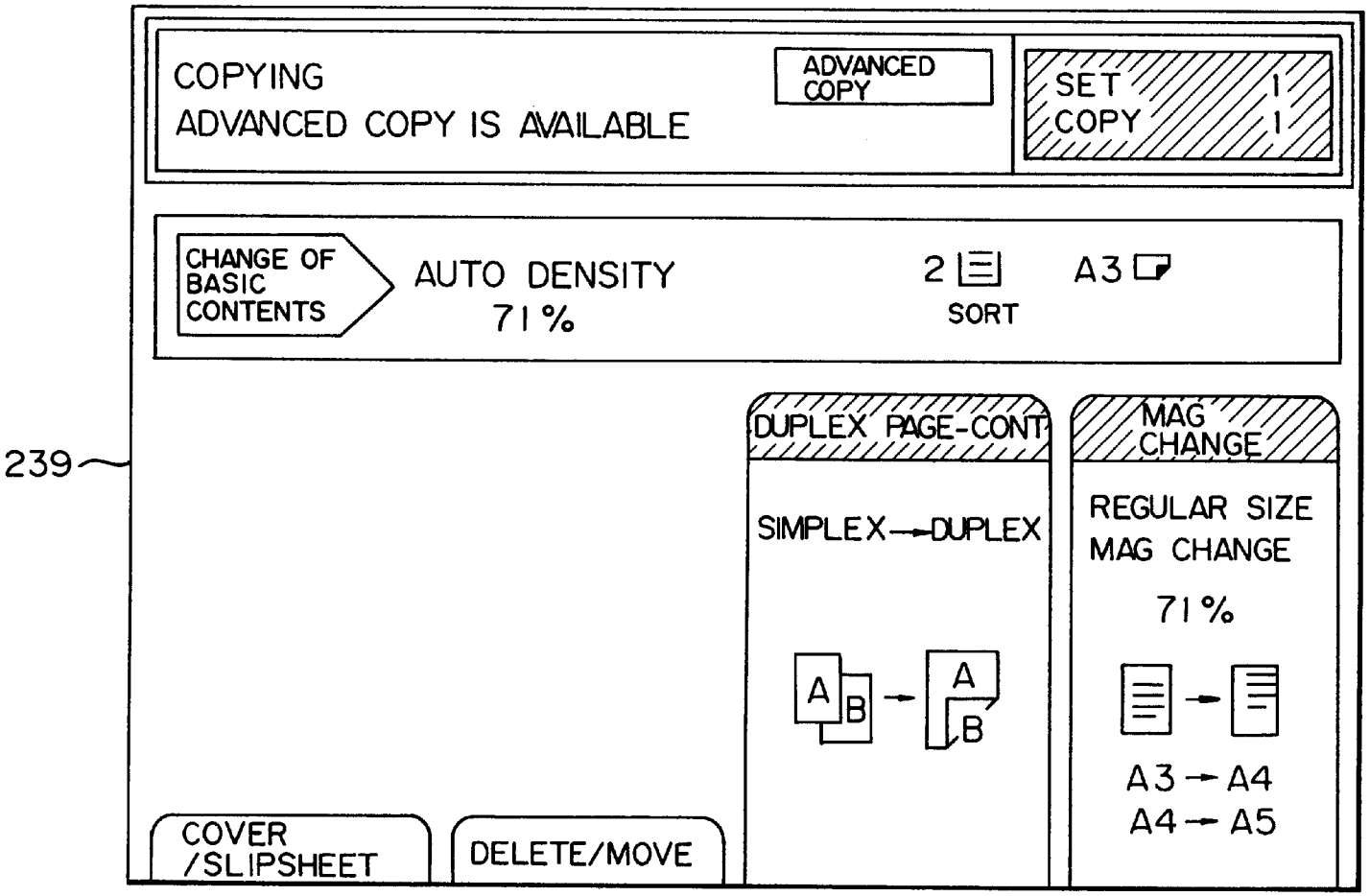
FIG. 12 shows a specific picture to appear on the LCD when a start key provided on the operation panel unit is pressed while the picture of FIG. 11 is displayed.

Assume that the operator touches an even key 281 on the picture of FIG. 10 and then touches an end key 285. Then, the control section sets up a simplex→duplex mode (even number of documents), and then replaces the picture with a picture shown in FIG. 11. When the operator presses the start key 231, FIG. 6, the control section causes a copying operation to start while substituting a picture shown in FIG. 12 for the picture of FIG. 11.

Figure 13:
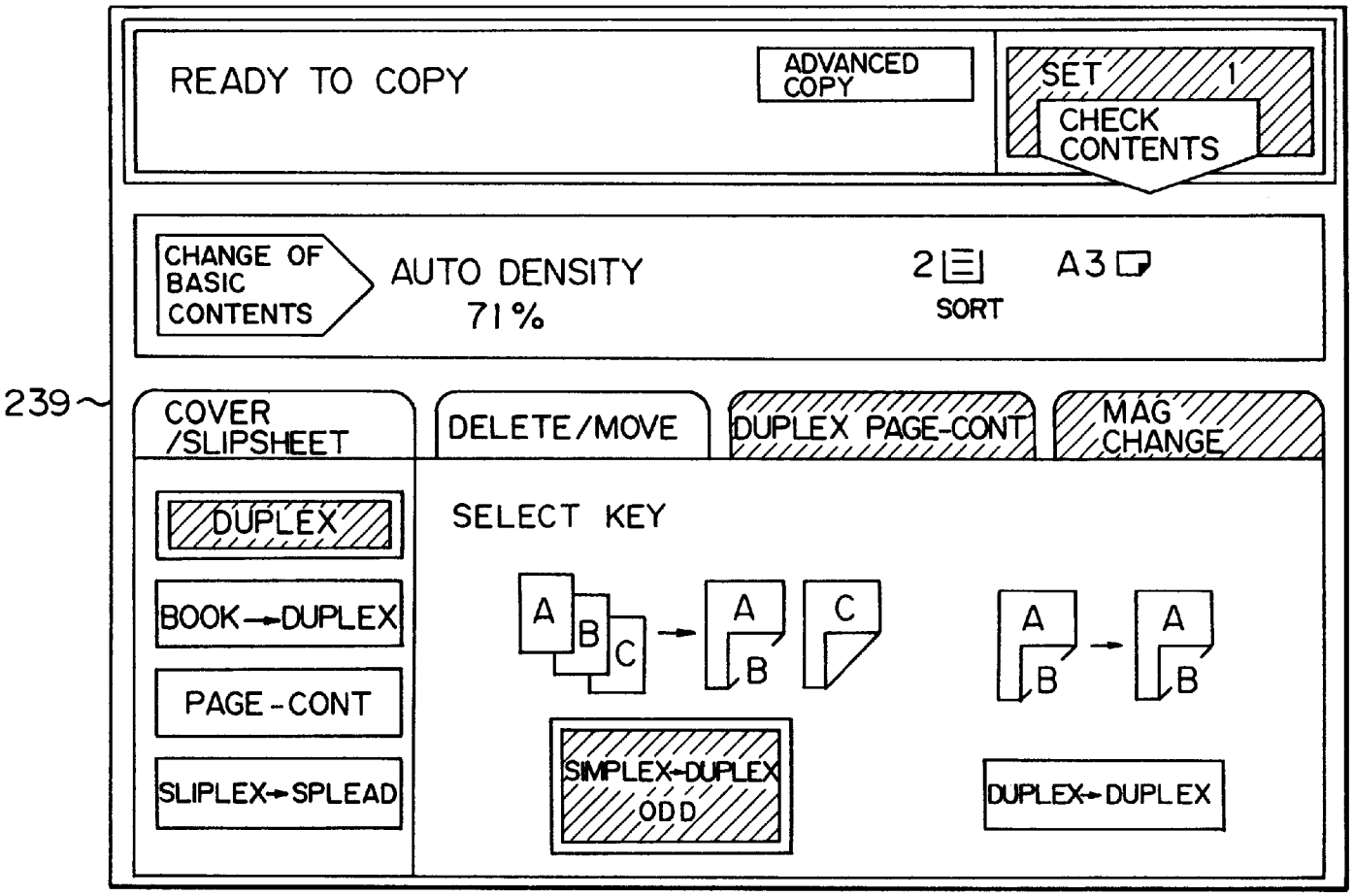
FIG. 13 shows a specific picture to appear on the LCD when an odd key included in the picture of FIG. 10 is touched.
Figure 14:
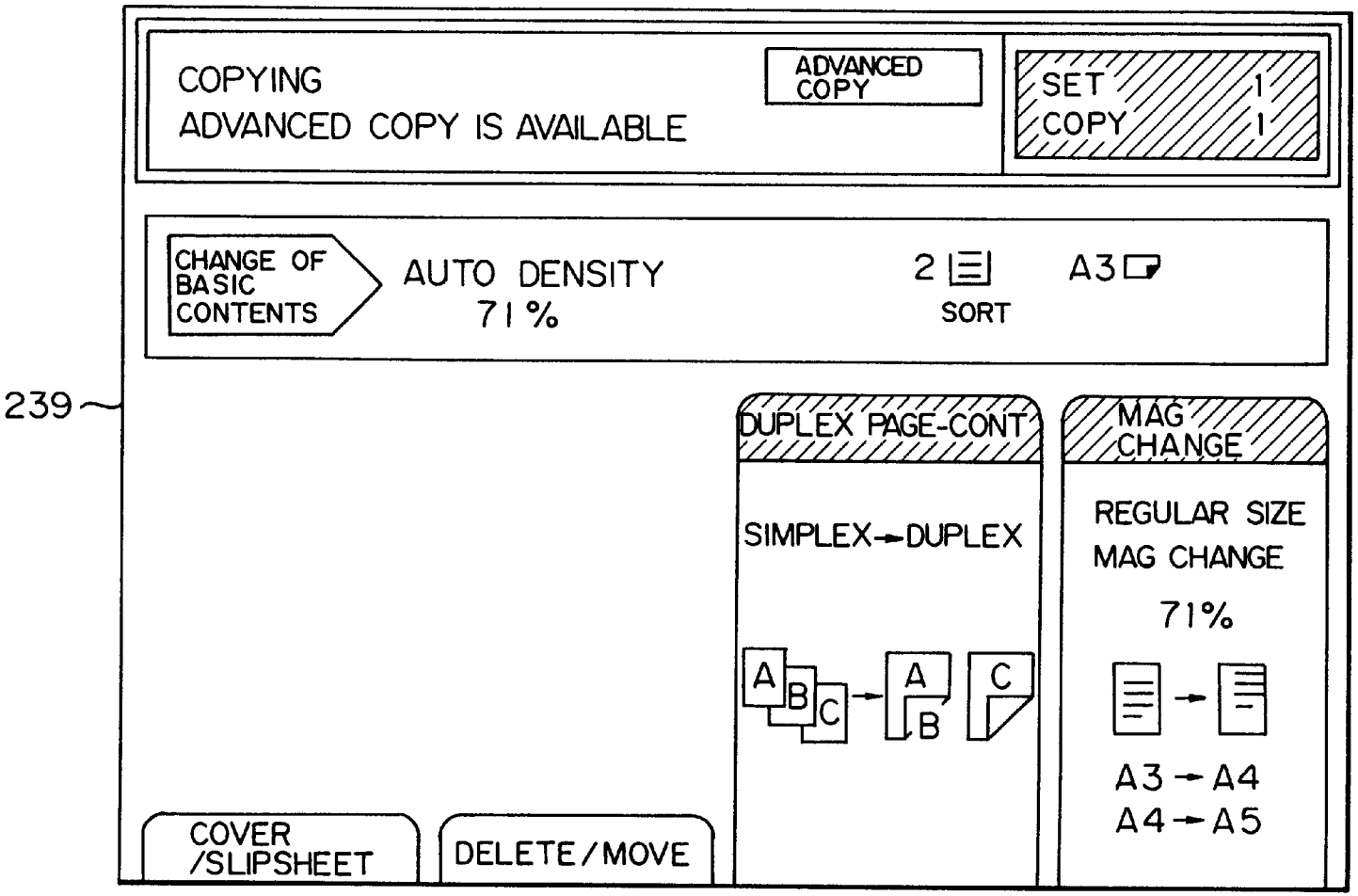
FIG. 14 shows a specific picture to appear on the LCD when the start key of FIG. 6 is pressed while the picture of FIG. 13 is displayed.
Figure 15:
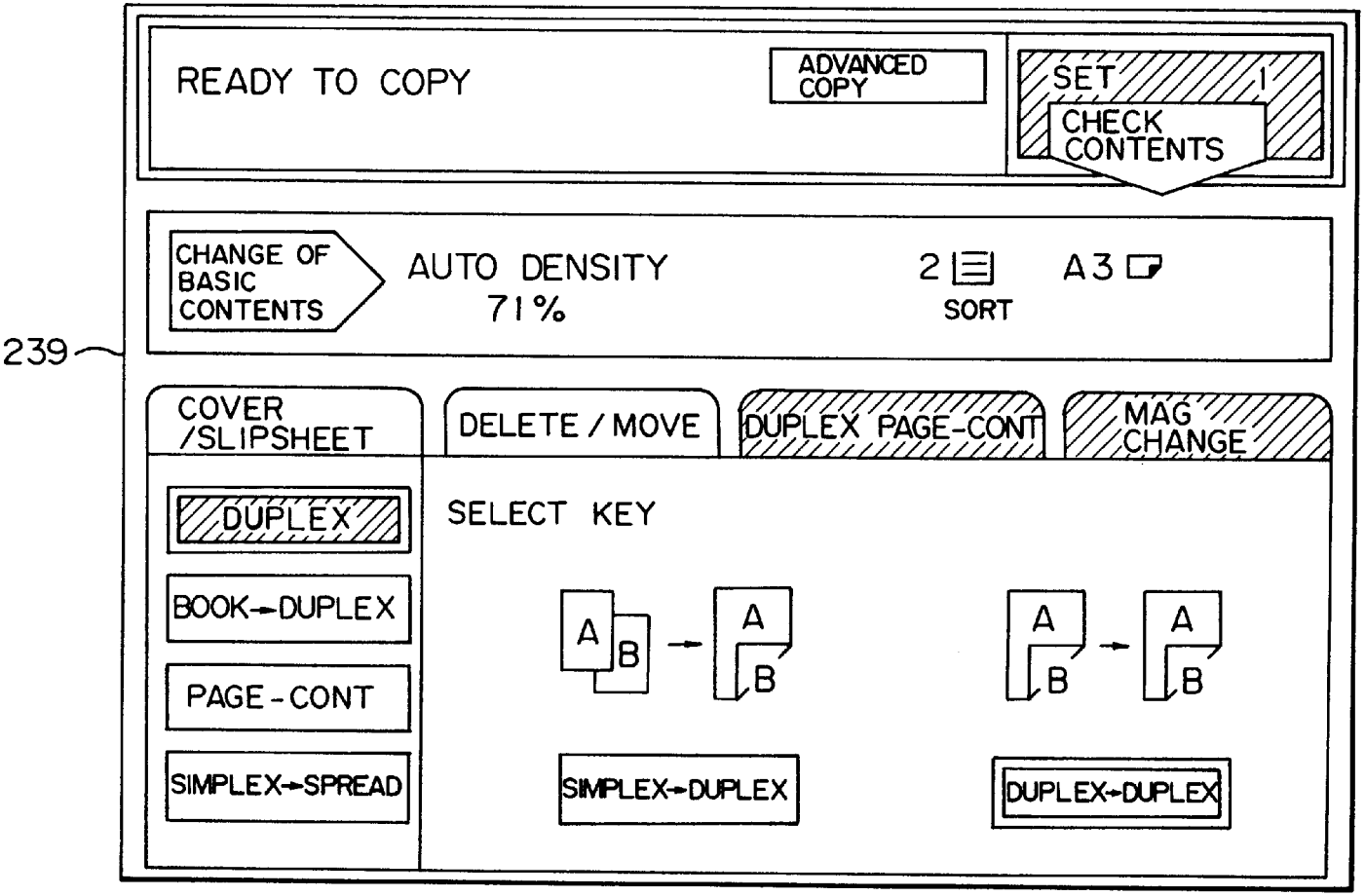
FIG. 15 shows a specific picture to appear on the LCD when a duplex→duplex key included in the picture of FIG. 10 is pressed.
Figure 16:
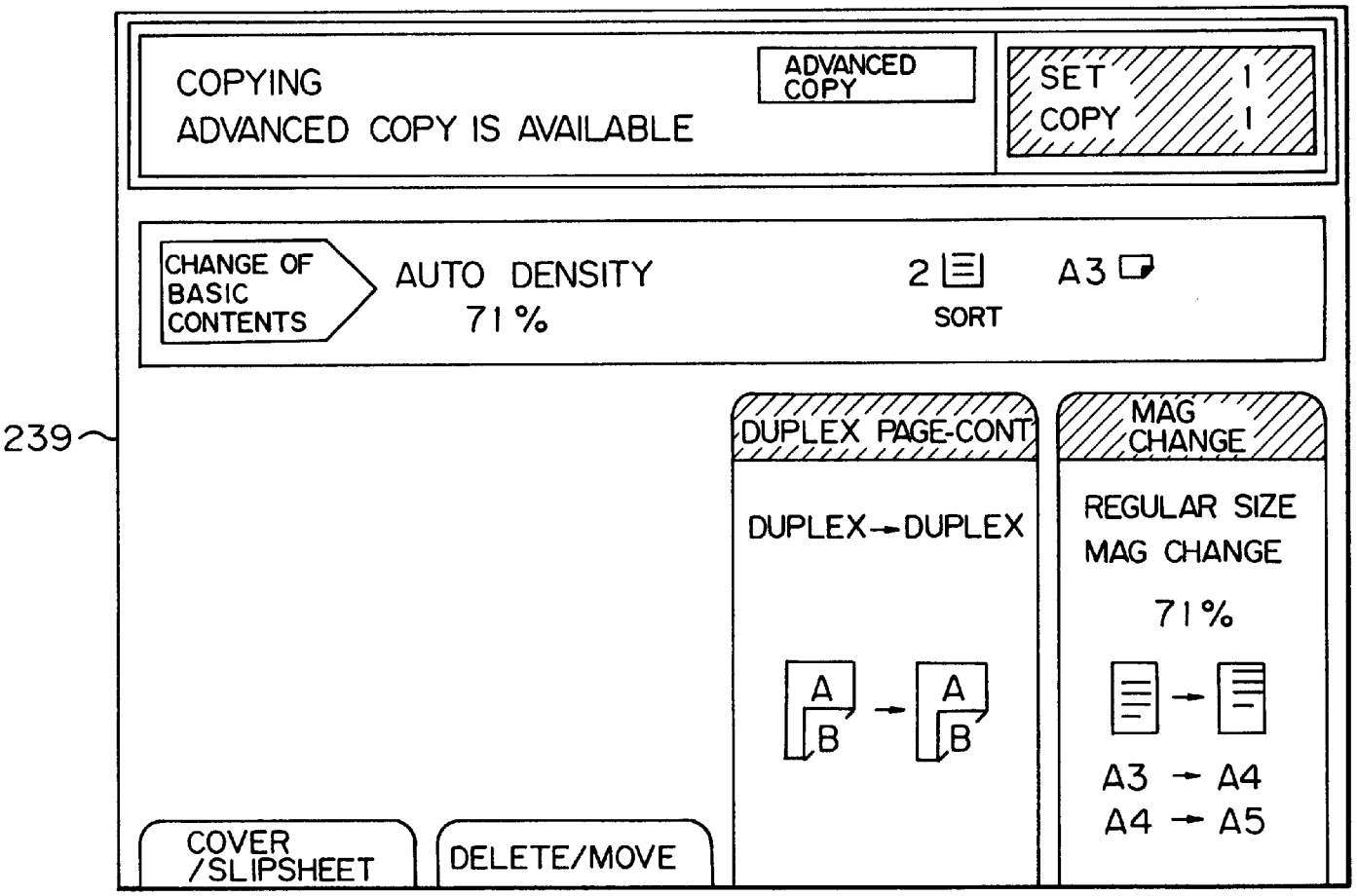
FIG. 16 shows a specific picture to appear on the LCD when the start key of FIG. 6 is pressed while the picture of FIG. 15 is displayed.

On the other hand, when the operator touches an odd key 282 on the picture of FIG. 10 and then touches the end key 285, the control section sets up the simplex→duplex mode (odd number of documents), and then replaces the picture with a picture shown in FIG. 13. When the operator presses the start key 231, the control section causes a copying operation to start while substituting a picture shown in FIG. 14 for the picture shown in FIG. 13.

Assume that the operator touches a duplex→duplex key 283 on the picture of FIG. 10 and then touches the end key 285. Then, the control section sets up a duplex→duplex mode and then replaces the picture with a picture shown in FIG. 15. When the operator presses the start key 231, the control section causes a copying operation to start while substituting a picture shown in FIG. 16 for the picture of FIG. 15.

Assume that the operator touches an auto count key 284 on the picture of FIG. 10 and then touches the end key 285.

Figure 17:
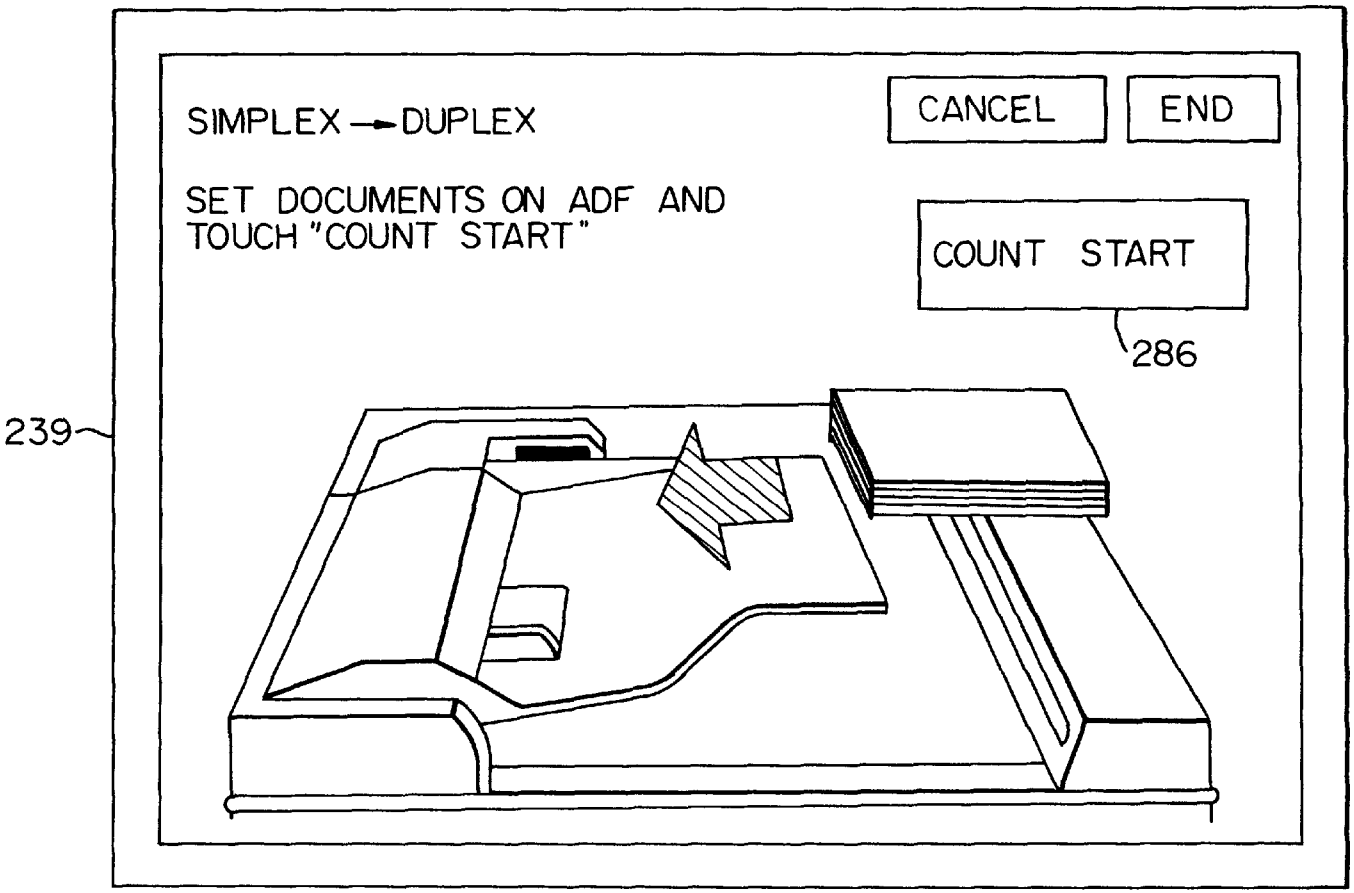
FIG. 17 shows a specific picture to appear on the LCD when an auto count key included in the picture of FIG. 10 is touched.
Figure 18:
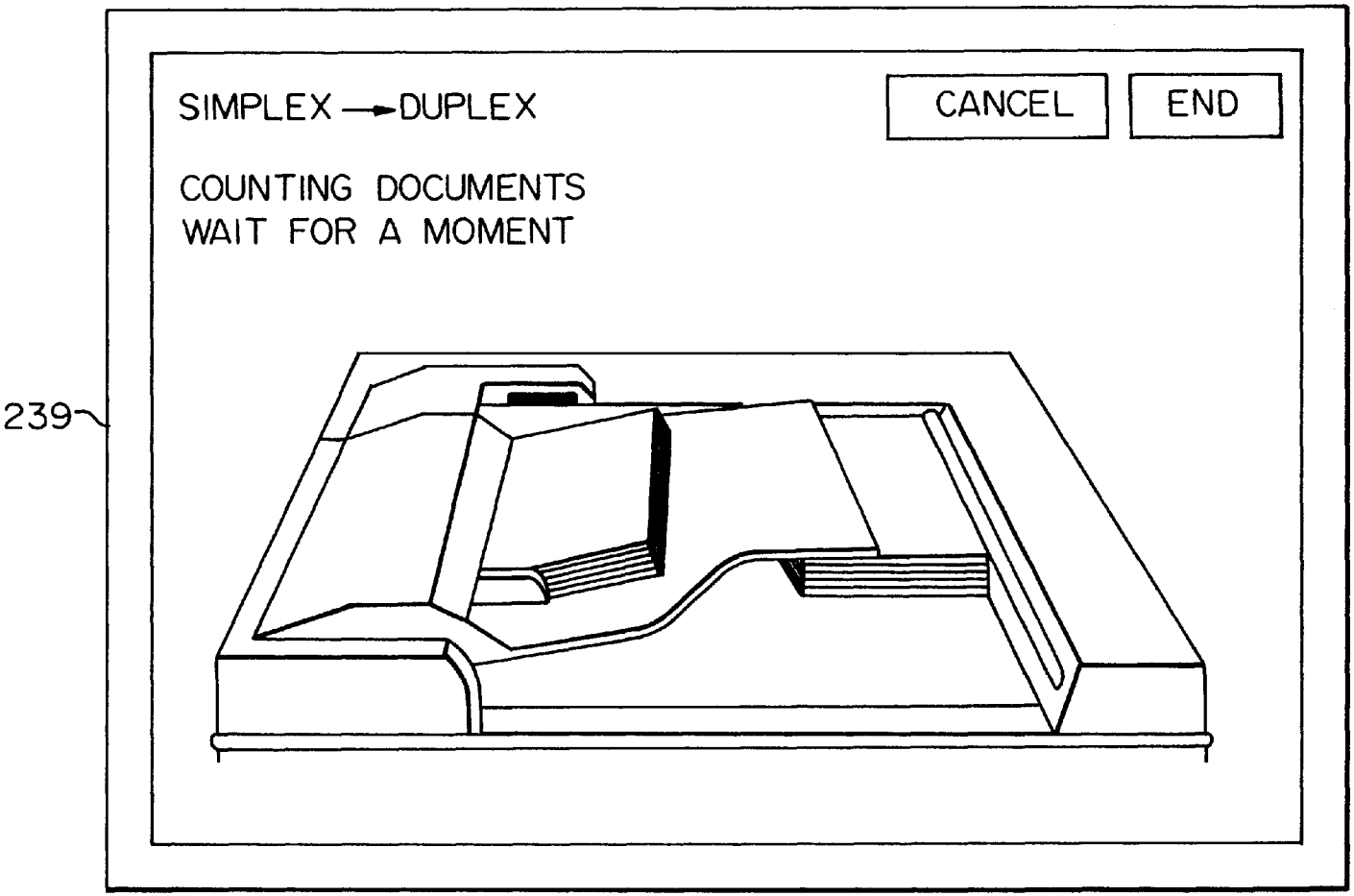
FIG. 18 shows a specific picture to appear on the LCD when a count start key included in the picture of FIG. 17 is touched.
Figure 19:
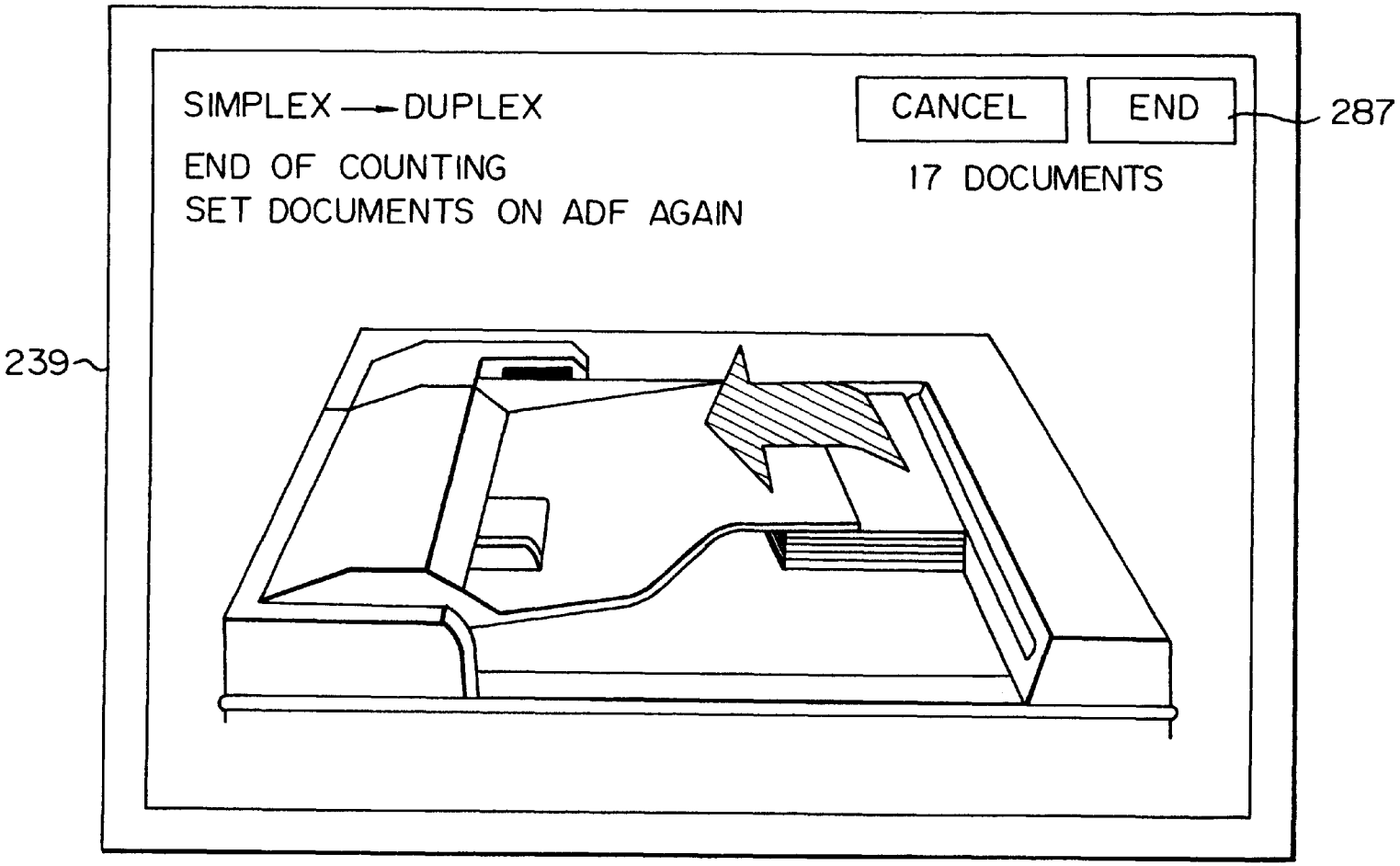
FIG. 19 shows a specific picture to appear on the LCD when a stack of documents have been fully counted while the picture of FIG. 18 is displayed.
Figure 20:
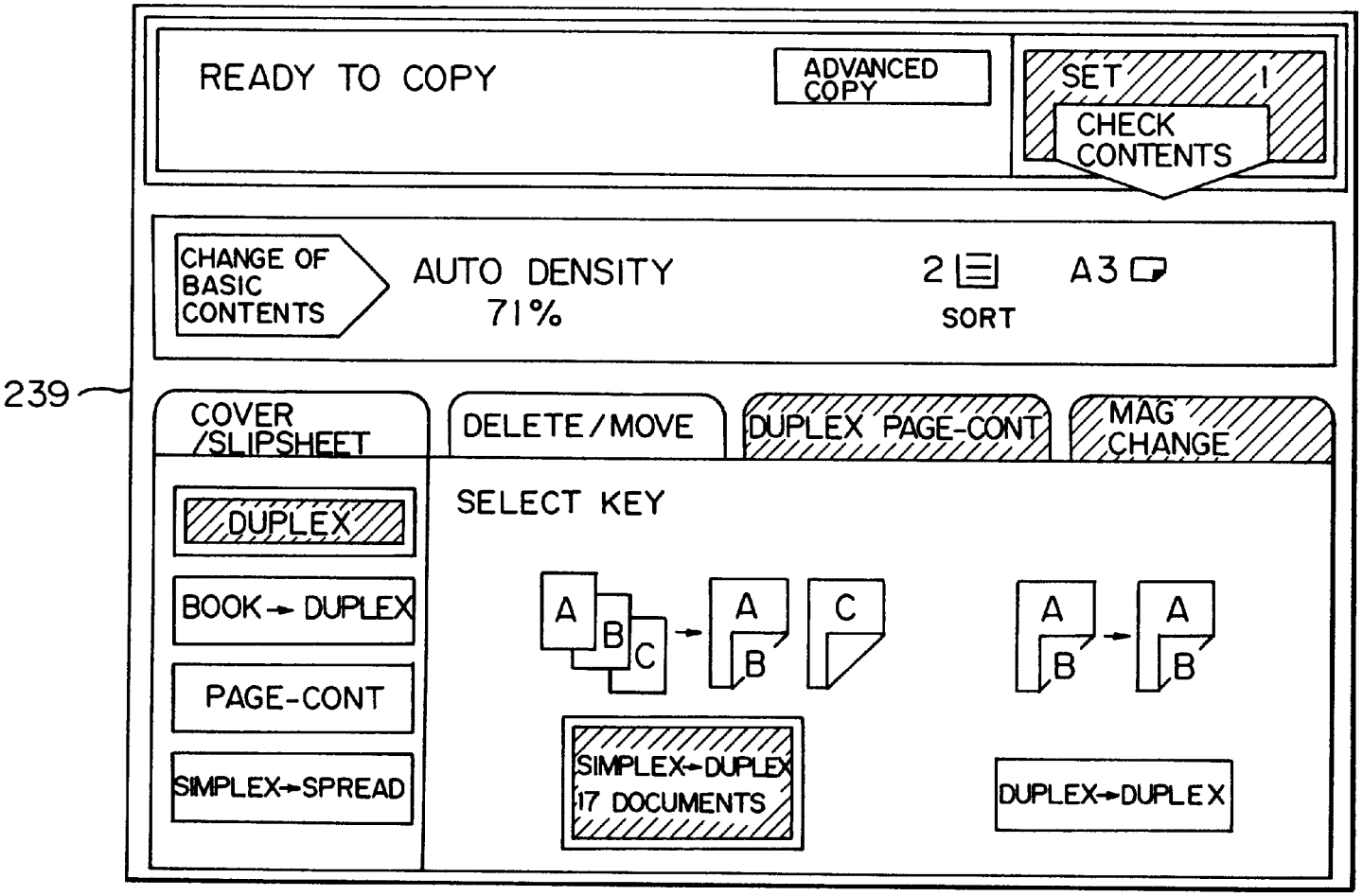
FIG. 20 shows a specific picture to appear on the LCD when an end key included in the picture of FIG. 19 is touched.

Then, the control section replaces the picture with a picture shown in FIG. 17. When the operator watching the picture of FIG. 17 touches a count start key 286, the control section LCD 239 replaces, if documents exist on the feed tray 100, the picture of FIG. 17 with a picture shown in FIG. 18 and causes the documents to be sequentially fed while counting them. Subsequently, the control section replaces the picture with a picture shown in FIG. 19 (count n being "17" by way of example). When the operator touches an end key 287 on the picture of FIG. 19, the control section sets up the simplex→duplex mode (n documents) and then substitutes a picture shown in FIG. 20 for the picture of FIG. 19.

Figures 21, 21A:
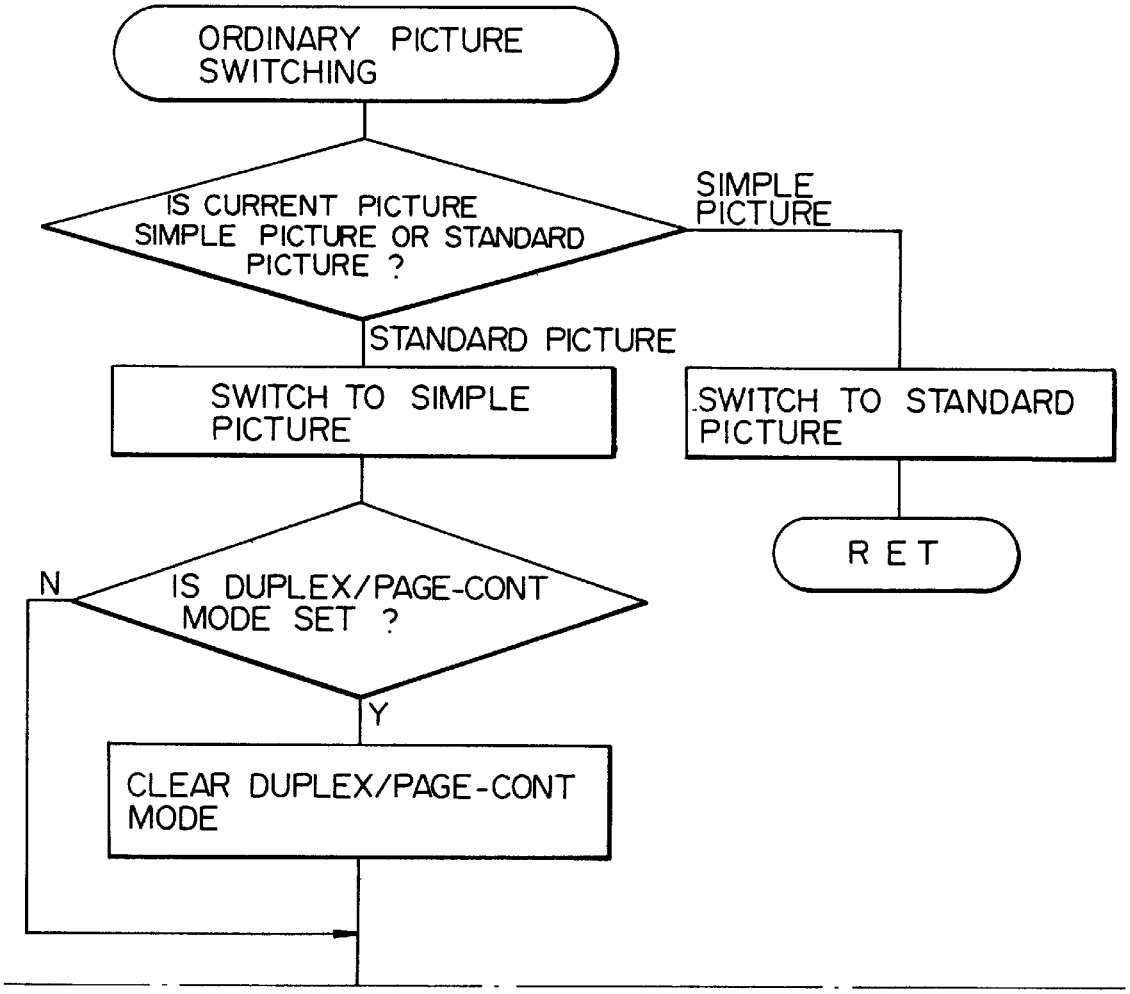
FIG. 21 is a flowchart demonstrating a specific ordinary picture switch routine to be executed by the control system shown in FIGS. 4 and 5.
Figure 21B:
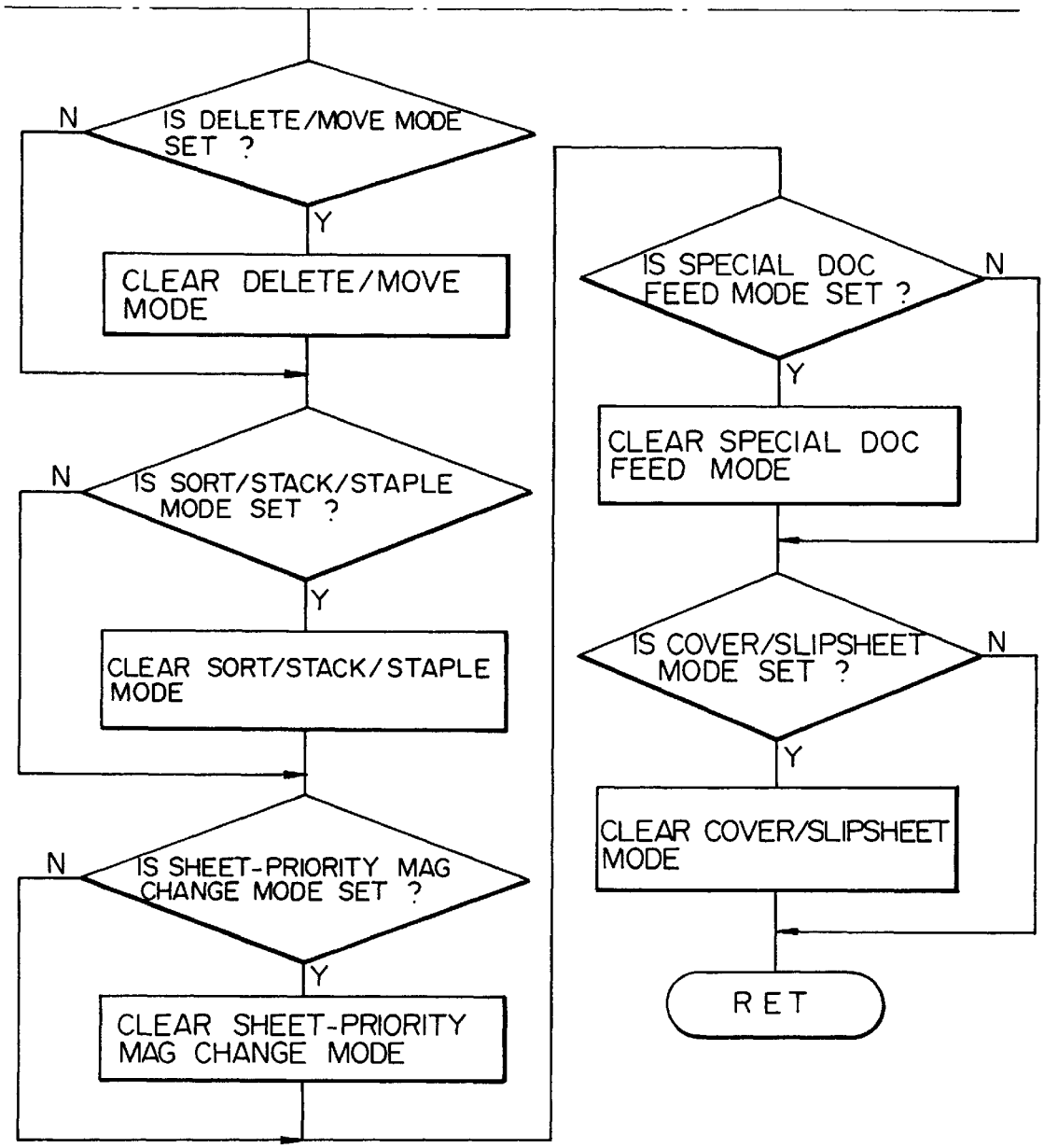

FIG. 21 is a flowchart demonstrating a specific ordinary routine in which the control section of the copier switches the picture appearing on the LCD 239. The routine to be described is called from a main routine, not shown, and started when the picture switch key 237, FIG. 6, is pressed. As shown, the control section determines whether the picture appearing on the LCD 239 is the simple picture or whether it is the standard picture. If the simple picture is displayed on the LCD 239, the control section replaces it with the standard picture while holding the copy modes set up on the simple picture. If the picture appearing on the LCD 239 is the standard picture, the control section replaces it with the simple picture, determines whether or not the copy modes (functions) available only with the standard picture (not available with the simple picture) are set, and clears (cancels) them if so. The modes available only with the standard picture are a duplex/page-continuous mode, a delete/move mode, a sort/stack/staple mode, a sheet-priority magnification change mode, a special document feed mode, and a cover/slipsheet mode.

As stated above, by selectively displaying the simple picture or the standard picture by software, it is possible to set up copy modes matching the contents of copying (image formation) and operator's skill without resorting to utilizing the previously stated openable cover. Further, when the picture is switched from the standard picture to the simple picture, the copy modes available only with the standard picture may be cleared. This successfully obviates undesired copies attributable to needless copy modes. Because the copy modes set on the simple picture are handed over to the standard picture when the former is replaced with the latter, it is not necessary for the operator to set the basic copy modes again. This enhances the easy operation of the copier.

If desired, an arrangement may be made such that in the event of the switchover from the standard picture to the simple picture the copy modes available only with the former picture are not cleared, or such that in the event of the switchover from the simple picture to the standard picture the copy modes set on the former are not handed over to the latter.

Figure 22:
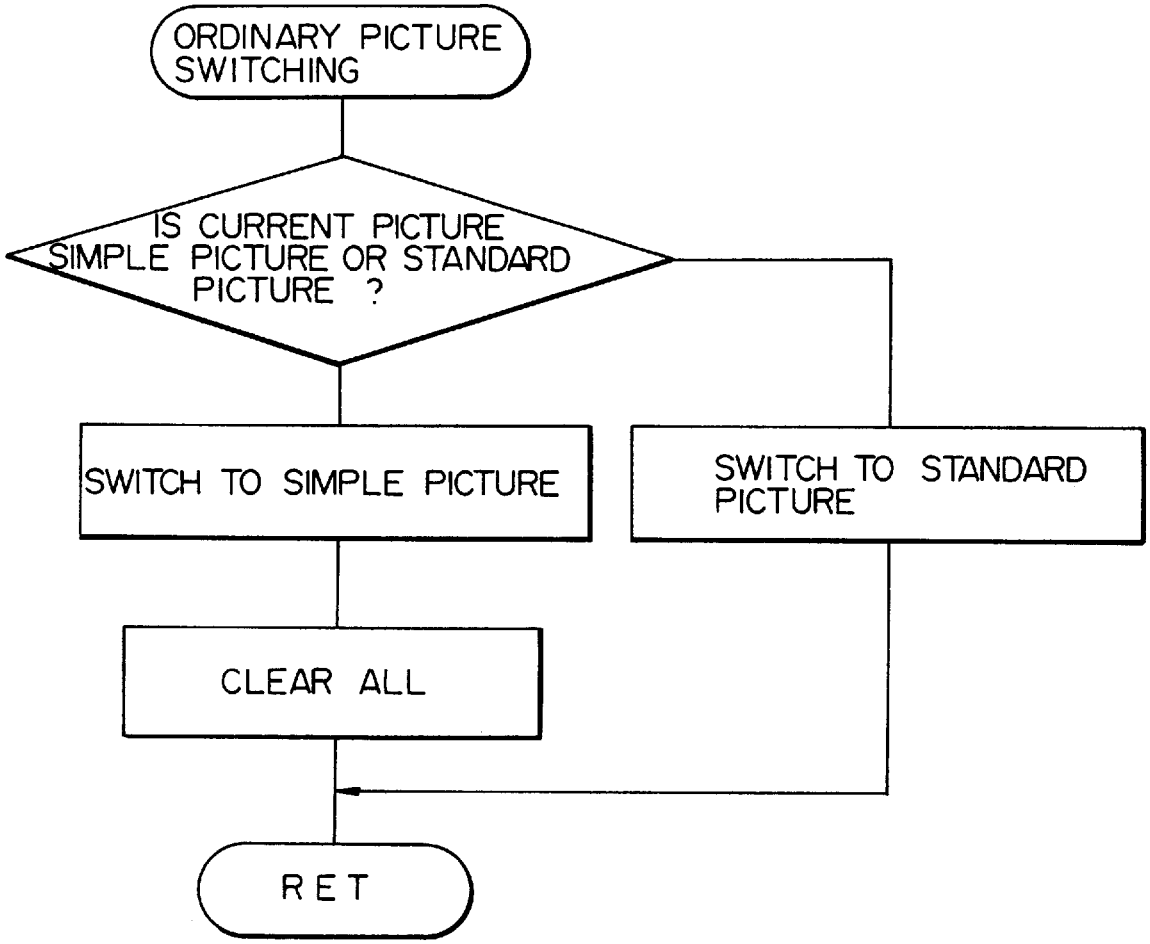
FIG. 22 is a flowchart demonstrating another specific ordinary picture switch routine.

FIG. 22 shows another specific ordinary picture switch routine to be executed by the control section of the copier. This routine is also called from the main routine and started when the operator presses the picture switch key 237. As shown, the control section determines whether the picture appearing on the LCD 239 is the simple picture or whether it is the standard picture. If the current picture is the simple picture, the control section replaces it with the standard picture while holding the copy modes set on the simple picture. If the current picture is the standard picture, the control section replaces it with the simple picture and then clears (cancels) all the existing copy modes (functions).

As stated above, by selectively displaying the simple picture or the standard picture by software, it is possible to set up copy modes matching the contents of copying and operator's skill without resorting to utilizing an openable cover. Further, when the picture is switched from the standard picture to the simple picture, all the existing copy modes may be cleared. This makes it needless for the operator to cancel the copy modes after the switchover of the picture, while successfully obviating undesired copies attributable to needless copy modes. Because the copy modes set on the simple picture are handed over to the standard picture when the former is replaced with the latter, it is not necessary for the operator to set the basic copy modes again. This enhances the easy operation of the copier.

If desired, an arrangement may be made such that in the event of the switchover from the simple picture to the standard picture the copy modes set on the former are not handed over to the latter.

How the operator or user sets a user code mode, the initial (default) image and whether or not the standard image can be used, and the operation of the control section will be described with reference also made to FIGS. 23–28.

Figure 23:
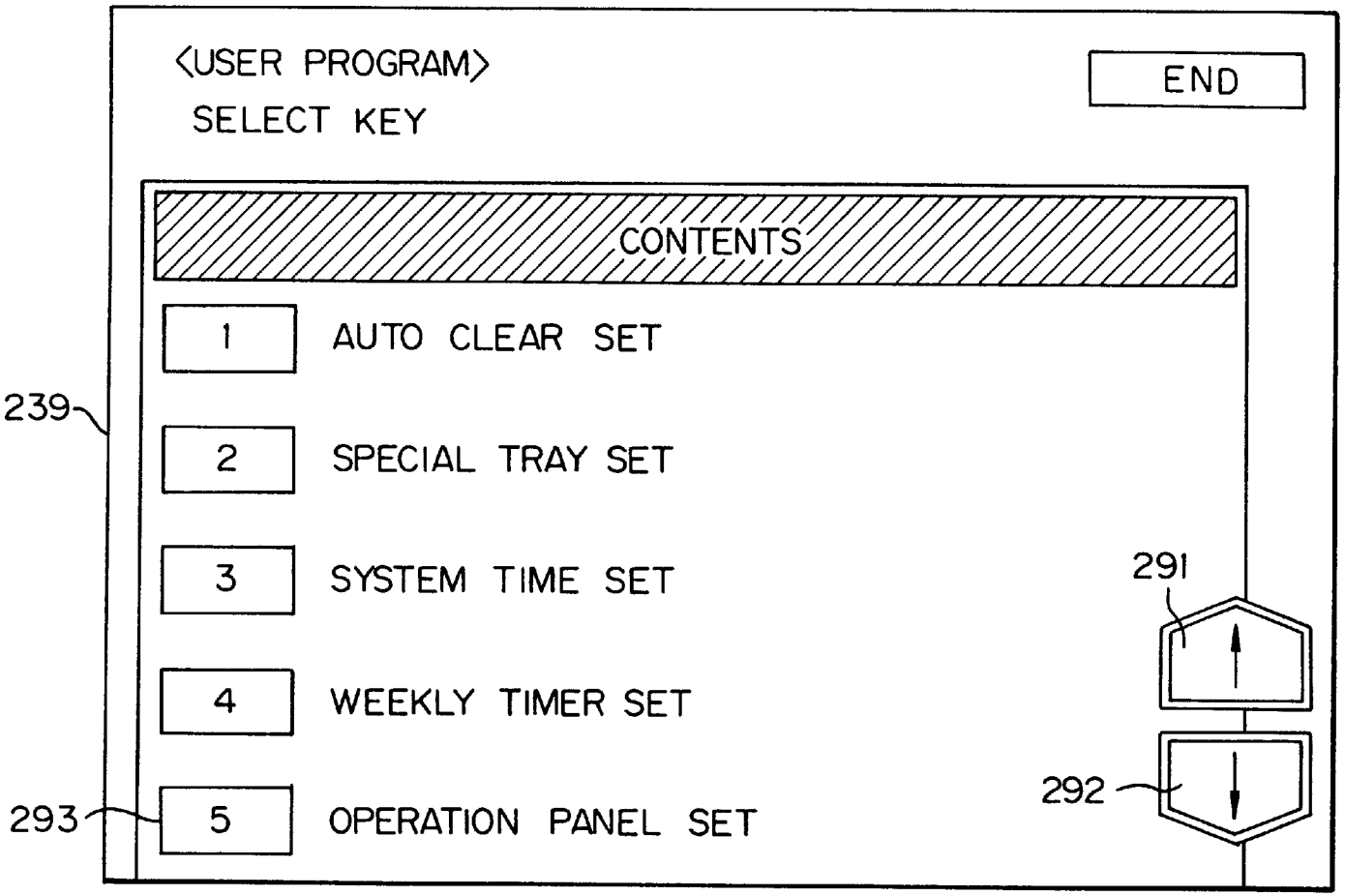
FIG. 23 shows a part of a picture to appear on the LCD when a mode clear and preheat/timer key of FIG. 6 is pressed, and then a clear/stop key of FIG. 6 is continuously pressed.
Figure 24:
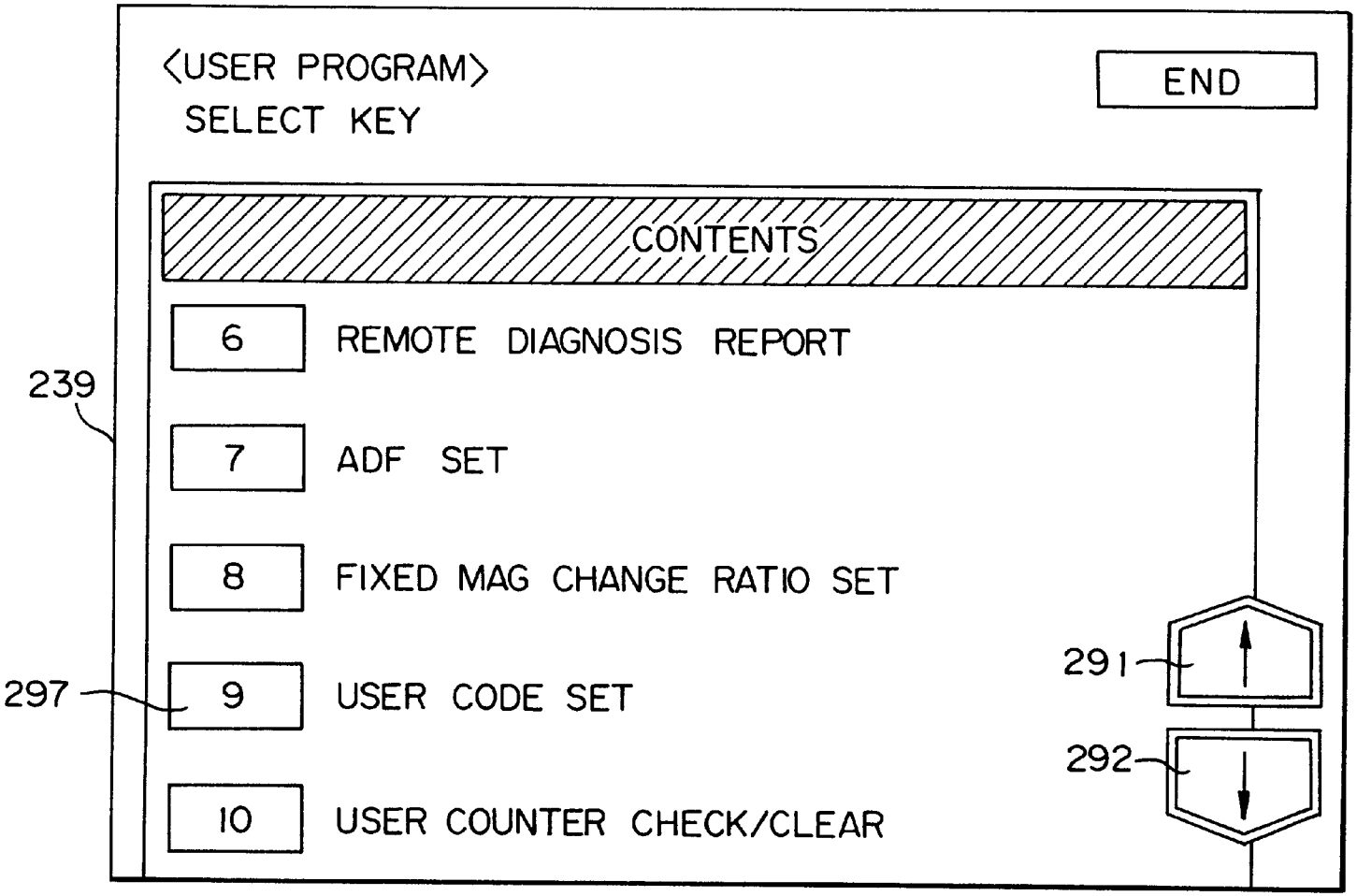
FIGS. 24 and 25 each shows another part of the same picture.
Figure 25:
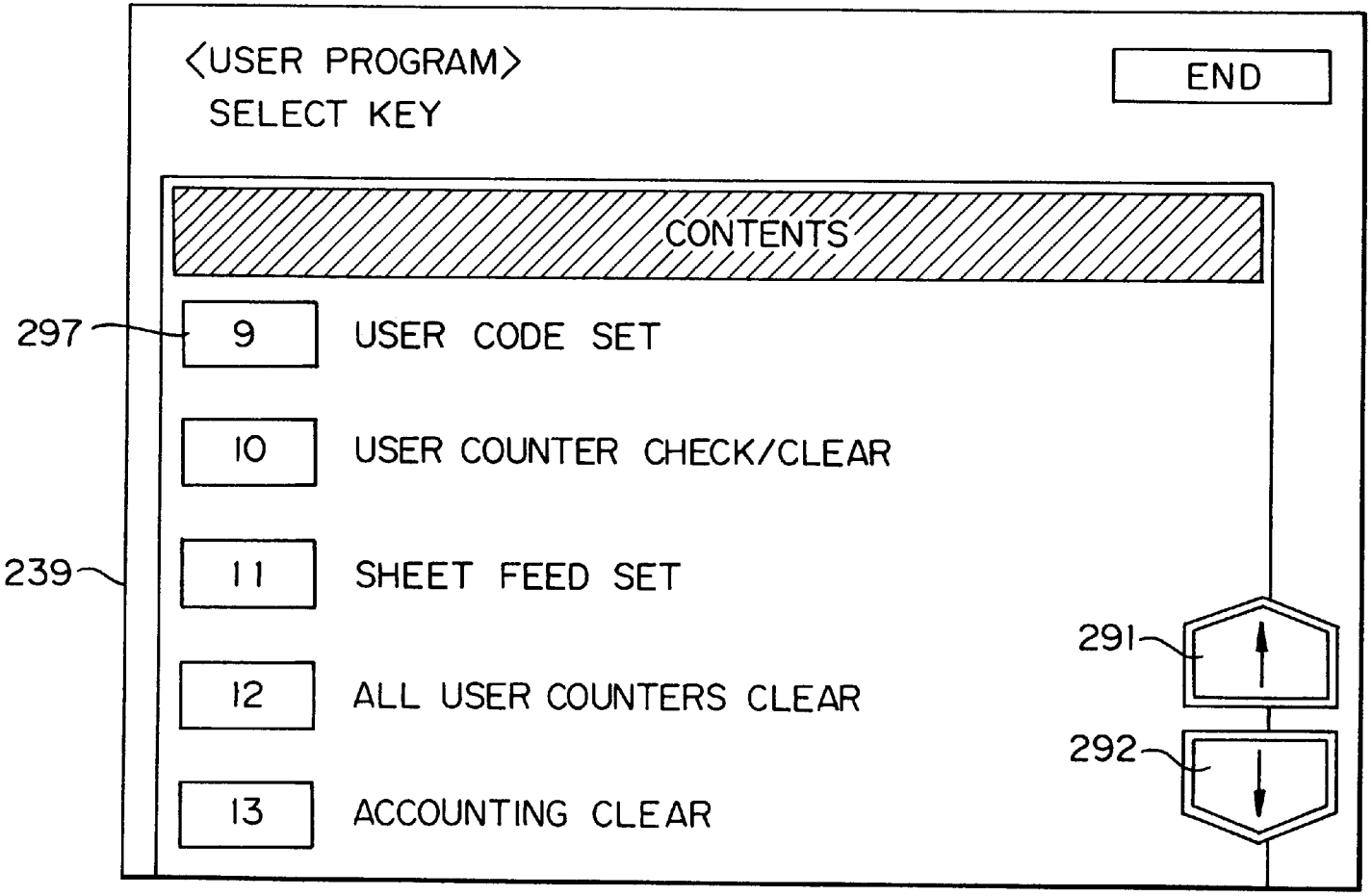
Figure 26:
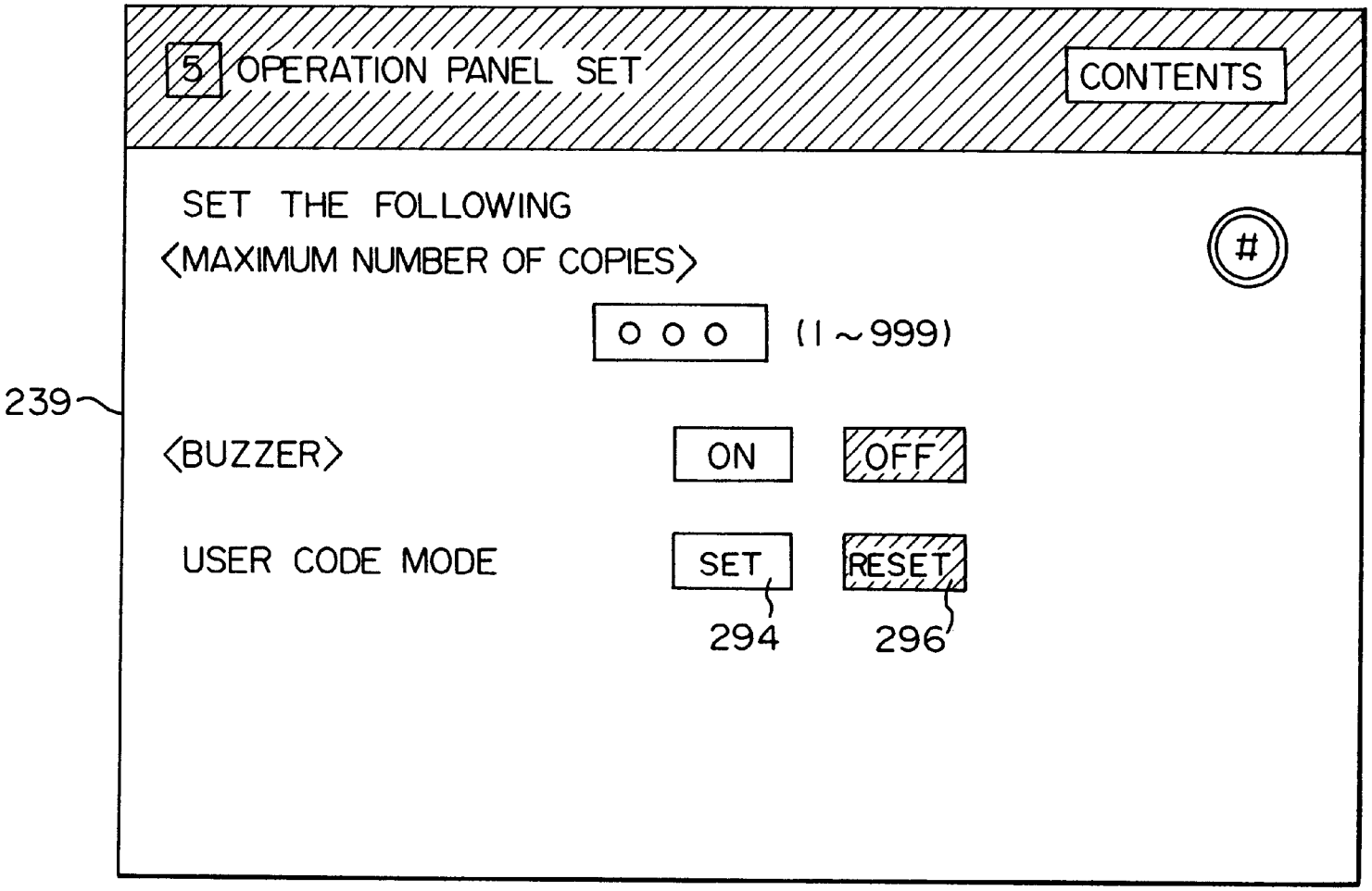
FIG. 26 shows a specific picture to appear on the LCD when a particular item number key included in the picture of FIG. 24 is touched.
Figure 27:
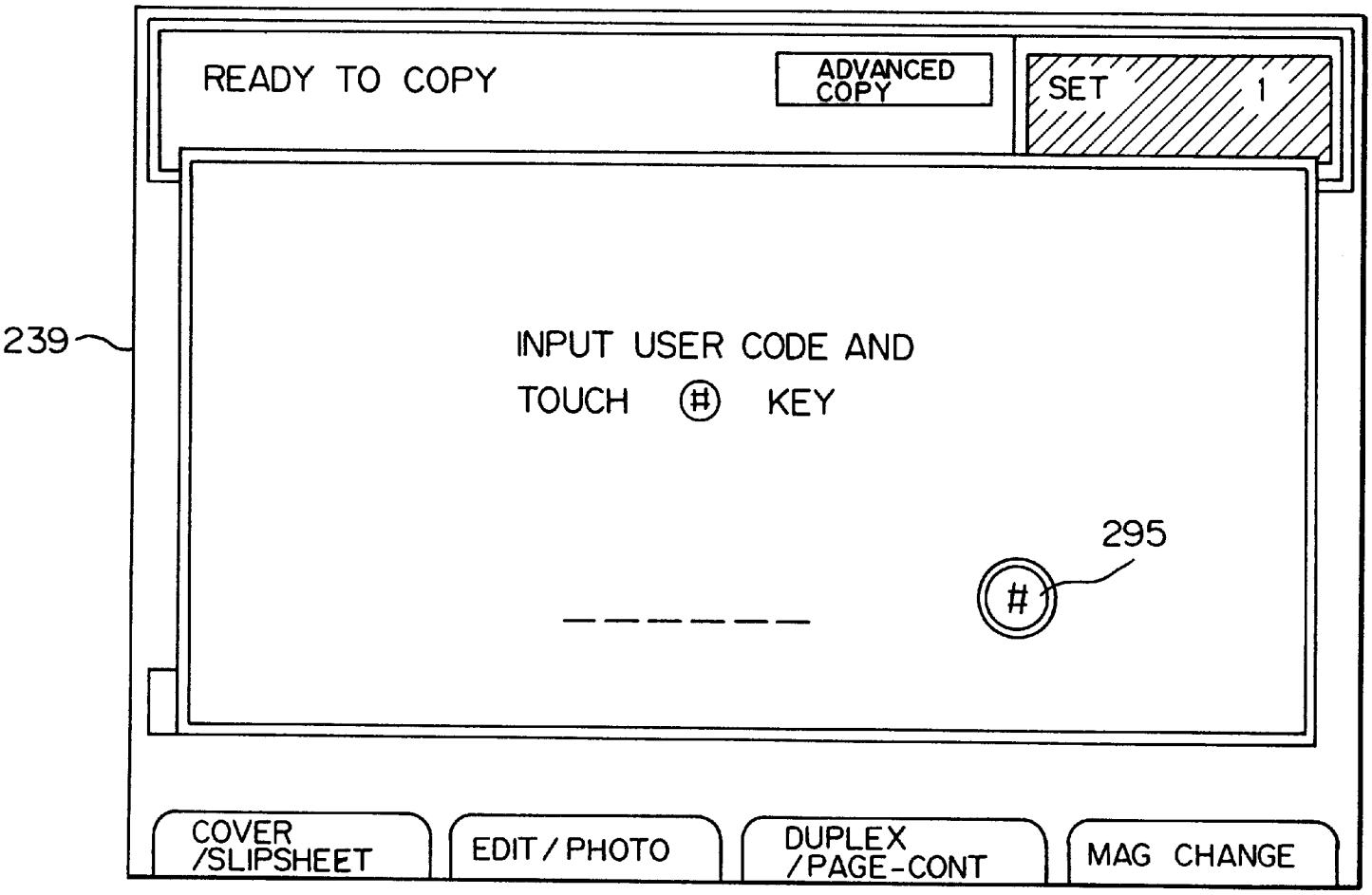
FIG. 27 shows a specific picture to appear on the LCD when a user code mode set key included in the picture of FIG. 27 is touched.

Assume that in the power-up state of the copier the operator presses the mode clear and preheat/timer key 233, FIG. 6 and then continuously presses the clear/stop key 240 for a predetermined period of time (e.g. 5 seconds). Then, the control section sets up a user program mode and displays a user program mode picture shown in FIG. 23 on the LCD 239. In practice, as shown in FIGS. 23–25, the user program mode picture extends over a plurality of frames of the LCD 239 and can be scrolled up by a scroll-up key 291 or scrolled down by a scroll-down key 292. In the above condition, when the operator touches a key 293 allocated to an item number 5, the control section replaces the picture with a panel set picture shown in FIG. 26. When the operator touches a user code mode set key 294 on the picture of FIG. 26, the control section sets up the user code mode and replaces the picture with a user code (user identification code) input picture shown in FIG. 27.

Subsequently, the operator inputs a user code on the numeral keys 232 and then touches an enter (#) key 295. In response, the control section executes an initial picture display routine which will be described. When the operator touches a user code mode cancel key 296 on the picture of FIG. 26, the control section cancels the user code mode.

Figure 28:
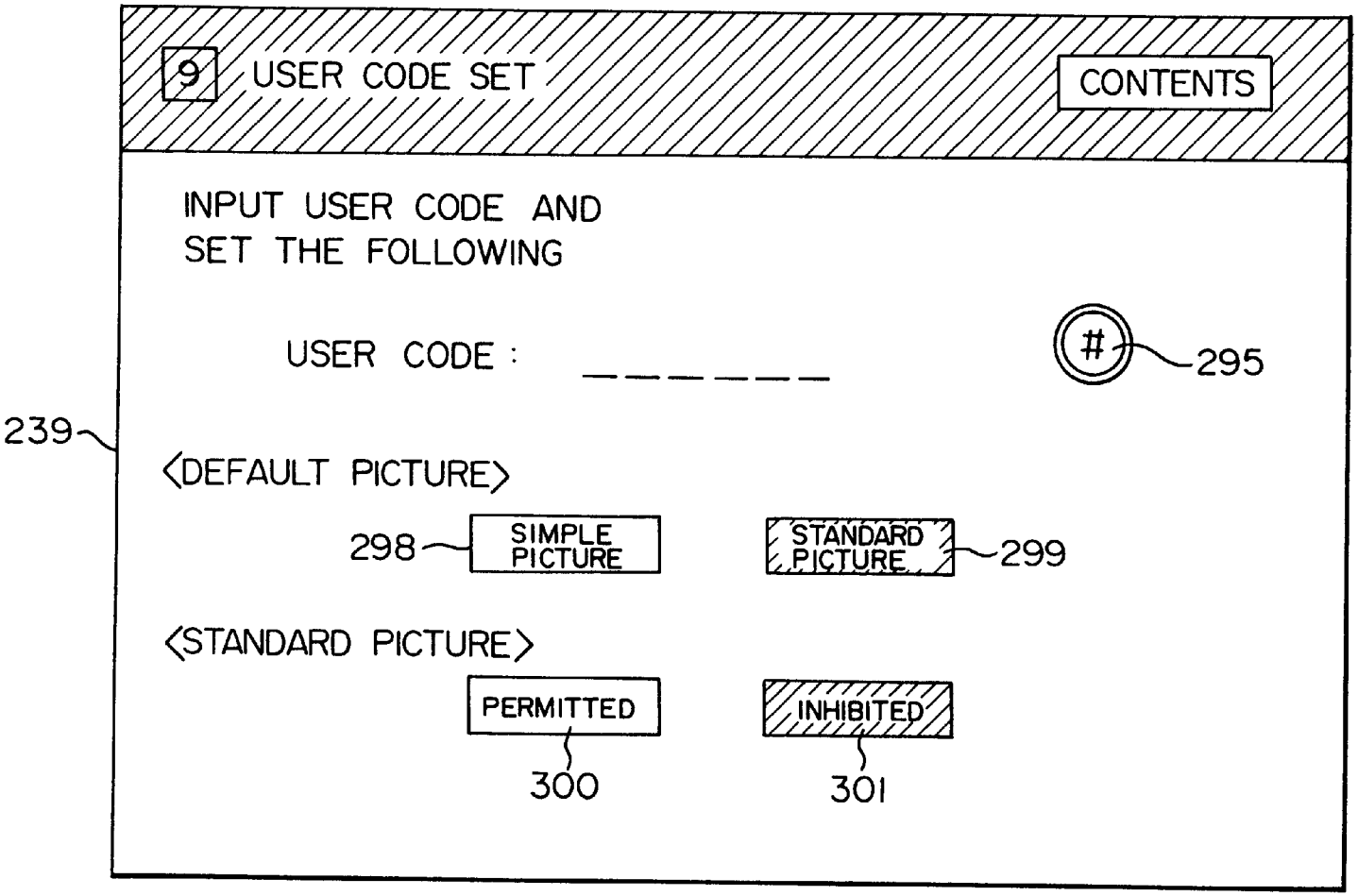
FIG. 28 shows a specific picture to appear on the LCD when a particular item number key included in the picture of FIG. 25 is touched.

When the operator touches a key 297 on the user program mode picture of FIG. 24, the control section replaces the picture with a user code set picture shown in FIG. 28. Then, the operator inputs a user code (e.g. six-figure numerical value) on the numeral keys 232, FIG. 6, touches one of a simple picture key 298 and a standard picture key 299 and one of a standard picture permit key 300 and a standard picture inhibit key 301, and then touches an enter key 295. In response, the control section sets the input user code, sets either the simple picture or the standard picture as the initial picture, and sets whether the use of the standard picture is permitted or whether it is inhibited.

It is to be noted that after the user code mode has been set, the user code input picture appears on the LCD 239 when the power switch of the copier is turned off and then turned on. As long as the user code mode is set, the copier cannot be used unless a user code matching the set user code is input.

Figure 29:
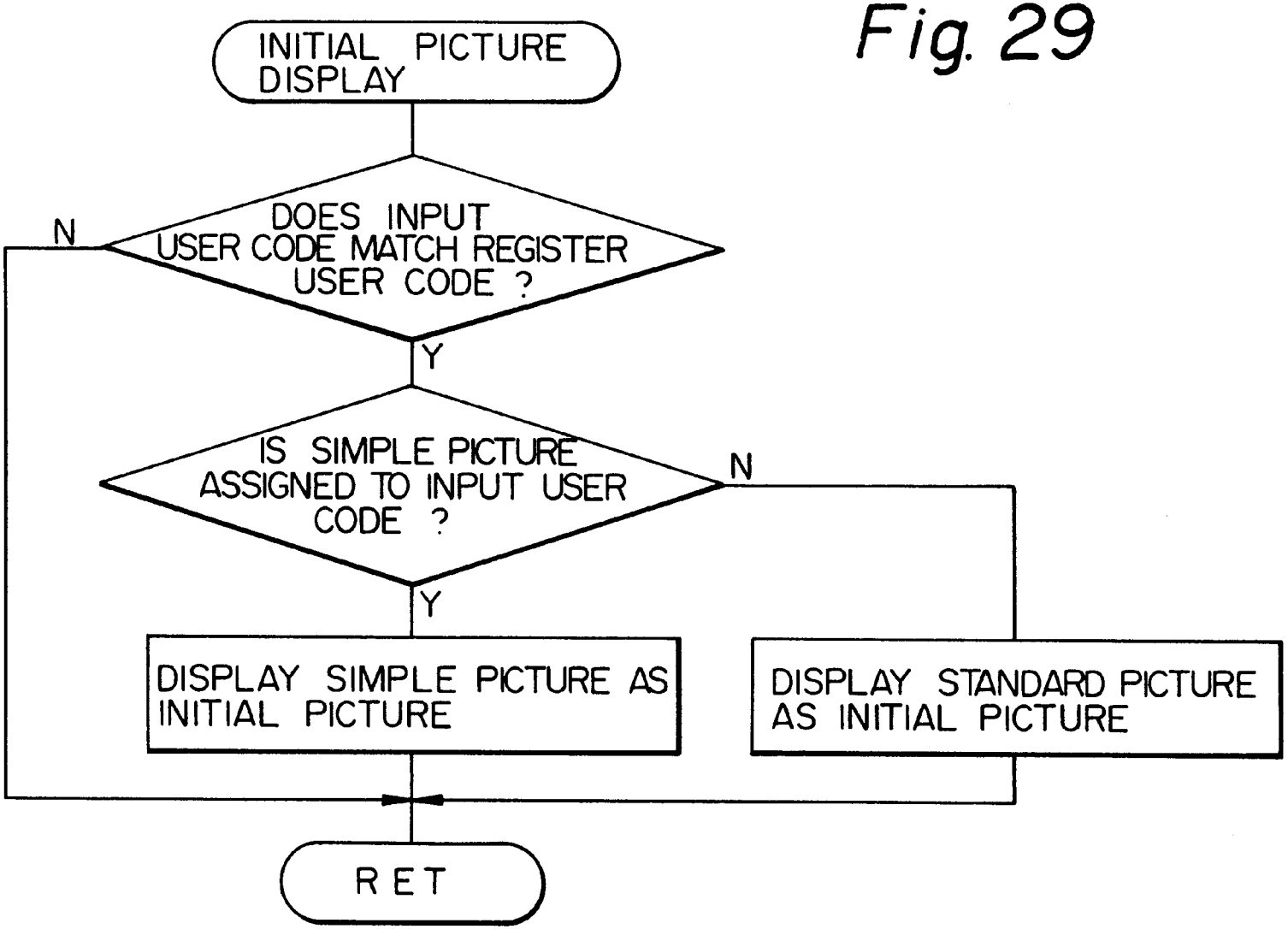
FIG. 29 is a flowchart representative of a specific initial picture display routine to be executed by the system of FIGS. 4 and 5 in a user code mode.

FIG. 29 demonstrates a specific initial picture display routine to be executed by the control section after the user code mode has been set. This routine is called from the main routine and started when the operator inputs a user code and then presses the enter key 295 on the picture of FIG. 28. As shown, the control section determines whether or not the input user code matches any one of the user codes registered at the copier beforehand. If the answer of this decision is negative, the control section returns to the main routine. If the answer of the decision is positive, the control section permits the operator to use the copier and then determines whether or not the picture allocated to the user code beforehand is the simple picture. The control section displays, based on the above decision, either the simple picture or the standard picture on the LCD 239 as the initial picture.

In the user code mode, when a predetermined period of time (e.g. 1 minute) expires without any key input after a copying operation, or when the clear/stop key 240 and mode clear and preheat/timer key 233 are pressed at the same time, the control section again displays the user code input picture on the LCD 239.

As stated above, the user code and either the simple picture or the standard pictures are registered in combination at the copier on the operator basis. Only when a user code matching any one of the registered user codes is input, the copier is allowed to be used. At the same time, the simple picture or the standard picture associated with the above user code is displayed on the LCD 239. This makes it needless for the individual operator to switch over the picture.

Figure 30:
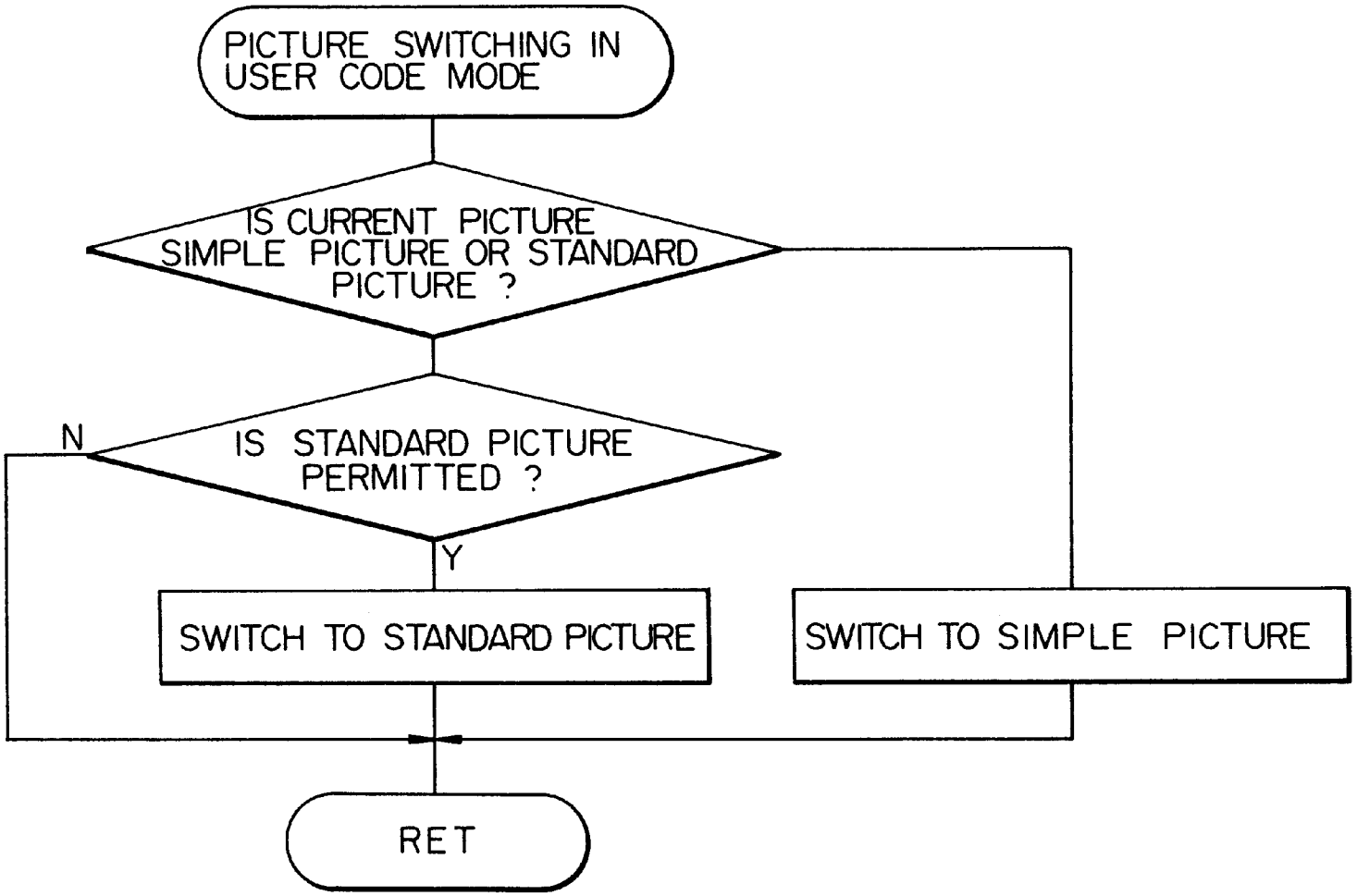
FIG. 30 is a flowchart representative of a specific picture switch routine also executed in the user code mode.

FIG. 30 shows a specific routine in which the control section switches over the picture in the user code mode. This routine is called from the main routine and started when the operator watching the initial picture on the LCD 239 presses the picture switch key 237, FIG. 6. As shown, the control section determines whether the picture appearing on the LCD 239 is the simple picture or whether it is the standard picture. If the picture is the standard picture, the control section replaces it with the simple picture and then returns to the main routine. If the picture is the simple picture, the control section determines whether or not the standard picture is permitted for the input user code. If the answer of this decision is negative, the control section holds the simple picture on the LCD 239, i.e., inhibits the simple picture from being replaced with the standard picture. If the answer of the above decision is positive, the control section replaces the simple picture with the standard picture and then returns to the main routine.

As stated above, whether or not the use of the standard picture is permitted is registered on a user code basis. If the standard picture is inhibited for the input user code, as determined after the display of the initial picture on the LCD 239, the simple picture is inhibited from being replaced with the standard picture. This successfully draws a distinction between a plurality of operators.

If desired, when the picture is switched from the simple picture to the standard picture, the copy modes selected on the former picture may be handed over to the latter picture. In addition, when the standard picture is substituted for the simple picture, the copy modes available only with the former picture or all the existing copy modes may be cleared.

Figure 31:
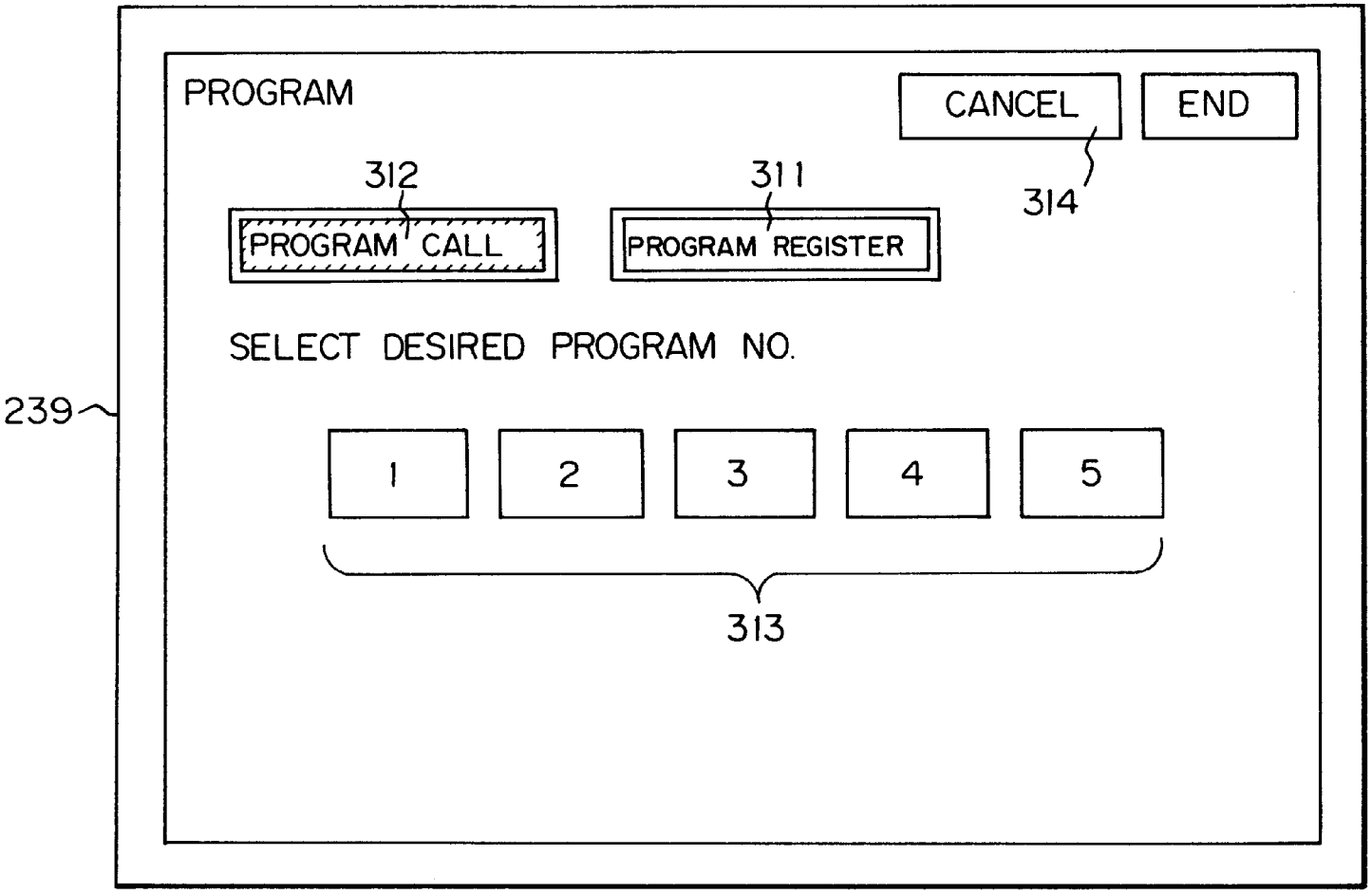
FIG. 31 shows a specific picture to appear on the LCD when a program key of FIG. 6 is pressed.

FIG. 31 shows a specific program mode picture to appear on the LCD 239 when the program key 236, FIG. 6, is pressed. As shown, the picture includes a program register key 311 for selecting a mode for registering the current copy modes (program), and a program call key 312 for selecting a mode for calling the registered copy modes. Program number keys 313 are used to input a number assigned to the copy modes to be registered or called. A cancel key 314 may be pressed to cancel the program mode. The program mode will also be cancelled when the program key 236 is pressed again.

Figures 32, 32A:
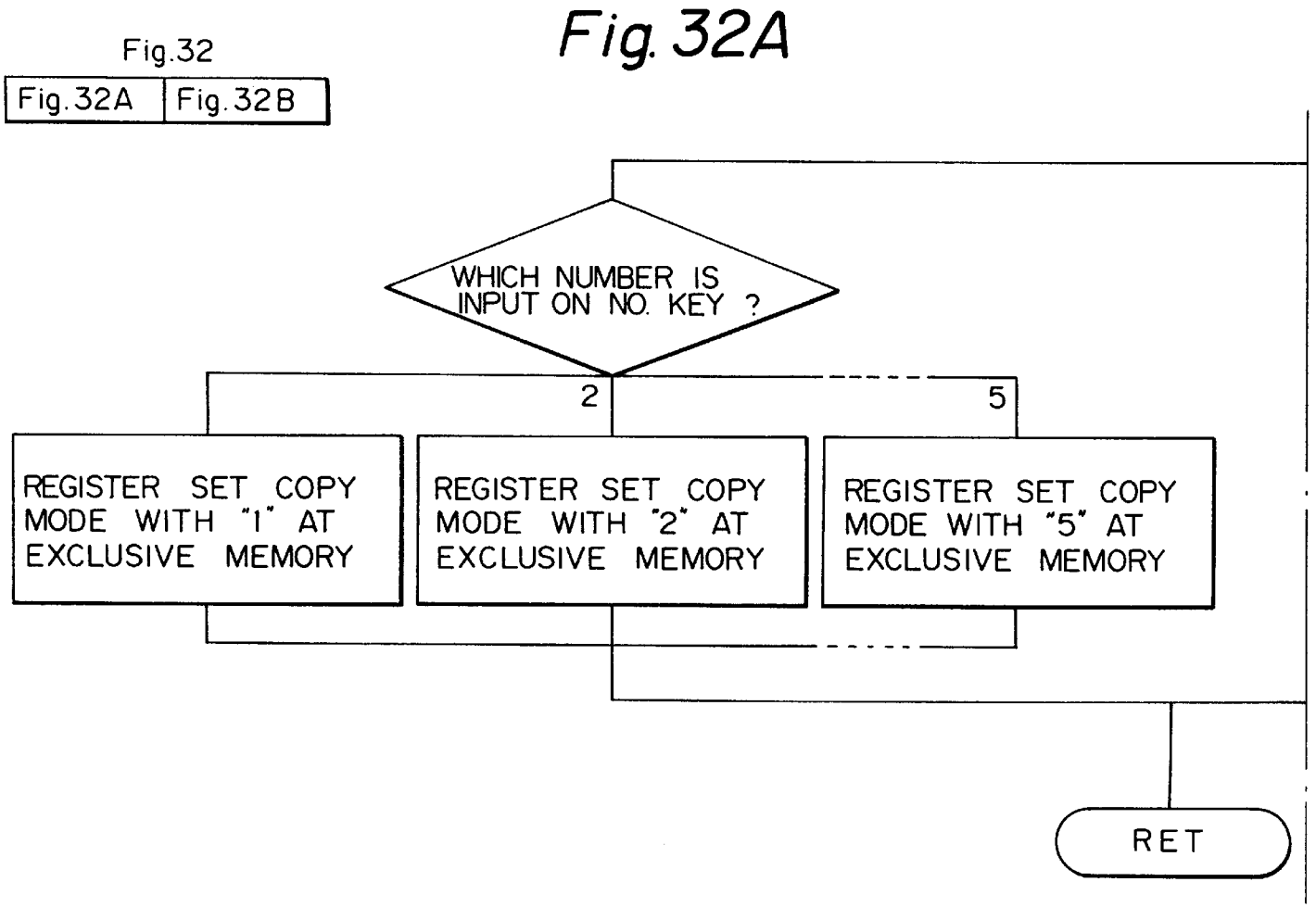
FIG. 32 is a flowchart demonstrating a specific ordinary copy mode register routine to be executed by the system of FIGS. 4 and 5.
Figure 32B:
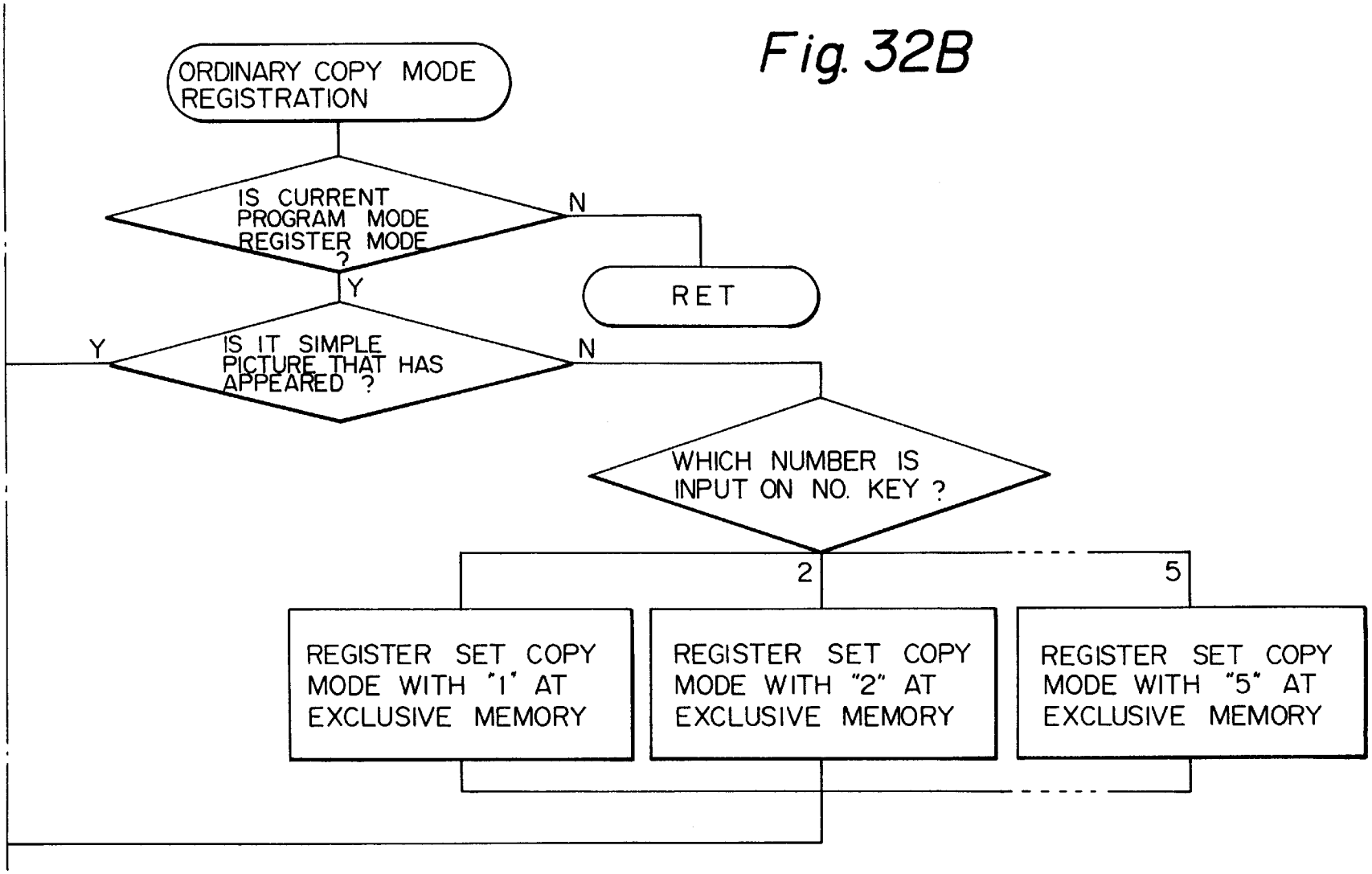

FIG. 32 shows a specific routine in which the control section registers the copy modes. This routine is called from the main routine and started after the operator has pressed the program key 236, FIG. 6, to select the program mode (program mode picture). As shown, the control section determines whether the current program mode is a register mode or whether it is a call mode. If the program mode is the call mode, the control section returns to the main routine immediately. In the case of the register mode, the control section determines whether the picture having been displayed up to that time is the simple picture or whether it is the standard picture. If the picture is the simple picture, the control section assigns, when the operator touches one of the program number keys 313 representative of "1" through "5", the program number selected to the current copy modes, registers the copy modes and program number at a memory, not shown, assigned to the simple picture, and then returns to the main routine.

If the picture having been displayed on the LCD 239 is the standard mode, the control section assigns, when the operator selects one of "1" through "5" on the program number keys 313, the program number selected to the current copy modes, registers them at a memory, not shown, assigned to the standard picture, and then returns to the main routine.

Figures 33, 33A:
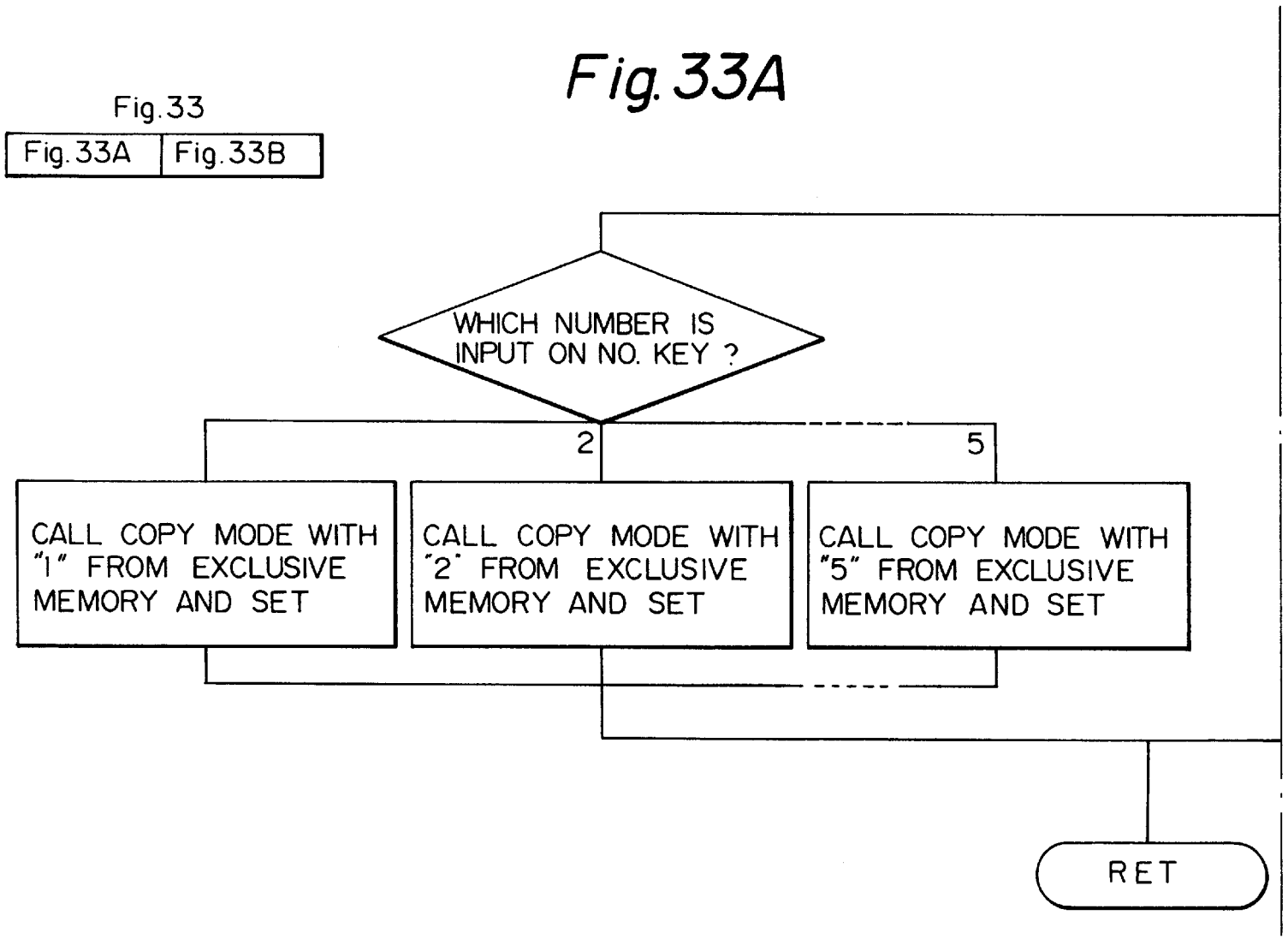
FIG. 33 is a flowchart representative of a specific ordinary copy mode call routine.
Figure 33B:
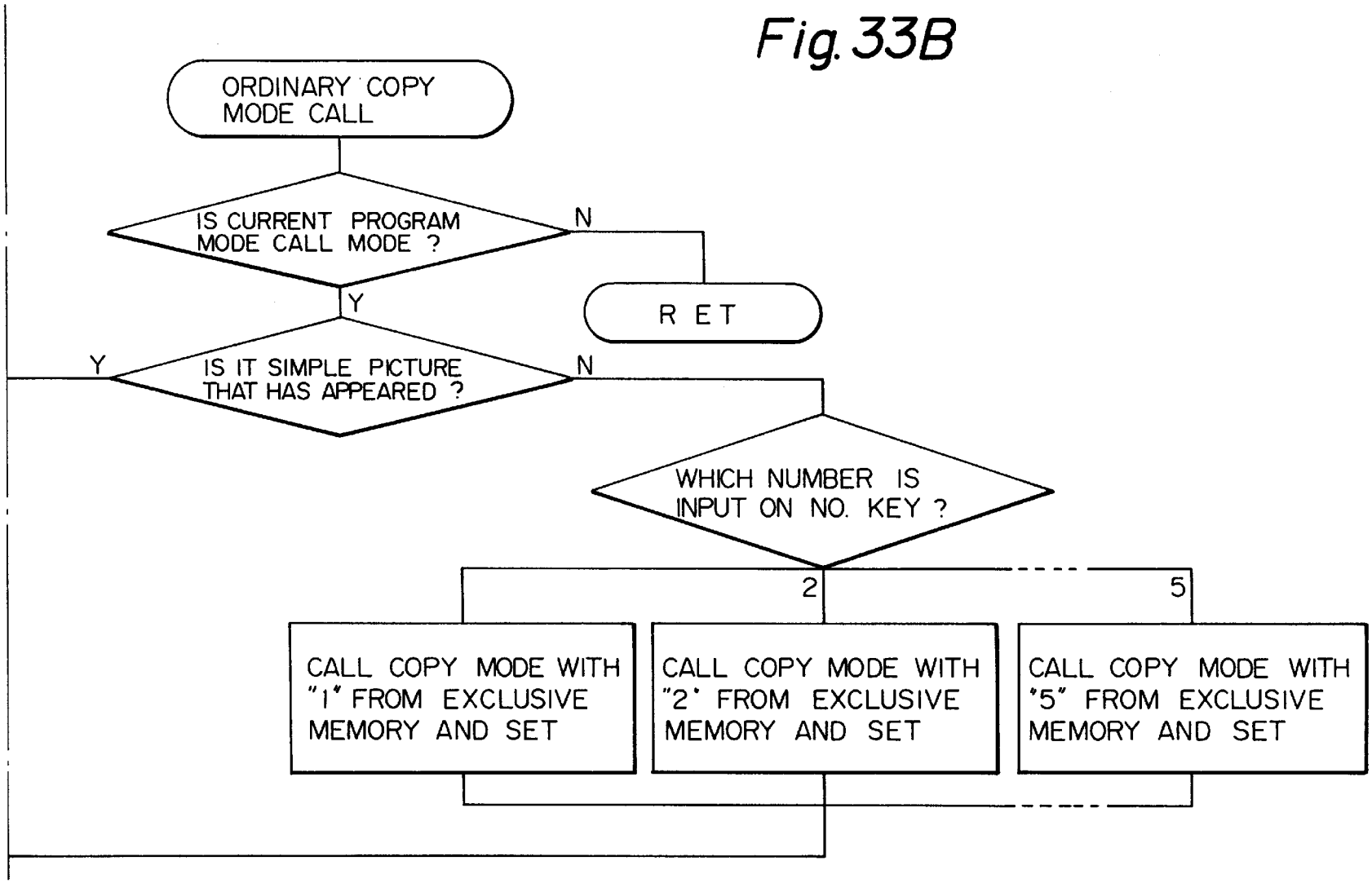

FIG. 33 shows a specific ordinary copy mode call routine to be executed by the control section. This routine is called from the main routine and started when the operator presses the program key 236, FIG. 6, to select the program mode. As shown, the control section determines whether or not the current program mode is the call mode. If the current program is the register mode, as distinguished from the call mode, the control section simply returns to the main routine. In the case of the call mode, the control section determines whether the picture having been displayed on the LCD 239 up to that time is the simple picture or whether it is the standard picture. If the picture is the simple picture, the control section calls, when the operator selects one of "1" through "5" on the program number keys 313, the copy modes designated by the number selected from the memory assigned to the simple picture, sets them up, and then returns to the main routine.

If the picture having been displayed on the LCD 239 is the standard picture, the control section calls, when the operator selects one of "1" through "5" on the program number keys 313, the copy modes designated by the program number from the memory assigned to the standard picture, and then returns to the main routine.

As stated above, the current copy modes are registered at the memory assigned to the simple picture or the standard picture, and any of the registered copy modes is called from the associated memory and set up. This obviates undesired copies attributable to needless copy modes.

Figure 34:
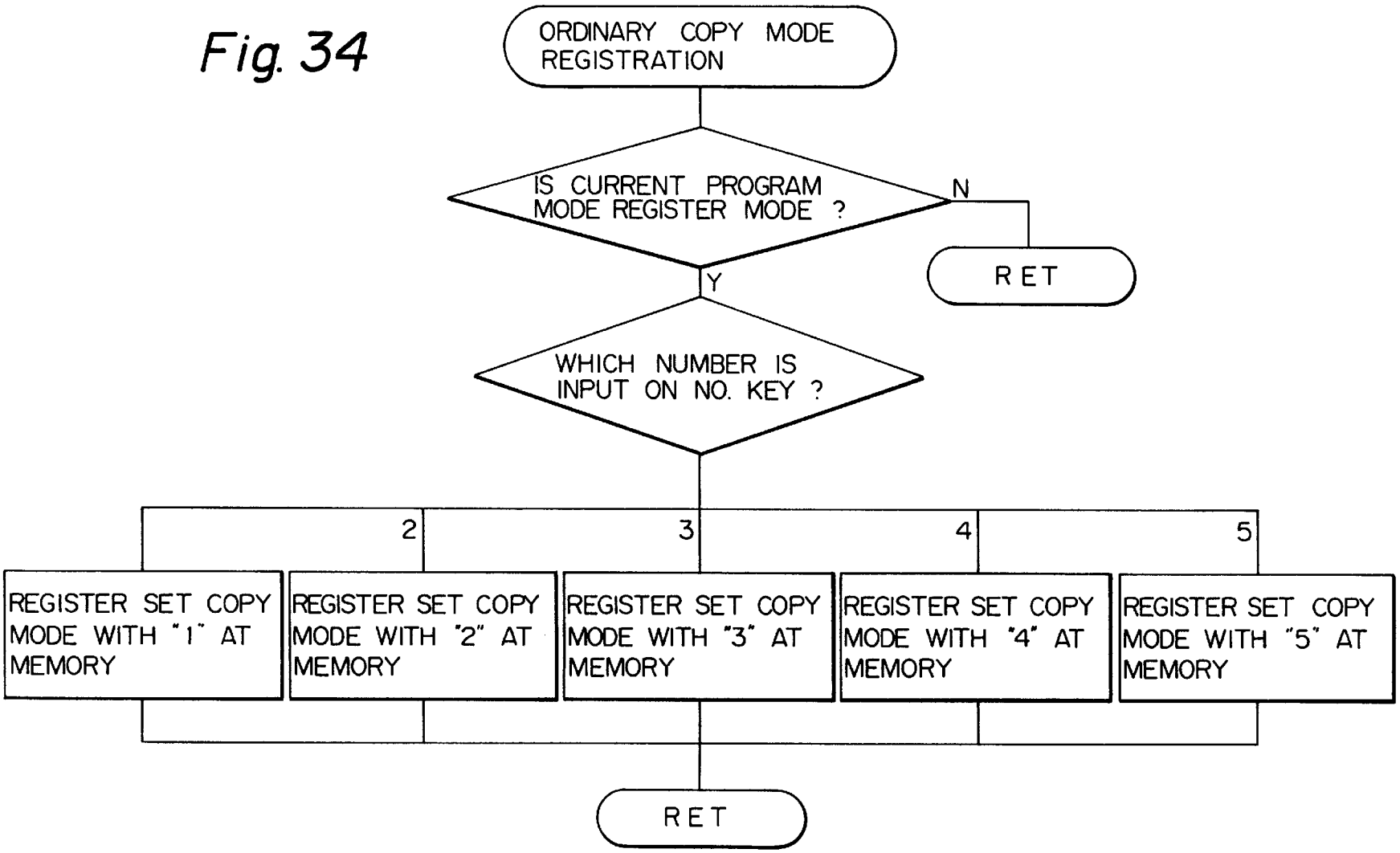
FIG. 34 is a flowchart representative of another specific ordinary copy mode register routine.

FIG. 34 shows another specific ordinary copy mode register routine to be executed by the control section. This routine is also called from the main routine and started when the operator presses the program key 236, FIG. 6, to select the program mode. As shown, the control section determines whether or not the current program is the register mode. If the answer of this decision is positive, the control section assigns, when the operator selects one of "1" through "5" on the program number keys 313, the number selected to the current copy modes, registers them at a memory, not shown, and then returns to the main memory.

Figure 35A:
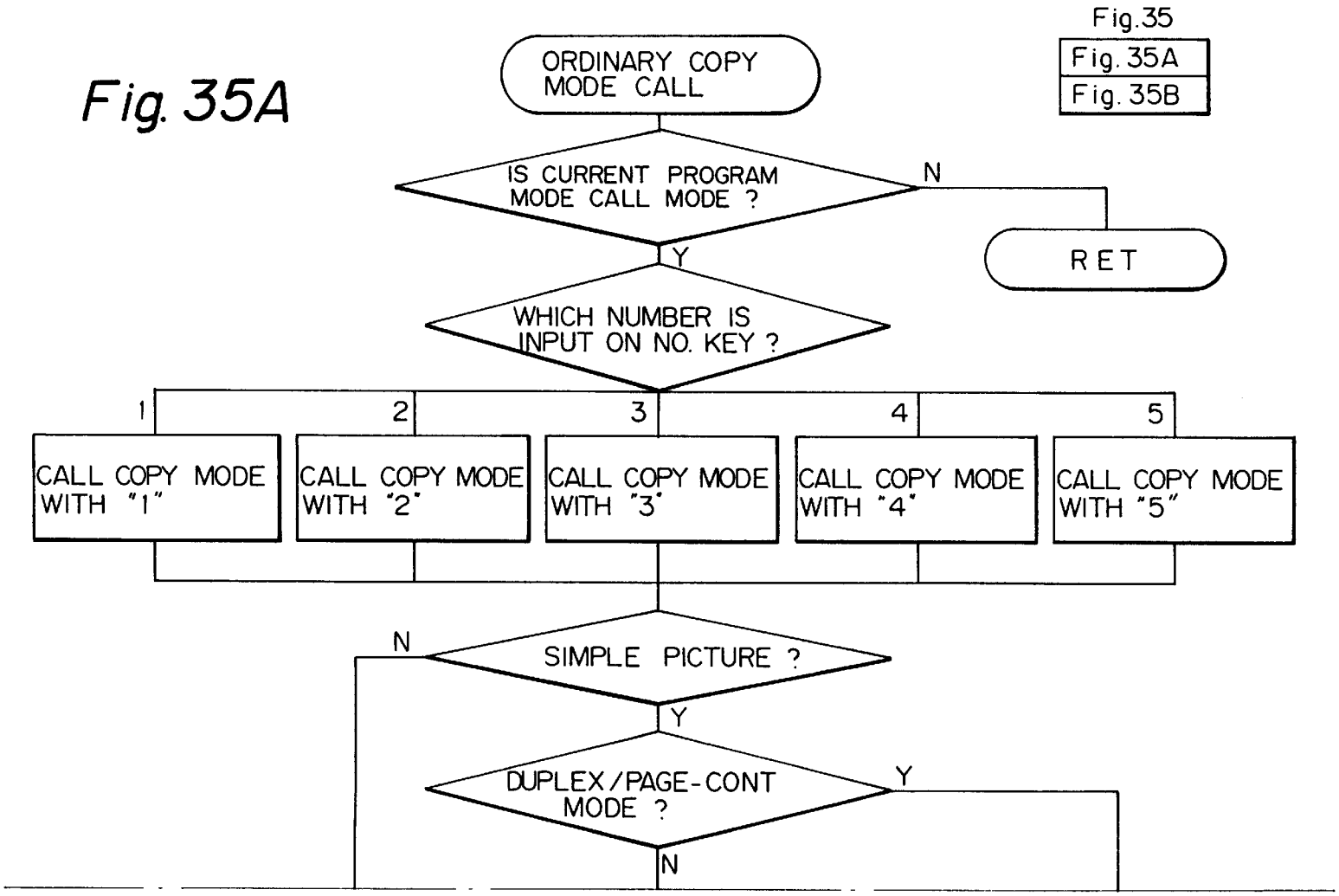
FIG. 35 is a flowchart representative of another specific ordinary copy mode call routine.
Figure 35B:
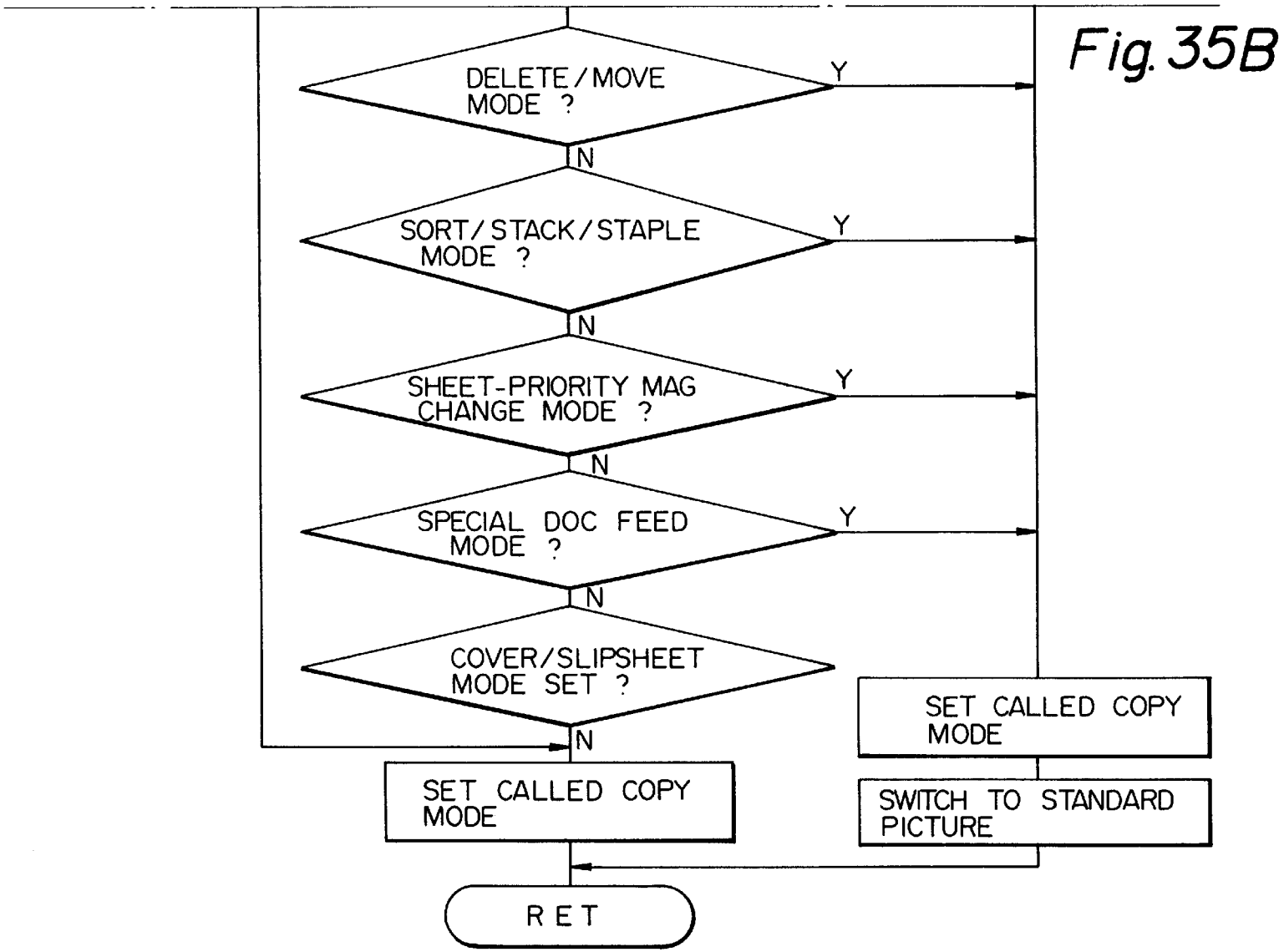

FIG. 35 shows another specific ordinary copy mode call routine to be executed by the control section. This routine is also called from the main routine and started when the operator presses the program key 236 to select the program mode. As shown, the control section determines whether or not the current program mode is the call mode. If the answer of this decision is positive, the control section calls, when the operator selects one of "1" through "5" on the program number keys 313, the copy modes designated by the number selected. Subsequently, the control section determines whether or not the picture having been displayed on the LCD 239 up to that time is the simple picture. If the answer of this decision is negative, meaning that the standard picture has been displayed, the control section sets up the copy modes called from the memory, and then returns to the main routine.

If the picture having been displayed on the LCD 239 up to that time is the simple picture, the control section determines whether or not the copy modes called are any of the copy modes available only with the standard picture (including the duplex/page-continuous mode, delete/move mode, sort/stack/staple mode, sheet-priority magnification change mode, special document feed mode, and cover/slipsheet mode). If the answer of this decision is negative, the control section sets the copy modes called and then returns to the main routine. If the answer of the above decision is positive, the control section sets up the copy modes called, displays the standard picture on the LCD 239, and then returns to the main routine.

As stated above, the current copy modes are registered at the memory. Assume that when the registered copy modes are called from the memory, the picture appearing on the LCD 239 is the standard picture, or that although the picture is the simple picture, the copy modes called are not the modes which are available only with the standard picture. Then, the called copy modes are set up. If the picture appearing on the LCD 239 is the simple picture and if the called copy modes are the modes which are available only with the standard picture, the called copy modes are set up, and the picture is switched from the simple picture to the standard picture. This enhances the easy operation of the copier while obviating undesired copies attributable to needless copy modes.

Figure 36A:
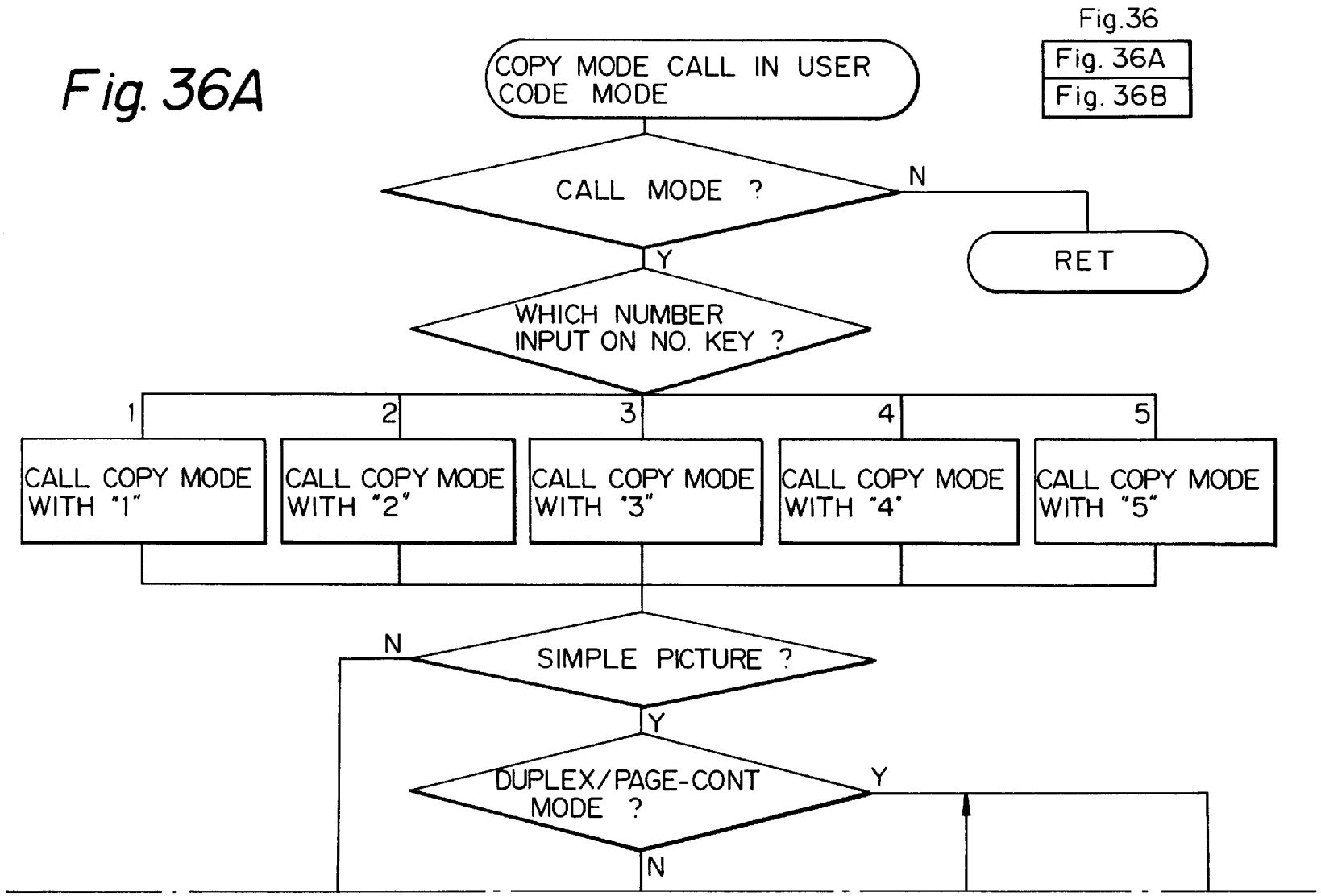
FIG. 36 is a flowchart demonstrating a specific copy mode call routine to be executed in the user code mode.
Figure 36B:
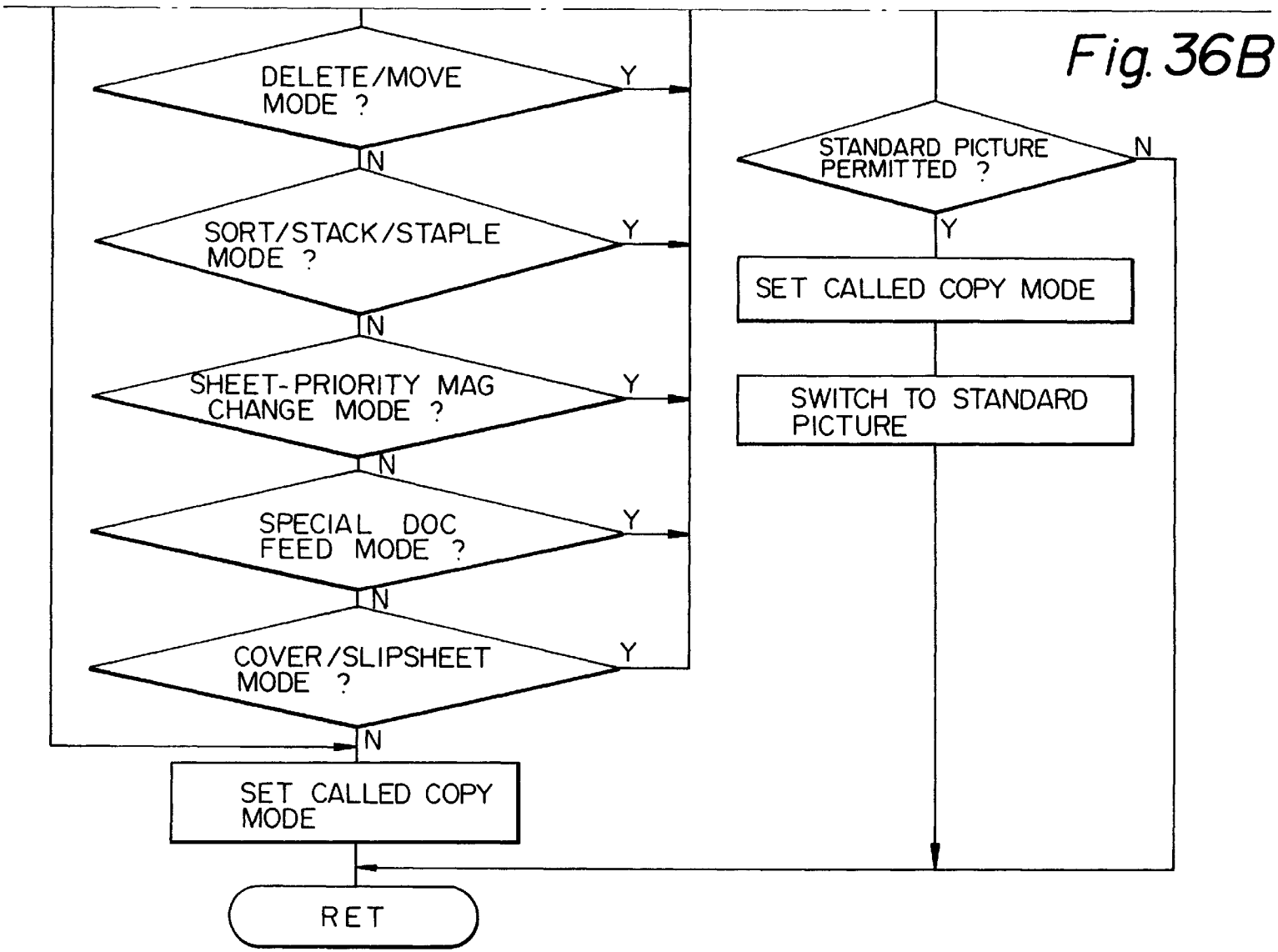

FIG. 36 shows a specific copy mode call routine to be executed by the control section in the user code mode. This routine is called from the main routine and started when the operator presses the program key 236 to select the program mode while the initial picture is displayed on the LCD 239. As shown, the control section determines whether or not the current program mode is the call mode. If the answer of this decision is positive, the control section calls, when the operator selects one of "1" through "5" on the program number keys 313, the copy modes designated by the number selected. Subsequently, the control section determines whether or not the picture having been displayed on the LCD 239 up to that time is the simple picture. If the answer of this decision is negative, meaning that the standard picture has been displayed on the LCD 239, the control section sets the called copy modes and then returns to the main routine.

If the picture having been displayed on the LCD 239 is the simple picture, the control section determines whether or not the called copy modes are the copy modes available only with the standard picture (duplex/page-continuous mode, delete/mode move, sort/stack/staple mode, sheet-priority magnification change mode, special document feed mode, and cover/slipsheet mode). If the picture having been displayed on the LCD 239 is not any of the copy modes available only with the standard picture, the control section sets the called copy modes and then returns to the main routine. If the called copy modes are those available only with the standard picture, the control section determines whether or not the standard picture is permitted for the input user code. If the answer of this decision is negative, the control section does not change the existing conditions, i.e., inhibits the called copy modes from being set and inhibits the simple picture from being replaced with the standard picture, and then returns to the main routine. If the answer of the above decision is positive, the control section replaces the simple picture with the standard picture and then returns to the main routine.

As stated above, when the program mode is selected in the user code mode, the copy modes registered at the memory are called. If the picture appearing on the LCD 239 is the standard picture or if it is the simple picture, but the called copy modes are not those available only with the standard picture, the called modes are set. If the picture appearing on the LCD 239 is the simple picture and if the called copy modes are those available only with the standard picture, and if the standard picture is inhibited for the input user code, the setting of the called copy modes and the substitution of the standard picture for the simple picture are inhibited. If the standard picture is permitted for the input user code, the called copy modes are set while the standard picture is substituted for the simple picture. This successfully draws a distinction between the operators, obviates undesired copies ascribable to needless copy modes, and enhances easy operation.

An alternative embodiment of the present invention will be described hereinafter. This embodiment is similar in hardware to the previous embodiment except that it additionally has a human body sensor. The following description will therefore concentrate only on the differences between the two embodiments.

Figure 37:
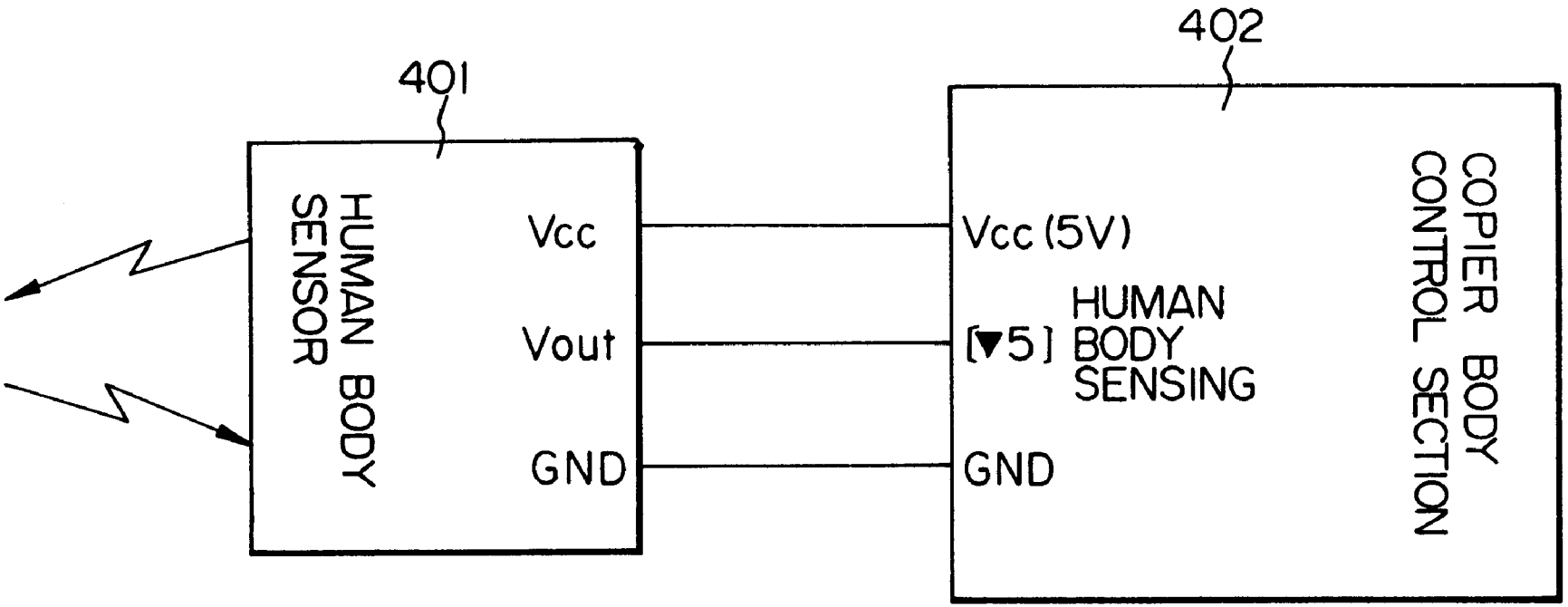
FIG. 37 shows an alternative embodiment of the present invention and including a human body sensor.

As shown in FIG. 37, the alternative embodiment has a human body sensor 401 located in close proximity to the operation panel unit 136. The sensor 401 consists of a light emitting diode for emitting infrared rays, optics for restricting the infrared rays in a preselected direction, and a light-sensitive element for receiving the rays reflected by a human body. When a human body exists in a predetermined range from the sensor 401, the sensor 401 senses it and sends its output (sense signal) to a copier body control section 402. A switch is built in the sensor 401 in order to switch the above range in two steps.

Figure 38:
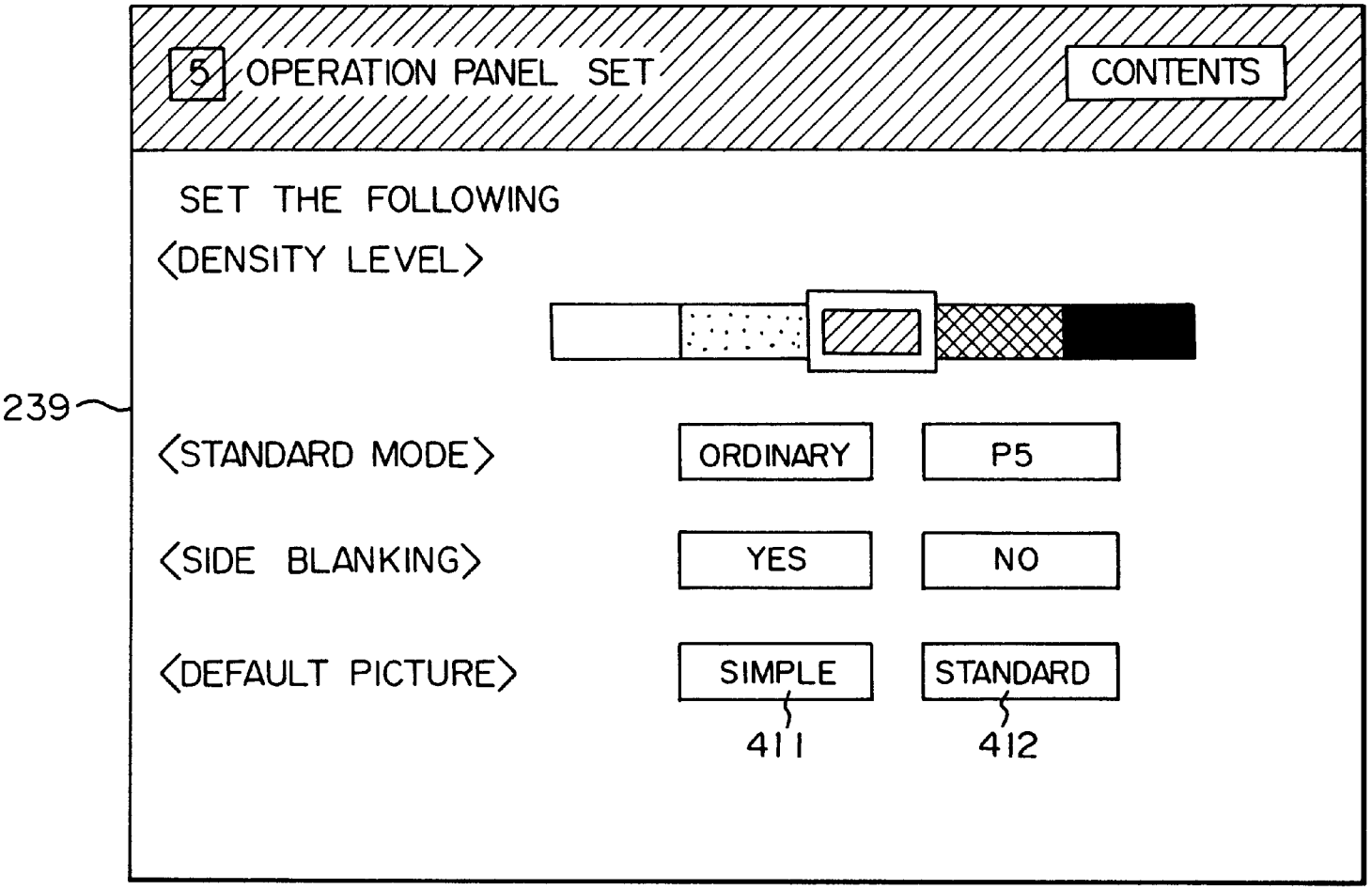
FIG. 38 shows a specific picture to appear on the LCD in the embodiment of FIG. 27 when the mode clear and preheat/timer key is pressed, and then the clear/stop key is continuously pressed.

How the initial (default) picture is set by the operator and dealt with by the control section will be described with reference also made to FIG. 38. Assume that after the power-up of the copier the operator presses the mode clear and preheat/timer key 233, FIG. 6, and then continuously presses the clear/stop key 240, as stated earlier. Then, the control section sets up the user program mode and substitutes the user program mode picture of FIG. 23 for the initial picture. When the operator touches "5" on the picture of FIG. 23, the control section replaces the existing picture with a panel setting picture shown in FIG. 38. When the operator touches a simple picture key 411 on the panel setting picture, the control section sets the simple picture, FIG. 8, as the initial picture. On the other hand, when the operator touches a standard picture key 412, the control section sets the standard picture, FIG. 9, as the initial picture.

Figure 39:
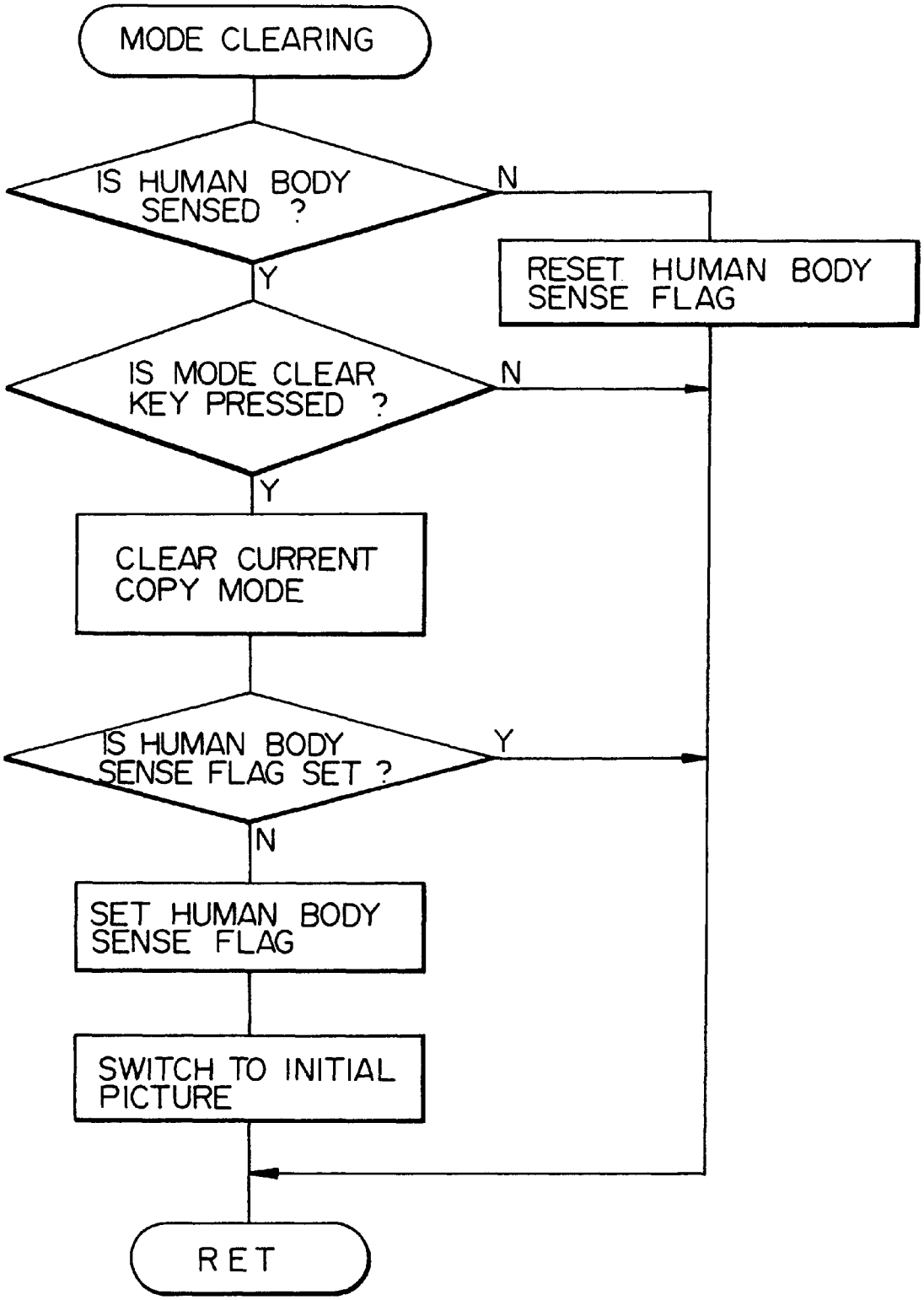
FIG. 39 is a flowchart demonstrating a specific ordinary mode clear routine.

FIG. 39 shows a specific ordinary mode clear routine to be executed by the control section. This routine is also called from the main routine and started. As shown, the control section determines whether or not the human body sensor 401 has sensed a human body. If the answer of this decision is negative, the control section resets ("0") a human body sense flag and then returns to the main routine. If the sensor 401 has sensed a human body, the control section determines whether or not the mode clear key 233, FIG. 6, has been pressed. If the key 233 has not been pressed, the control section returns to the main routine; if otherwise, it clears the existing copy modes and then determines whether or not the human body sense flag is set ("1").

Assume that the human body sense flag is set, meaning that the sensor 401 is sensing a human body, and the second or successive mode clear command (operation of the mode clear and preheat/timer key 233) is input (i.e. the operator is manipulating the keys on the operation panel unit 136). Then, the control section simply returns to the main routine, i.e., inhibits the replacement of the existing picture with the initial picture. If the human body sense flag is not set, meaning that the first mode clear command is input while the sensor 401 is sensing a human body (i.e. just after the operator has started manipulating the keys on the unit 136), the control section sets the flag, replaces the picture of FIG. 6 with the initial picture (simple picture or picture forming part of the standard picture and set as the initial picture), and then returns to the main routine.

As stated above, when the first mode clear (function clear) command is input while the sensor 401 is sensing a human body, the existing copy modes are cleared, and the picture on the LCD 239 is replaced with the initial picture. When the second or successive mode clear command is input while the sensor 401 is sensing a human body, the existing copy modes are cleared, but the replacement of the existing picture with the initial picture is inhibited. This frees the individual operator from the operation for switching the picture to the initial picture and thereby enhances easy operation.

Further, if either the simple picture or the standard picture is set as the initial picture beforehand, it is possible for the individual operator to select the initial picture meeting the operator's needs.

This embodiment, like the previous embodiment, is capable of executing the ordinary picture switch routine and the picture display and picture switch routines in the user code mode when the picture switch key 237, FIG. 6 is operated.

Figure 40:
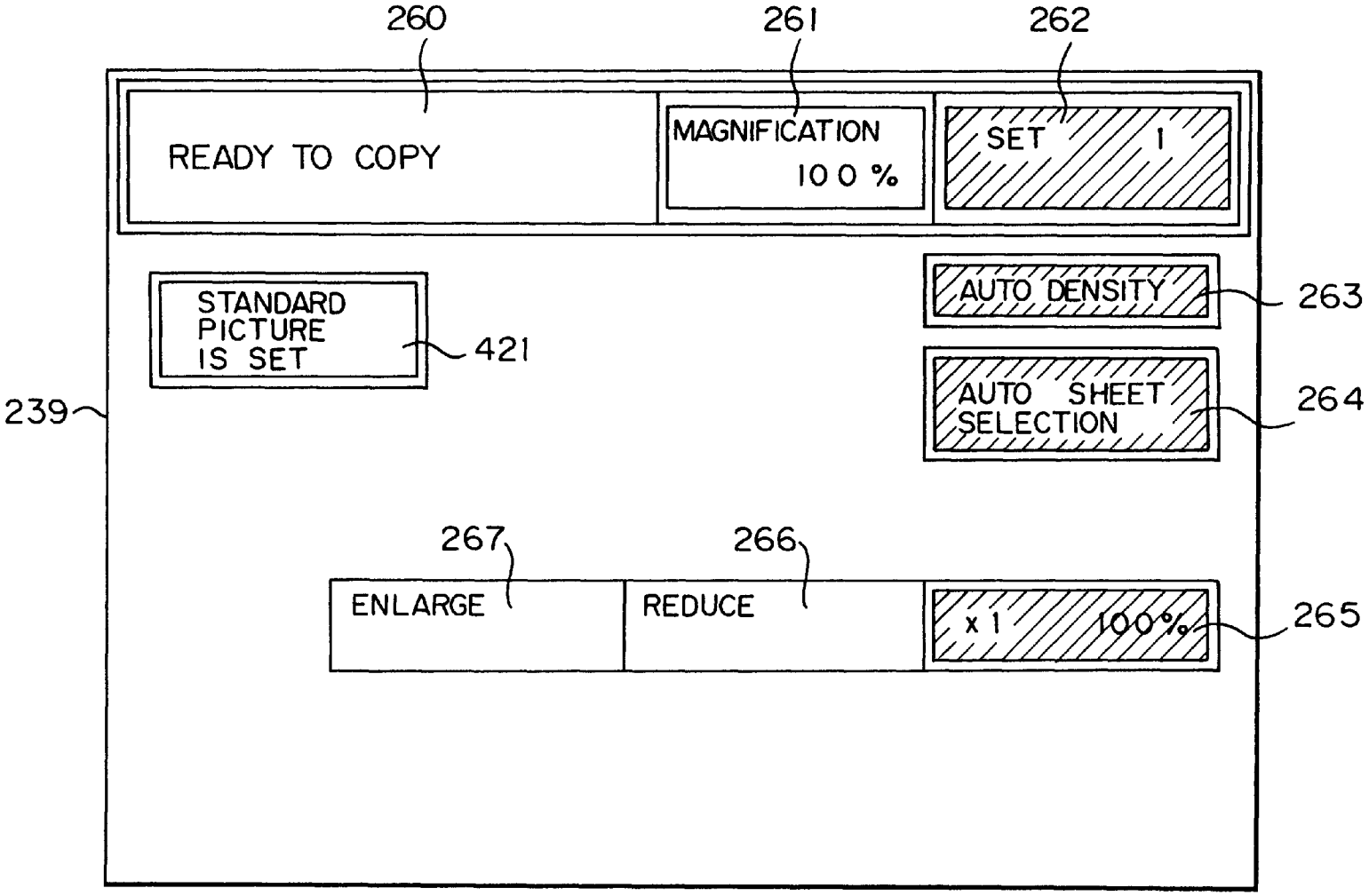
FIG. 40 shows a specific simple picture to appear on the LCD and representative of another alternative embodiment of the present invention.

Another alternative embodiment of the present invention will be described hereinafter and is practicable with the same hardware as shown and described in relation to the first embodiment. FIG. 40 shows a specific simple picture to appear on the LCD 239, FIG. 6, and is similar to FIG. 8 except for the following. As shown, the simple picture additionally includes an area for informing the operator of the fact that copy modes not available with the simple picture are set on the standard picture. The standard picture is identical with the picture shown in FIG. 9. Again, either the simple picture or the standard picture may be set as the initial picture, if desired.

Figure 41:
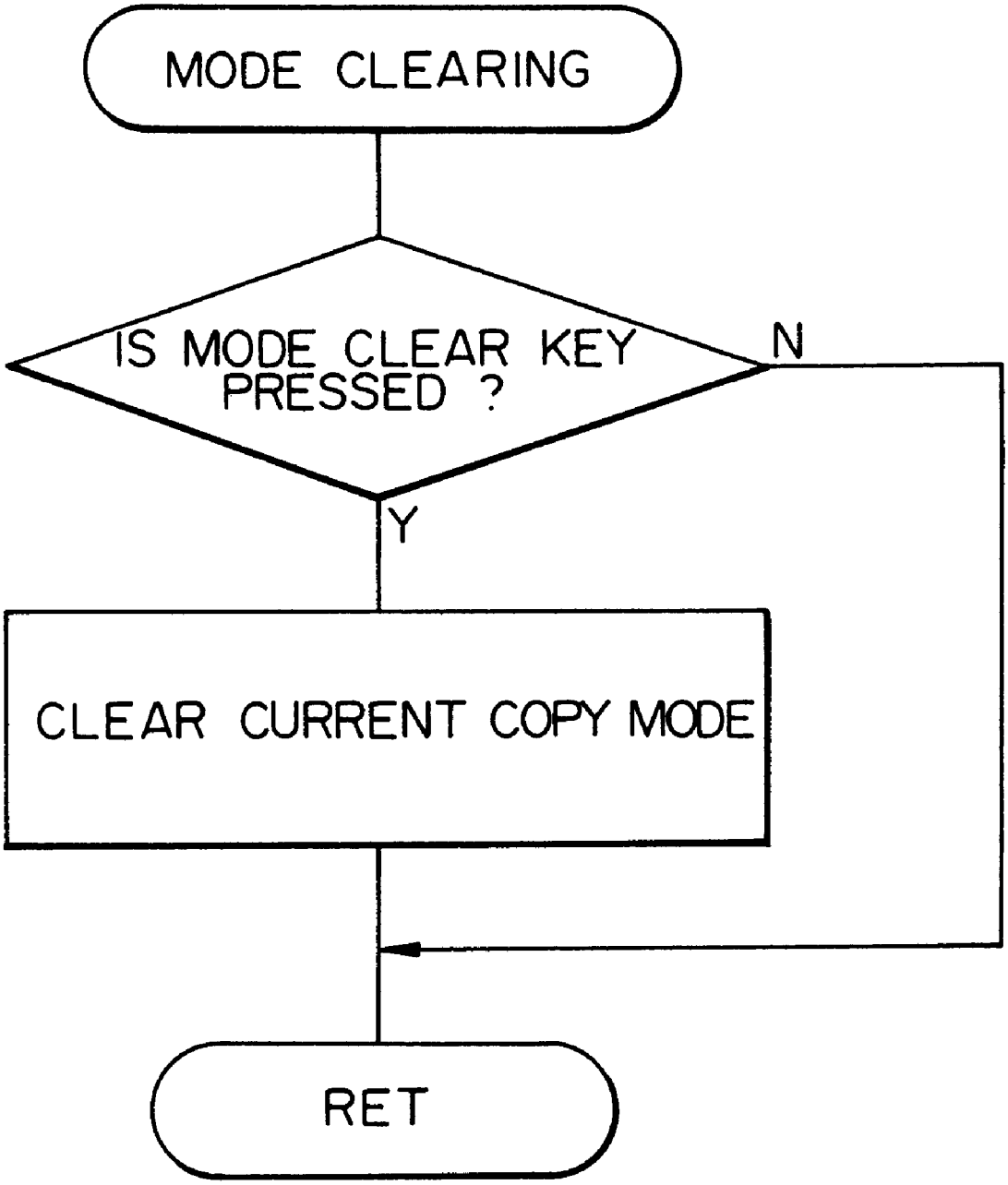
FIG. 41 is a flowchart demonstrating a specific ordinary mode clear routine available with the embodiment of FIG. 40.

FIG. 41 shows a specific mode clear routine available with the illustrative embodiment. This routine is also called from the main routine and started. As shown, the control section determines whether or not the mode clear key 233, FIG. 6, has been pressed. If the answer of this decision is negative, the control section simply returns to the main routine; if otherwise, it clears the existing copy modes and then returns to the main routine. At this instant, the control section does not switch the picture to the initial picture, i.e., it inhibits the switchover.

Figure 42:
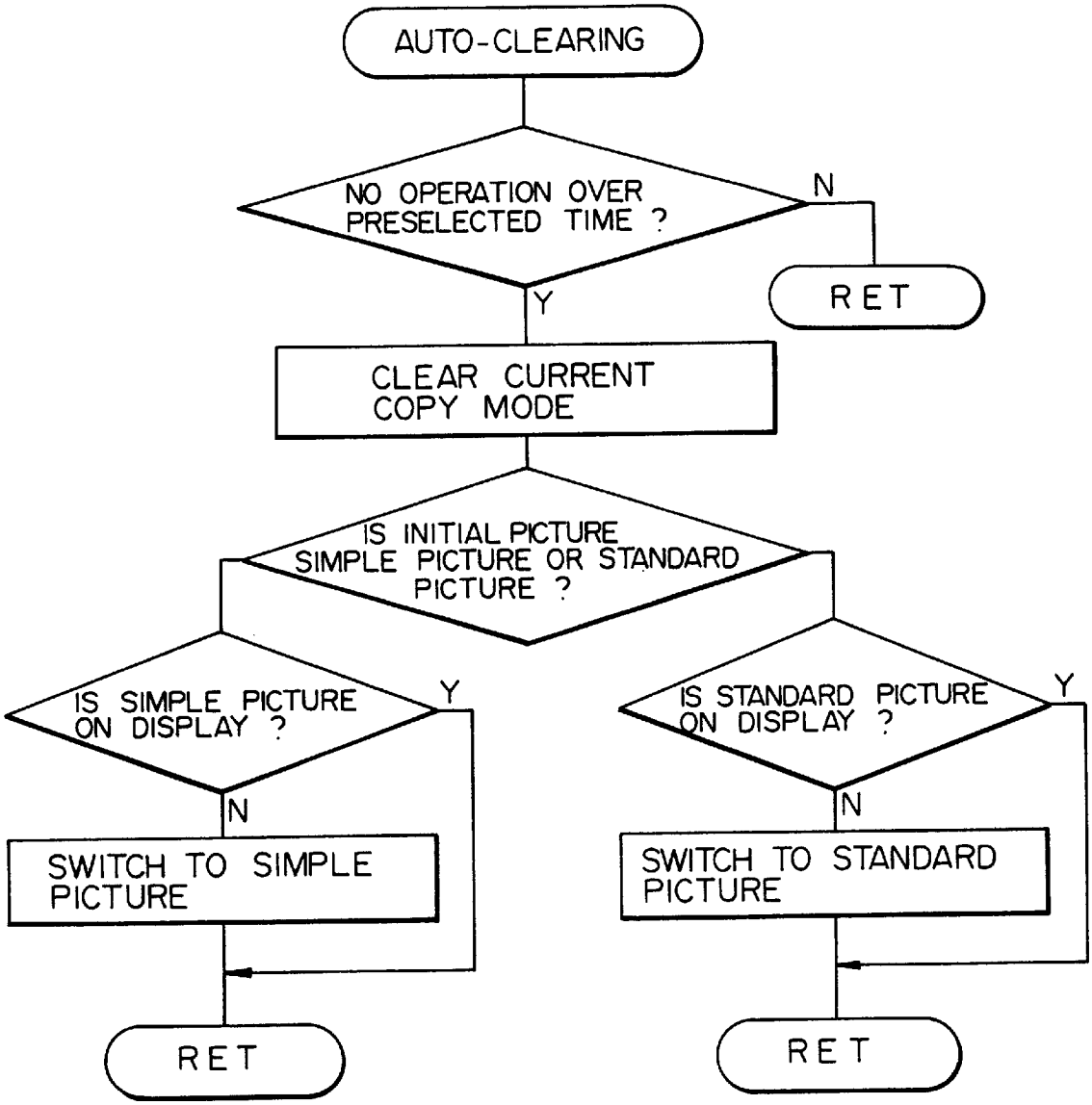
FIGS. 42 and 43 are flowchart respectively demonstrating a specific ordinary auto-clear routine and a specific ordinary picture switch routine particular to the embodiment of FIG. 40.

FIG. 42 shows a specific ordinary auto-clear routine to be executed by the control section. This routine is also called from the main routine and started. As shown, the control section determines whether or not the keys on the operation panel unit 136, FIG. 6, have not been operated for more than a predetermined period of time (e.g. 1 minute). If any one of the keys is operated before the above period of time elapses, the control section simply returns to the main routine. If no keys have been operated for the above period of time, the control section clears the existing copy modes and then determines whether the initial picture is the simple picture or whether it is the standard picture. If the initial picture is the simple picture, the control section determines whether or not it is displayed on the LCD 239. If the answer of this decision is positive, the control section returns to the main routine.

If the simple picture is not displayed on the LCD 239, the control section switches the picture to the simple picture and then returns to the main routine. On the other hand, if the initial picture is the standard picture, the control section determines whether or not it is displayed on the LCD 239; if it is not displayed, the control section displays it and then returns to the main routine.

As stated above, when no keys are operated for more than a predetermined period of time, the existing copy modes are automatically cleared while the existing picture is switched to the initial picture. When a mode clear command is input, the existing modes are cleared, but the existing picture is inhibited from being replaced with the initial picture. This frees the individual operator from the operation for selecting the initial picture and thereby enhances easy operation.

Further, if either the simple picture or the standard picture is set as the initial picture beforehand, it is possible for the individual operator to select the initial picture meeting the operator's needs.

Figure 43:
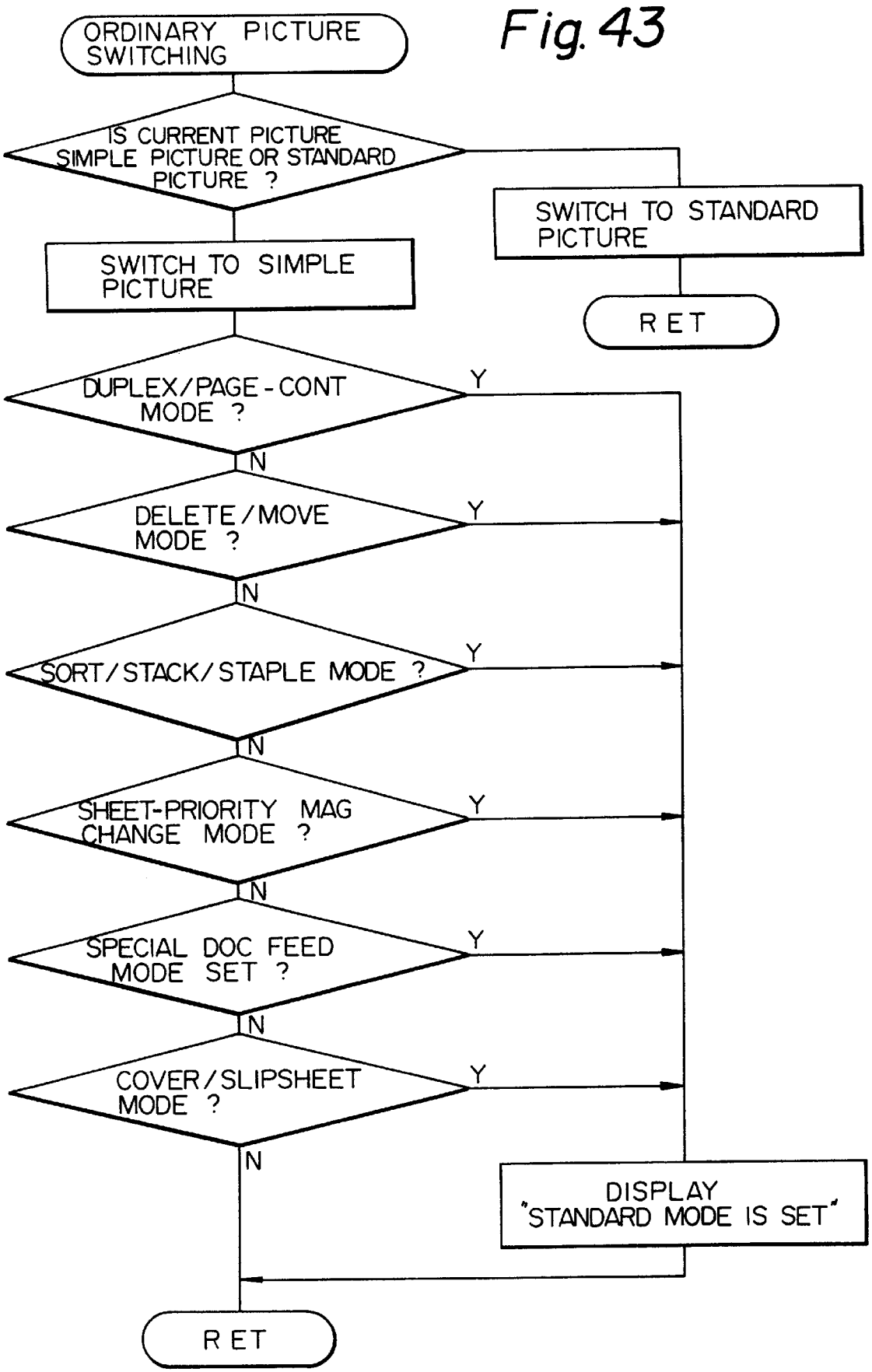

FIG. 43 shows a specific ordinary picture switch routine available with the illustrative embodiment. This routine is called from the main routine and started when the operator presses the picture switch key 237 of the operation panel unit 136 shown in FIG. 6. As shown, the control section determines whether the picture appearing on the LCD 239 is the simple picture or whether it is the standard picture. If the existing picture is the simple picture, the control section replaces it with the standard picture and then returns to the main routine. If the existing picture is the standard picture, the control section replaces it with the simple picture and then determines whether or not the copy modes available only with the standard picture (duplex/page-continuous mode, delete/mode move, sort/stack/staple mode, sheet-priority magnification change mode, special document feed mode, and cover/slipsheet mode) are set.

If the above copy modes are not set, the control section simply returns to the main routine. If such modes are set, the control section holds them, displays a suitable message, e.g., "Standard picture is set," in the area 421 of the LCD 239 shown in FIG. 40, and then returns to the main routine. The above message informs the operator of the fact that the copy modes not available with the simple picture are set.

As stated above, if the copy modes available only with the standard picture are set when the operator switches the picture on the LCD 239 from the standard picture to the simple picture, the above copy modes are held while a message informing the operator of such a condition is displayed in the simple picture. Hence, even when the operator setting various copy modes including the above copy modes performs the picture switching operation by accident, it is not necessary for the operator to again set the original copy modes when restored the standard picture. Further, undesirable copies attributable to needless copy modes are obviated, so that easy operation is enhanced to a noticeable degree.

In summary, it will be seen that the present invention provides an image forming apparatus having various unprecedented advantages as enumerated below.

(1) By selectively displaying a simple picture or a standard picture by software, it is possible to set up functions matching the contents of image formation and operator's skill without resorting to utilizing an openable cover for covering a part of function setting keys.

(2) When the picture is switched from the standard picture to the simple picture, functions available only with the standard picture are cleared. This successfully obviates defective image formation attributable to needless functions.

(3) When the standard picture is replaced with the simple picture, all the existing functions are cleared. This makes it needless for the operator to clear the functions after the switchover, and obviates defective image formation attributable to needless functions.

(4) Because the functions set on the simple picture are handed over to the standard picture when the former is replaced with the latter, it is not necessary for the operator to set basic functions again. This enhances the easy operation of the apparatus.

(5) Only when a user code matching any one of registered user codes is input, the apparatus is allowed to be used. At the same time, the simple picture or the standard picture associated with the above user code is displayed on display means. This makes it needless for the individual operator to switch over the picture.

(6) If the standard picture is inhibited for the input user code, the simple picture is inhibited from being replaced with the standard picture. This successfully draws a distinction between a plurality of operators.

(7) The current functions are registered at a memory assigned to the simple picture or the standard picture, and any of the registered functions is called from the associated memory and set up. This obviates defective image formation attributable to needless functions.

(8) The current functions are registered at a memory. Assume that when the registered functions are called from the memory, the picture appearing on the display means is the standard picture, or that although the picture is the simple picture, the functions called are not the functions which are available only with the standard picture. Then, the called functions are set up. If the picture appearing on the display means is the simple picture and if the called functions are the functions which are available only with the standard picture, the called functions are set up, and the picture is switched from the simple picture to the standard picture. This enhances the easy operation of the apparatus while obviating defective image formation attributable to needless functions.

(9) Functions set are registered at the memory. Only when a user code matching any one of the registered user codes is input, the apparatus is permitted to be used. Assume that the registering function is called after the picture assigned to the input user code has been displayed as the initial picture. Then, if the picture appearing on the display means is the standard picture or if it is the simple picture, but the called functions are not those available only with the standard picture, the called functions are set. If the picture appearing on the display means is the simple picture and if the called functions are those available only with the standard picture, and if the standard picture is inhibited for the input user code, the setting of the called functions and the substitution of the standard picture for the simple picture are inhibited. If the standard picture is permitted for the input user code, the called functions are set while the standard picture is substituted for the simple picture. This successfully draws a distinction between the operators, obviates defective image formation ascribable to needless functions, and enhances easy operation.

(10) When the first function clear command is input while a human body sensor is sensing a human body, the existing functions are cleared, and the picture on the display means is replaced with the initial picture. When the second or successive function clear command is input while the sensor is sensing a human body, the existing functions are cleared, but the replacement of the existing picture with the initial picture is inhibited. This frees the individual operator from the operation for switching the picture to the initial picture and thereby enhances easy operation.

(11) When no keys are operated for more than a predetermined period of time, the existing functions are automatically cleared while the existing picture is switched to the initial picture. When a function clear command is input, the existing functions are cleared, but the existing picture is inhibited from being replaced with the initial picture. This frees the individual operator from the operation for selecting the initial picture and thereby enhances easy operation.

(12) Because either the simple picture or the standard picture is set as the initial picture beforehand, it is possible for the individual operator to select the initial picture meeting the operator's needs.

(13) If the functions available only with the standard picture are set when the operator switches the picture on the display means from the standard picture to the simple picture, the above functions are held. Hence, even when the operator setting various functions including the above copy modes performs the picture switching operation by accident, it is not necessary for the operator to again set the original functions when restored the standard picture

(14) A message informing the operator of the fact that the functions not available with the simple picture are set is displayed in the simple picture. This obviates defective image formation attributable to needless functions.

Various modifications will become possible for those skilled in the art after receiving the teachings of the present disclosure without departing from the scope thereof. For example, while the illustrative embodiments have been shown and described in relation to a digital copier, the present invention is similarly applicable to other various kinds of image forming apparatuses including laser printers or similar optical printers and facsimile apparatuses.

What is claimed is:

1. An image forming apparatus comprising:

display means for displaying information on functions relating to an image forming operation;

position sensing means comprising a matrix touch switch provided on a display surface of said display means, and for sensing a position of said matrix touch switch touched by an operator;

function setting means for setting a function designated by said position touched by the operator;

picture display control means for causing said display means to selectively display a simple picture displaying only switches which allows a limited number of basic functions to be selected, or a standard picture displaying all switches which allows all functions including all of said limited number of basic functions to be selected; and picture switching means for selecting one of said simple picture and said standard picture and for switching directly from the simple picture to the standard picture and directly from the standard picture to the simple picture based on a set function.

2. An apparatus as claimed in claim 1, further comprising means for cancelling, when said standard picture is replaced with said simple picture by said picture switching means, functions available only with said standard picture.

3. An apparatus as claimed in claim 1, further comprising means for cancelling, when said standard picture is replaced with said simple picture by said picture switching means, all functions set.

4. An apparatus as claimed in claim 1, further comprising:

a user code setting means for setting user codes for distinguishing a plurality of operators;

display picture setting means for setting either said simple picture or said standard picture for each of said user codes set by said user code setting means; and permitting means for permitting, only when a user code matching any one of said user codes set by said user code setting means is input, said apparatus to be used, and causing said display means to display, as an initial picture, one of said simple picture and said standard picture set for said input user code.

5. An apparatus as claimed in claim 1, further comprising:

registering means for registering functions set by said function setting means for each of said simple picture and said standard picture;

calling means for calling said functions registered by said registering means and associated with either one of said simple picture and said standard picture; and means for causing said function setting means to set said functions called by said calling means.

6. An image forming apparatus comprising:

display means for displaying information on functions relating to an image forming operation;

position sensing means comprising a matrix touch switch provided on a display surface of said display means, and for sensing a position of said matrix touch switch touched by an operator;

function setting means for setting a function designated by said position touched by the operator;

picture display control means for causing said display means to selectively display a simple picture displaying only switches which allows a limited number of basic functions to be selected, or a standard picture displaying all switches which allows all functions including said limited number of basic functions to be selected;

picture switching means for selecting one of said simple picture and said standard picture and for switching from the simple picture to the standard picture and from the standard picture to the simple picture based on a set function;

registering means for registering functions set by said function setting means;

calling means for calling said functions registered by said registering means; and means for causing, if said standard picture is displayed on said display means when said functions are called for said registering means or if said simple picture is displayed on said display means, but said functions called are not functions available only with said standard picture, said function setting means to set said functions called, or causing, if said simple picture is displayed on said display means and if said functions called are said functions available only with said standard picture, said function setting means to set said functions called, and causing said picture switching means to replace said simple picture with said standard picture.

7. An image forming apparatus comprising:

display means for displaying information on functions relating to an image forming operation;

position sensing means comprising a matrix touch switch provided on a display surface of said display means, and for sensing a position of said matrix touch switch touched by an operator;

function setting means for setting a function designated by said position touched by the operator;

picture display control means for causing said display means to selectively display a simple picture displaying only switches which allows a limited number of basic functions to be selected, or a standard picture displaying all switches which allows all functions including said limited number of basic functions to be selected;

picture switching means for selecting one of said simple picture and said standard picture and for switching from the simple picture to the standard picture and from the standard picture to the simple picture based on a set function;

user code setting means for setting user codes for distinguishing operators;

display picture setting means for setting either said simple picture or said standard picture for each of said user codes set by said user code setting means;

means for setting, for each of said user codes, whether or not said standard picture is permitted to be used;

registering means for registering functions set by said function setting means;

calling means for calling said functions registered by said registering means;

permitting means for permitting, only when a user code matching any one of said user codes set by said user code setting means is input, said apparatus to be used, and causing said display means to display, as an initial picture, one of said simple picture and said standard picture set for said input user code; and means for causing, after said permitting means has caused said display means to display said initial picture, said function setting means to set functions called from said registering means by said calling means if said standard picture is displayed on said display means when said functions are called or if said simple picture is displayed on said display means, but said functions called are not functions available only with said standard picture, or inhibiting, if said simple picture is displayed on said display means, and if said functions called are said functions available only with said standard picture, and if said standard picture is inhibited for said input user code, said function setting means from setting said functions called, and inhibiting said picture switching means for replacing said simple picture with said standard picture, or causing, if said standard picture is permitted for said input user code, said function setting means to set said functions called, and causing said picture switching means to replace said simple picture with said standard picture.

8. An image forming apparatus comprising:

display means for displaying information on functions relating to an image forming operation;

position sensing means comprising a matrix touch switch provided on a display surface of said display means, and for sensing a position of said matrix touch switch touched by an operator;

function setting means for setting a function designated by said position touched by the operator;

picture display control means for causing said display means to selectively display a simple picture displaying only switches which allows a limited number of basic functions to be selected, or a standard picture displaying all switches which allows all functions including said limited number of basic functions to be selected;

picture switching means for selecting one of said simple picture and said standard picture and for switching from the simple picture to the standard picture and from the standard picture to the simple picture based on a set function;

sensing means for sensing a human body; and means for cancelling, when a first function clear command is input while said sensing means is sensing a human body, functions set by said function setting means, and causing said picture switching means to display an initial picture on said display means, or inhibiting, when a second or successive function clear command is input while said sensing means is sensing a human body, said picture switching means from displaying said initial picture while cancelling said functions set by said function setting means.

9. An apparatus as claimed in claim 8, further comprising means for setting either said simple picture or said standard picture as said initial picture.

10. An image forming apparatus comprising:

display means for displaying information on functions relating to an image forming operation;

position sensing means comprising a matrix touch switch provided on a display surface of said display means, and for sensing a position of said matrix touch switch touched by an operator;

function setting means for setting a function designated by said position touched by the operator;

picture display control means for causing said display means to selectively display a simple picture displaying only switches which allows a limited number of basic functions to be selected, or a standard picture displaying all switches which allows all functions including said limited number of basic functions to be selected;

picture switching means for selecting one of said simple picture and said standard picture and for switching from the simple picture to the standard picture and from the standard picture to the simple picture based on a set function;

automatic clearing means for automatically clearing, when said apparatus is not operated for more than a preselected period of time, functions set by said function setting means; and means for causing, when said functions are cleared by said automatic clearing means, said picture switching means to replace a picture appearing on said display means with an initial picture.

11. An apparatus as claimed in claim 10, further comprising means for setting either said simple picture or said standard picture as said initial picture.

12. An image forming apparatus comprising:

display means for displaying information on functions relating to an image forming operation;

position sensing means comprising a matrix touch switch provided on a display surface of said display means, and for sensing a position of said matrix touch switch touched by an operator;

function setting means for setting a function designated by said position touched by the operator;

picture display control means for causing said display means to selectively display a simple picture which allows a limited number of basic functions to be selected, or a standard picture which allows all functions including all of said limited number of basic functions to be selected;

picture switching means for directly switching between one of said simple picture and said standard picture; and means for handing over, when said simple picture is replaced with said standard picture by said picture switching means, functions set on said simple picture to said standard picture.

13. An image forming apparatus comprising:

display means for displaying information on functions relating to an image forming operation;

position sensing means comprising a matrix touch switch provided on a display surface of said display means, and for sensing a position of said matrix touch switch touched by an operator;

function setting means for setting a function designated by said position touched by the operator;

picture display control means for causing said display means to selectively display a simple picture which allows a limited number of basic functions to be selected, or a standard picture which allows all functions including all of said limited number of basic functions to be selected;

picture switching means for selecting one of said simple picture and said standard picture; and means for holding functions available only with said standard picture if said holding functions are set when said picture switching means replaces said standard picture with said simple picture.

14. An image forming apparatus comprising:

display means for displaying information on functions relating to an image forming operation;

position sensing means comprising a matrix touch switch provided on a display surface of said display means, and for sensing a position of said matrix touch switch touched by an operator;

function setting means for setting a function designated by said position touched by the operator;

picture display control means for causing said display means to selectively display a simple picture which allows a limited number of basic functions to be selected, or a standard picture which allows all functions including said limited number of basic functions to be selected;

picture switching means for selecting one of said simple picture and said standard picture;

user code setting means for setting user codes for distinguishing a plurality of operators;

display picture setting means for setting either said simple picture or said standard picture for each of said user codes set by said user code setting means;

permitting means for permitting, only when a user code matching any one of said user codes set by said user code setting means is input, said apparatus to be used, and causing said display means to display, as an initial picture, one of said simple picture and said standard picture set for said input user code;

means for setting, for each of said user codes, whether or not said standard picture is permitted to be used; and means for inhibiting, if said standard picture is not permitted for said input picture code, as determined after said initial picture has been displayed by said display means, said simple picture from being replaced with said standard picture.

15. An image forming apparatus comprising:

a display displaying information on functions relating to an image forming operation;

a position sensor comprising a matrix touch switch provided on a display surface of said display, and for sensing a position of said matrix touch switch touched by an operator;

a function setting unit setting a function designated by said position touched by the operator;

a picture display controller causing said display to selectively display a simple picture which allows a limited number of basic functions to be selected, or a standard picture which allows all functions including all of said limited number of basic functions to be selected;

a picture switch directly switching between one of said simple picture and said standard picture; and wherein, when said simple picture is replaced with said standard picture by said picture switch, functions set on said simple picture are handed over to said standard picture.

16. An image forming apparatus comprising:

a display displaying information on functions relating to an image forming operation;

a position sensor comprising a matrix touch switch provided on a display surface of said display means, and for sensing a position of said matrix touch switch touched by an operator;

a function setting unit setting a function designated by said position touched by the operator;

a picture display controller causing said display to selectively display a simple picture which allows a limited number of basic functions to be selected, or a standard picture which allows all functions including all of said limited number of basic functions to be selected;

a picture switch selecting one of said simple picture and said standard picture; and wherein functions available only with said standard picture are held if said held functions are set when said picture switch replaces said standard picture with said simple picture.

17. An image forming apparatus comprising:

a display displaying information on functions relating to an image forming operation;

a position sensor comprising a matrix touch switch provided on a display surface of said display, and for sensing a position of said matrix touch switch touched by an operator;

a function setting unit setting a function designated by said position touched by the operator;

a picture display controller causing said display to selectively display a simple picture which allows a limited number of basic functions to be selected, or a standard picture which allows all functions including said limited number of basic functions to be selected;

a picture switch selecting one of said simple picture and said standard picture;

a user code setting unit setting user codes for distinguishing a plurality of operators;

a display picture setting unit setting either said simple picture or said standard picture for each of said user codes set by said user code setting unit;

a permitting unit permitting, only when a user code matching any one of said user codes set by said user code setting means is input, said apparatus to be used, and causing said display to display, as an initial picture, one of said simple picture and said standard picture set for said input user code;

a setting unit setting unit, for each of said user codes, whether or not said standard picture is permitted to be used; and a controller inhibiting, if said standard picture is not permitted for said input picture code, as determined after said initial picture has been displayed by said display, said simple picture from being replaced with said standard picture.

18. An image forming method comprising the steps of:

displaying information on functions relating to an image forming operation;

sensing a position of a matrix touch switch touched by an operator;

setting a function designated by said position touched by the operator;

selectively displaying a simple picture which allows a limited number of basic functions to be selected, or a standard picture which allows all functions including all of said limited number of basic functions to be selected;

directly switching between one of said simple picture and said standard picture; and handing over, when said simple picture is replaced with said standard picture, functions set on said simple picture to said standard picture.

19. An image forming method comprising the steps of:

displaying information on functions relating to an image forming operation;

sensing a position of a matrix touch switch touched by an operator;

setting a function designated by said position touched by the operator;

selectively displaying a simple picture which allows a limited number of basic functions to be selected, or a standard picture which allows all functions including all of said limited number of basic functions to be selected;

selecting one of said simple picture and said standard picture; and holding functions available only with said standard picture if said holding functions are set when said standard picture is replaced with said simple picture.

20. An image forming method comprising the steps of:

displaying information on functions relating to an image forming operation;

sensing a position of a matrix touch switch touched by an operator;

setting a function designated by said position touched by the operator;

selectively displaying a simple picture which allows a limited number of basic functions to be selected, or a standard picture which allows all functions including said limited number of basic functions to be selected;

selecting one of said simple picture and said standard picture;

setting user codes for distinguishing a plurality of operators;

setting either said simple picture or said standard picture for each of said user codes set;

permitting, only when a user code matching any one of said set user codes is input, said method to be used, and for displaying, as an initial picture, one of said simple picture and said standard picture set for said input user code;

setting, for each of said user codes, whether or not said standard picture is permitted to be used; and inhibiting, if said standard picture is not permitted for said input picture code, as determined after said initial picture has been displayed, said simple picture from being replaced with said standard picture.

21. An image forming apparatus comprising:

a display displaying information on functions relating to an image forming operation;

a position sensor comprising a matrix touch switch provided on a display surface of said display, and for sensing a position of said matrix touch switch touched by an operator;

a function setting unit setting a function designated by said position touched by the operator;

a picture display controller causing said display to selectively display a simple picture displaying only switches which allows a limited number of basic functions to be selected or a standard picture displaying all switches which allows all functions including all of said limited number of basic functions to be selected;

a picture switch selecting one of said simple picture and said standard picture and for switching directly from the simple picture to the standard picture and directly from the standard picture to the simple picture based on a set function.

22. An apparatus as claimed in claim 21, further comprising a controller cancelling, when said standard picture is replaced with said simple picture by said picture switching means, functions available only with said standard picture.

23. An apparatus as claimed in claim 21, further comprising a controller cancelling, when said standard picture is replaced with said simple picture by said picture switching means, all functions set.

24. An apparatus as claimed in claim 21, further comprising a controller handing over, when said simple picture is replaced with said standard picture by said picture switching means, functions set on said simple picture to said standard picture.

25. An apparatus as claimed in claim 21, further comprising:

a user code setting unit setting user codes for distinguishing a plurality of operators;

a display picture setting unit setting either said simple picture or said standard picture for each of said user codes set by said user code setting unit; and a controller permitting, only when a user code matching any one of said user codes set by said user code setting unit is input, said apparatus to be used, and causing said display to display, as an initial picture, one of said simple picture and said standard picture set for said input user code.

26. An apparatus as claimed in claim 25, further comprising:

a setting unit setting, for each of said user codes, whether or not said standard picture is permitted to be used; and wherein said controller inhibits, if said standard picture is not permitted for said input picture code, as determined after said initial picture has been displayed by said display, said simple picture from being replaced with said standard picture.

27. An apparatus as claimed in claim 21, further comprising:

a register registering functions set by said function setting unit for each of said simple picture and said standard picture;

a calling unit calling said functions registered by said register and associated with either one of said simple picture and said standard picture; and a controller causing said function setting unit to set said functions called by said calling unit.

28. An apparatus as claimed in claim 21, further comprising:

a register registering functions set by said function setting unit;

a calling unit calling said functions registered by said register; and a controller causing, if said standard picture is displayed on said display when said functions are called from said register or if said simple picture is displayed on said display, but said functions called are not functions available only with said standard picture, said function setting unit to set said functions called, or causing, if said simple picture is displayed on said display and if said functions called are said functions available only with said standard picture, said function setting unit to set said functions called, and causing said picture switch to replace said simple picture with said standard picture.

29. An apparatus as claimed in claim 21, further comprising:

a user code setting unit setting user codes for distinguishing operators;

a display picture setting unit setting, either said simple picture or said standard picture for each of said user codes set by said user code setting unit;

a controller setting, for each of said user codes, whether or not said standard picture is permitted to be used;

a register registering functions set by said function setting unit;

a calling unit calling said functions registered by said register;

said controller permitting, only when a user code matching any one of said user codes set by said user code setting unit is input, said apparatus to be used, and causing said display to display, as an initial picture, one of said simple picture and said standard picture set for said input user code; and said controller causing, after said controller has caused said display to display said initial picture, said function setting unit to set functions called from said register by said calling unit if said standard picture is displayed on said display when said functions are called or if said simple picture is displayed on said display, but said functions called are not functions available only with said standard picture, or inhibiting, if said simple picture is displayed on said display, and if said functions called are said functions available only with said standard picture, and if said standard picture is inhibited for said input user code, said function setting unit from setting said functions called, and inhibiting said picture switching means from replacing said simple picture is permitted for said input user code, said function setting unit to set said functions called, and causing said picture switch to replace said simple picture with said standard picture.

30. An apparatus as claimed in claim 29, further comprising a controller setting either said simple picture or said standard picture as said initial picture.

31. An apparatus as claimed in claim 30, further comprising a controller setting either said simple picture or said standard picture as said initial picture.

32. An apparatus as claimed in claim 21, further comprising:

a sensor sensing a human body; and a controller cancelling, when a first function clear command is input while said sensor senses a human body, functions set by said function setting unit, and causing said picture switch to display an initial picture on said display, or inhibiting, when a second or successive function clear command is input while said sensor senses a human body, said picture switch from displaying said initial picture while cancelling said functions set by said function setting unit.

33. An apparatus as claimed in claim 21, further comprising:

an automatic clearing unit for automatically clearing, when said apparatus is not operated for more than a preselected period of time, functions set by said function setting unit; and a controller causing, when said functions are cleared by said automatic clearing unit, said picture switch to replace a picture appearing on said display with an initial picture.

* * * * *